US007494450B2

(12) United States Patent
Solomon

(10) Patent No.: US 7,494,450 B2
(45) Date of Patent: Feb. 24, 2009

(54) VARIABLE UNWEIGHTING AND RESISTANCE TRAINING AND STRETCHING APPARATUS FOR USE WITH A CARDIOVASCULAR OR OTHER EXERCISE DEVICE

(76) Inventor: Richard D. Solomon, 9432 Harvest Ct., St. Louis, MO (US) 63132

( * ) Notice: Subject to any disclaimer, the term of this patent is extended or adjusted under 35 U.S.C. 154(b) by 533 days.

(21) Appl. No.: 10/846,319

(22) Filed: May 14, 2004

(65) Prior Publication Data

US 2005/0255971 A1 Nov. 17, 2005

(51) Int. Cl.
*A63B 22/00* (2006.01)

(52) U.S. Cl. ..... 482/69; 482/51

(58) Field of Classification Search ..... 482/51, 482/54, 121–122, 124, 74, 69
See application file for complete search history.

(56) References Cited

U.S. PATENT DOCUMENTS

| | | | | |
|---|---|---|---|---|
| 3,721,437 | A | 3/1973 | Skaricic | 272/70.3 |
| 3,778,052 | A | 12/1973 | Andow et al. | 272/70.4 |
| 4,114,873 | A | 9/1978 | Jones | 272/61 |
| 4,279,415 | A | 7/1981 | Katz | 482/80 |
| 4,431,184 | A | 2/1984 | Lew et al. | 272/109 |
| 4,545,575 | A | 10/1985 | Forjot | 272/92 |
| 4,635,928 | A | 1/1987 | Ogden et al. | 272/69 |
| 4,655,447 | A | 4/1987 | Dubinsky et al. | 272/69 |
| 4,861,021 | A | 8/1989 | Edwards et al. | 272/69 |
| 4,898,378 | A | 2/1990 | Edwards et al. | 272/69 |
| 4,981,307 | A | 1/1991 | Walsh | 280/290 |
| 5,000,440 | A | 3/1991 | Lynch | 272/69 |
| 5,104,119 | A | 4/1992 | Lynch | 482/5 |
| 5,171,196 | A | 12/1992 | Lynch | 482/7 |
| 5,187,822 | A | 2/1993 | Merry | 5/86.1 |
| 5,221,241 | A | 6/1993 | Bare, II | 482/43 |
| 5,234,392 | A | 8/1993 | Clark | 482/54 |
| 5,242,339 | A | 9/1993 | Thornton | 482/8 |
| 5,242,343 | A | 9/1993 | Miller | 482/57 |
| 5,372,561 | A | 12/1994 | Lynch | 482/54 |
| 5,383,829 | A | 1/1995 | Miller | 482/57 |
| 5,401,226 | A | 3/1995 | Stearns | 482/53 |
| 5,518,473 | A | 5/1996 | Miller | 482/57 |
| 5,527,239 | A | 6/1996 | Abbondanza | 482/8 |
| 5,562,574 | A | 10/1996 | Miller | 482/51 |
| 5,577,984 | A | 11/1996 | Bare, II | 482/43 |
| 5,577,985 | A | 11/1996 | Miller | 482/52 |
| 5,584,783 | A * | 12/1996 | Hagg et al. | 482/57 |
| 5,603,677 | A | 2/1997 | Sollo | 482/69 |
| 5,611,756 | A | 3/1997 | Miller | 482/52 |

(Continued)

OTHER PUBLICATIONS

*The Complete Idiot's Guide To The Pilates Method*, © 2001, by Karon Karter, Chapters 13 & 24, pp. 181-209.

(Continued)

*Primary Examiner*—Fenn C Mathew

(57) ABSTRACT

A device for variably unweighting or unloading and performing resistance exercises and stretches while performing cardiovascular exercises on a cardiovascular exercise machine or other exercise device, including a plurality of exercise elements at different locations above the machine or device, the exercise elements being graspable individually or in a selected number and resiliently extended in a variety of directions for reducing forces applied against movable elements of the exercise machine or device and for performing a variety of resistance exercises and stretches.

22 Claims, 40 Drawing Sheets

U.S. PATENT DOCUMENTS

| | | | | | |
|---|---|---|---|---|---|
| 5,653,670 | A | | 8/1997 | Endelman | 482/142 |
| 5,662,560 | A | | 9/1997 | Svendsen et al. | 482/69 |
| 5,667,461 | A | * | 9/1997 | Hall | 482/69 |
| 5,704,341 | A | | 1/1998 | Ritzenthaler | 124/8 |
| 5,704,881 | A | | 1/1998 | Dudley | 482/69 |
| 5,733,229 | A | | 3/1998 | Dalebout et al. | 482/54 |
| 5,755,642 | A | | 5/1998 | Miller | 482/51 |
| 5,788,606 | A | | 8/1998 | Rich | 482/27 |
| 5,788,609 | A | | 8/1998 | Miller | 482/51 |
| 5,792,033 | A | | 8/1998 | Merrithew | 482/96 |
| 5,816,983 | A | * | 10/1998 | Dawes et al. | 482/78 |
| 5,860,894 | A | | 1/1999 | Dalebout et al. | 482/54 |
| 5,871,421 | A | | 2/1999 | Trulaske et al. | 482/54 |
| 5,899,833 | A | | 5/1999 | Ryan et al. | 482/52 |
| 5,906,564 | A | | 5/1999 | Jacobsen | 482/96 |
| 5,911,649 | A | | 6/1999 | Miller | 482/52 |
| 5,947,872 | A | | 9/1999 | Ryan et al. | 482/51 |
| 6,045,487 | A | | 4/2000 | Miller | 482/52 |
| 6,099,439 | A | | 8/2000 | Ryan et al. | 482/51 |
| 6,120,425 | A | | 9/2000 | Endelman | 482/142 |
| 6,146,315 | A | | 11/2000 | Schönenberger | 482/69 |
| 6,176,814 | B1 | | 1/2001 | Ryan et al. | 482/51 |
| 6,186,929 | B1 | | 2/2001 | Endelman et al. | 482/121 |
| 6,261,250 | B1 | * | 7/2001 | Phillips | 601/23 |
| 6,273,844 | B1 | | 8/2001 | Kelsey et al. | 482/54 |
| 6,302,828 | B1 | | 10/2001 | Martin et al. | 482/69 |
| 6,338,704 | B1 | | 1/2002 | Endelman | 482/142 |
| 6,371,895 | B1 | | 4/2002 | Endelman et al. | 482/135 |
| 6,398,695 | B2 | | 6/2002 | Miller | 482/52 |
| 6,436,009 | B1 | | 8/2002 | Marucci | 482/54 |
| 6,450,923 | B1 | | 9/2002 | Vatti | 482/8 |
| 6,554,747 | B1 | * | 4/2003 | Rempe | 482/38 |

OTHER PUBLICATIONS

*The Everything Pilates Book*, © 2002, by Amy Taylor Alpers & Rachel Taylor Segel, Chapter 6, pp. 67-84.

Catalog entitled *Finely crafted Pilates equipment*, © Jan. 2003, by Balanced Body, Inc.

Catalog entitled *Catalog 37 Physical Medicine & Rehabilitation*, © May 2003, by Biodex Medical Systems, Inc.

*BiodexNews*, Autumn 2003 Edition, published by Biodex Medical Systems, Inc.

Article entitled *Treadmill Ambulation With Partial Body Weight Support for the Treatment of Low Back and Leg Pain*, published in the Journal of Orthopaedic & Sports Physical Therapy, vol. 32, No. 5, May 2002.

*Rehabilitation Of The Spine*, by Stephen H. Hocuschuler et al., Chapter 38, entitled *Rehabilitation of Degenerative Disease of the Spine*, pp. 457 & 466-467.

Brochure entitled *ZUNI Incremental Weightbearing System . . .*, © 1995, by SOMA, Inc.

Advertisement entitled *Return on Investment: Pilates Allegro® Classes, Semi-Private Training And Personal Training*, by Balanced Body, Inc.

Advertisement entitled *Vertical Rehabilitation*, by National Medical Alliance.

Advertisement entitled *Pneu-Weight: The Key To Expand*, by Malcolm Macaulty, P.T., Isernhagen Clinics, Inc.

Article entitled *Space Research is Enhancing Our Understanding of the Control of Muscle and Movement and Aiding Patients with Spinal Cord Injuries*, © 2000, by Office of Biological & Physical Research, National Aeronautics and Space Administration.

Information from website www.stottpilates.com/equip.html, regarding Pilates equipment, by Stott Pilates, dated Feb. 5, 2003.

Information from website www.pilates.com, regarding custom Pilates equipment, by Balanced Body, Inc., dated Feb. 5, 2003.

Information from website www.pilates.com, regarding Reformer/Half Trapeze Combination, by Balanced Body, Inc., dated Feb. 5, 2003.

Information from website www.zlift.com, regarding Z-Lift in Body-Weight Support Therapy & Training, by Z-Lift Corporation, dated May 24, 2001.

* cited by examiner

VARIABLE UNWEIGHTING AND RESISTANCE TRAINING AND STRETCHING APPARATUS FOR USE WITH A CARDIOVASCULAR OR OTHER EXERCISE DEVICE

TECHNICAL FIELD

This invention relates generally to an exercise device, and more particularly, to an exercise device for use while performing a cardiovascular exercise such as walking or running on a treadmill, cycling on a stationary bicycle, or other cardiovascular exercise using a cardiovascular or other exercise device or machine, which provides the capability for unweighting or unloading in a variety of ways a desired portion of the person's weight supported on weight bearing elements of the cardiovascular exercise device or machine, and performing numerous resistance exercises and stretches.

BACKGROUND ART

Cardiovascular exercise machines such as, but not limited to, treadmills, stationary cycles, and elliptical machines, and devices such as exercise balls, also known as Swiss balls, are well known in the exercise, fitness and rehabilitation fields, for both gymnasium and home use. Such machines and devices, when used properly, can provide excellent cardiovascular and endurance benefit, build strength, and serve a rehabilitation function.

Currently, to allow use of some cardiovascular exercise machines during rehabilitation, particularly the use of treadmills for rehabilitating the legs, it has been necessary or customary in some instances to also use apparatus termed herein as "unweighting" or "unloading" apparatus, that is, apparatus for reducing or unloading a portion of the user's weight applied against one or more weight bearing elements of the device, particularly the moving belt of a treadmill. Such unweighting or unloading apparatus typically include, for instance, a harness worn about the torso and suspended from a gantry or frame disposed above the user, which can be used for supporting all or a portion of the user's weight, such that none or only a desired portion of the user's weight is applied against the weight bearing element of the machine. Also, it is known to provide railings and handles beside the treadmill that can be grasped and held as desired or required for steadying, and for supporting a portion of the user's weight through the arms. Reference in this regard, Schonenberger U.S. Pat. No. 6,146,315 issued to Woodway AG of Schonenberg, Switzerland.

Still further, it is known to provide apparatus for performing limited upper body cardiovascular exercises in conjunction with lower body exercises, for example the well known Nordic skiing machines, and the treadmills shown in Lynch U.S. Pat. No. 5,171,196 which disclose essentially levers that can be manipulated during the exercise; and Lynch U.S. Pat. No. 5,000,440 which discloses an upper body muscle stressing device for use with a treadmill.

Addressing shortcomings of the above referenced devices for use with cardiovascular exercise machines, the known harness type unloading devices can be hot, uncomfortable, and fit poorly. Additionally, increasing the amount of weight carried by a harness typically involves raising the harness and thus the person, which can increase discomfort, particularly at greater levels of unloading where the harness and the person are lifted more. The harnesses are also typically tight fitting and substantially restrict side to side and front to rear movement. It is known to attempt to reduce the discomfort of harnesses by adding elements thereto for supporting the person more in the hip or thigh region. However, supporting a person by the lower body or hip region can exert uncomfortable or painful forces on the person's back and pelvic region, which can make such harnesses undesirable or unusable for those suffering or recovering from back or pelvic injury or disease. Finally, harness type devices provide no resistance exercise or stretching benefit.

Rigid railings and handles located at fixed positions beside a treadmill suffer from the shortcoming of a lack of a capability for varying the orientation and position of the hands when grasping the railing and handles, which may result in limitation in the ability of the user to find a way of comfortably unloading, particularly for extended periods of time. The hardness of the railings and handles may also cause pain for persons with soft, fragile or sensitive skin and/or hands and/or arthritis which are common in elderly persons. Fixed railings and handles also can provide only very limited resistance exercise and stretching benefit.

Shortcomings of known Nordic skiing machines, which generally have handles connected to the ends of ropes or cables or poles movable reciprocally forwardly and rearwardly, include a limitation to a single or slightly variable repetitive movement, which can eventually become boring, and lead to repetitive use injuries. Also, only a limited manner of resistance exercise or stretching benefit is realized from use of skiing machines, namely in one direction, the rearward or posterior direction. And, some users with injuries and or disease, or who are recovering from surgery or the like may not be able to find a comfortable position for using the devices.

Regarding known levers or handles associated with treadmills and other machines and movable for performing resistance exercises, such devices are located at a fixed location or in only a small number of alternative locations or orientations and thus cannot provide desirable variability in the manner of performing the exercise, which can lead to boredom and repetitive use injury. Also, limited or no unloading or stretching benefit may be realized by their use. U.S. Pat. No. 5,000,440 referenced above actually increases loading due to reliance on weights for providing resistance exercise benefit. It is known to use exercise balls alone for performing a variety of exercises including sit ups, crunches and the like, and with other devices such as resiliently elongatable cords, cable type weight machines and free weights. The softness of the balls provides a desirable alternative to exercising on a relatively harder floor or bench. However, developing and using balance is typically an objective when exercising with such exercise balls, and for some persons, this may be difficult or disadvantageous.

Another type of exercise device presently known for performing Pilates type exercises utilizes a base supporting a platform for reciprocal movement on which a person can sit, stand or lie while pushing or pulling on biasing members such as springs and/or elastic cords, for achieving weight unloading, resistance exercise and stretching benefits. An observed limitation of such Pilates type devices, however, is a lesser cardiovascular exercise benefit comparable to what can be achieved using treadmills, stationary cycles, and elliptical machines.

With special regard to rehabilitating or recuperating from an injury, and exercising with a chronic injury or disease particularly of the back, it has been found that it can be desirable and important to have the ability to unload at least a portion of the user's body weight in several ways and in varying degrees, and to be able to change the manner of unloading, sometimes several or many times during a cardiovascular exercise session, to achieve comfort and possibly even to have the ability to conduct the exercise at all.

For fitness and rehabilitation purposes, it has also been found that there can be benefit to having the ability to perform a variety of resistance exercises and stretches, and to perform particular exercises in a variety of ways, particularly including both concentric and eccentric exercises of various muscles and muscle groups, while doing a cardiovascular exercise, for fitness benefit, including increasing strength and endurance. Herein, the term concentric is defined as shortening muscle actions in opposition to a load, and the term eccentric is defined as lengthening muscle actions in opposition to a load. Thus, concentric contractions are defined as movements that shorten muscles in opposition to a load, and eccentric contractions resist lengthening of muscles by application of a load. As an example, if an arm curl were to be performed while walking or running on a treadmill wherein the arm is curled to bring the forearm to the chest while holding a dumb bell in the hand, the biceps of the arm would be subjected to a concentric contraction (shortening to raise the load). Then, as the arm is controllably lowered, the biceps would be subjected to eccentric action (resisting elongation in opposition to the load). This provides a fitness benefit. However, because the user is holding a weight, the body is being loaded, that is, the loading on the lower body is increased by the weight, which can be undesirable, particularly to a person for whom unloading is a necessity. And, the load or weight is always acting downwardly which limits the variety of exercises that can be performed, the muscle groups affected, and, as a result, the benefits obtained. The same limitation would be present when using the body stressing device disclosed in Lynch U.S. Pat. No. 5,000,440 referenced above. Some persons with injury or disease may not be able to perform certain resistance exercises in the manner or manners possible using weights. As an alternative, if resistance from a variety of directions were possible, such as from the side, the front, the rear, and above, the variety of exercises possible, the muscle groups affected, and the benefits achieved would be increased, and, it is more likely that a user who has problems with downwardly directed loads would be able to find one or more manners of comfortably exercising a particular muscle group.

The abilities to asymmetrically unload, that is, unload one side of the body to a different degree or in a different manner compared to the contralateral or opposite side of the body; to perform unilateral or one sided resistance exercises, that is, exercises of a muscle group on one side of the body in one manner or plane, and a muscle group on the other side of the body in another manner or plane; and to perform simultaneous resisted exercises in multiple planes, have been found to provide numerous benefits, including increasing the time period that the person can exercise before exhaustion or the onset of pain and/or stiffness. Some persons with injury and/or disease may require the capability to exercise in multiple planes and/or in multiple ways for pain avoidance and comfort.

Therefore, what is sought is apparatus for use with a cardiovascular exercise machine or device such as, but not limited to, a treadmill, a cycle, or an elliptical machine, a stair stepper, and other exercise devices and machines, such as exercise or Swiss balls, or alone, which apparatus allows unloading a desired portion of a user's weight from weight bearing elements of the device in a variety of different manners, and easily and rapidly changing the manners of unloading, while also simultaneously performing a wide variety of upper body, lower body, and trunk resistance exercises and stretches in a wide variety of different ways, including both concentric and eccentric loading, and using different amounts of resistance, for obtaining various benefits including reduction of stress on the back and lower extremities, rehabilitation, resistance exercise and stretching benefit, including strengthening and increased flexibility, and for making the exercise session more productive and enjoyable, and the user more compliant and fit.

DISCLOSURE OF THE INVENTION

What is disclosed is variable unweighting and resistance training and stretching apparatus for use with a cardiovascular or other exercise device or machine, or alone, which overcomes many of the shortcomings and provides many of the advantages sought above, including the ability to unload a desired portion of a user's weight from weight bearing elements of the device or machine in a rapidly changeable manner as desired or required, while also simultaneously performing a wide variety of strengthening or resistance exercises and stretches in a wide variety of different ways, including both eccentric and concentric exercises, using varying amounts of resistance.

A typical cardiovascular or other exercise device or machine with which the present apparatus can be used supports the person at a predetermined location at which the person can apply a force against at least one weight supporting element of the device or machine. The present variable unloading and resistance exercise training apparatus includes a support structure disposed over, adjacent to, or around at least a portion of the predetermined location, and a plurality of flexible, resiliently biasable, elastically stretchable, or elongatable exercise elements supported by, connected to, and/or suspended from the support structure at different locations above and adjacent to the predetermined location. The locations preferably include in front of (anterior), behind (posterior), beside (lateral), and above the person.

Preferred ones of the exercise elements include at least one portion which, when in a free state or not biased, stretched or elongated by a user, is positioned to be grasped in a hand of the person or otherwise held or connected to the person, and which is displaced or moved by application of a force thereagainst in any of a plurality of directions, including downwardly for resiliently elongating or stretching the exercise element for unloading or unweighting purposes, and for performing resistance exercises that are different from the resistance exercises performed when others of the exercise elements at other locations are grasped by the person and displaced and resiliently elongated. In particular, it is sought for the apparatus of the invention to provide the ability to exercise and/or stretch multiple muscle groups in multiple planes, including the frontal, saggital, and transverse planes.

According to a further preferred aspect of the invention, the exercise elements at the first and second locations each include a plurality of resiliently elongatable cords of a solid or tubular elastic rubbery material, a selected number of which, or all of which, at each location can be grasped and elongated to allow varying the amount or level of force required. The directions in which the exercise elements are preferable movable include downward, upward, sideward toward and away from the user, and forwardly and rearwardly, so as to allow varying the exercises that can be performed, including the desired concentric and eccentric actions of targeted or selected muscle groups, and the plane or planes in which the exercises are performed.

As a result of the ability to exercise multiple muscle groups in multiple planes, the present apparatus allows performing or mimicking complex motor movements and tasks, for instance, throwing and rowing, which can be particularly advantageous for rehabilitation and training purposes, such as for developing and/or improving balance and core body strength. Performing multiple exercises in multiple planes during a cardiovascular exercise is also believed to improve coordination.

A preferred support structure of the apparatus is of tubular construction including at least one member disposed above the predetermined location for supporting the exercise elements. The structure can further include one or more movable members preferably supported on low friction elements such as slides, rollers, bearings, or the like, for movement preferably in forward and rearward directions, but also or alternatively in upwardly and downwardly and sideward directions, as desired. The movable member preferably supports at least some of the exercise elements that can be grasped by the user, and can be moved into a desired or required position relative to a user, or with the user as he or she moves within the predetermined area of the cardiovascular machine, which can be for instance the belt of a treadmill. The movable member can optionally be connected to the support structure or another fixed structure by one or more resiliently yieldable and/or biasable elements such that movement of the movable member itself provides resistance, for varying and/or accentuating one or more of the resistance exercises and stretches, and/or to provide optional resistance in multiple directions of movement. For example, a user can grasp and resiliently extend one or more exercise elements attached to the movable member for performing an exercise in one way, and sequentially or simultaneously move the movable member in opposition to the resiliently yieldable and/or biasable member or members connecting it to the support frame, to provide additional resistance exercise and stretching benefit. Here, it can be noted that the exercise elements supported on the movable member can be extended in one or more directions which can be different from the direction or directions that the movable member is moved, to provide resistance in multiple directions.

The support structure can optionally be connected to and/or supported by the cardiovascular exercise or other machine or device, or separate therefrom, and easily foldable or collapsible for compact storage when not in use. Additionally, optional apparatus can be provided for variously lifting or raising the apparatus relative to the cardiovascular machine or for raising both, or for raising the cardiovascular exercise device relative to the present apparatus, for providing a desired fit, position or orientation for different users and/or applications, and for varying the exercise capabilities of the apparatus.

The present device can be used with a wide variety of cardiovascular exercising machines, such as, but not limited to, a treadmill, a stationary cycle, and those machines commonly known as an elliptical machine, a stair stepper machine, and an arc trainer machine, respectively, with exercise or Swiss balls, or by itself. In operation, while doing a cardiovascular exercise on a cardiovascular or other exercise machine or device or using the present apparatus alone, the user can selectably grasp one or more of the exercise elements located at any desired one or ones of the locations, and move or resiliently elongate the exercise element or elements to a desired extent, to achieve a sought after resistance benefit and/or stretch, and if extended in a downward direction, for simultaneously achieving an unweighting or unloading benefit, that is, a reduction in the downward load or force exerted by the user's body against a weight bearing element or elements of the cardiovascular exercise machine, exercise device or the floor or another surface or object, different ones of the exercise elements at one or more of the locations being easily and readily graspable and resiliently extendible in different directions for varying the muscle groups exercised, such as in a manner for performing both concentric and eccentric exercises of selected muscles and muscle groups, to provide a broad range of benefits and to make the exercise session more enjoyable. Some of the exercise elements may also be positioned to allow exercising therewith by a person not located on the cardiovascular exercise machine, but instead standing, seated or lying on the floor or another surface adjacent to the machine.

As another preferred aspect of the invention, the present apparatus can include a sound and/or a video system for playing music and/or video media during an exercise session, for entertainment, instructional, or informational purposes, as desired or required.

DETAILED DESCRIPTION OF THE PREFERRED EMBODIMENTS

Figure 1:
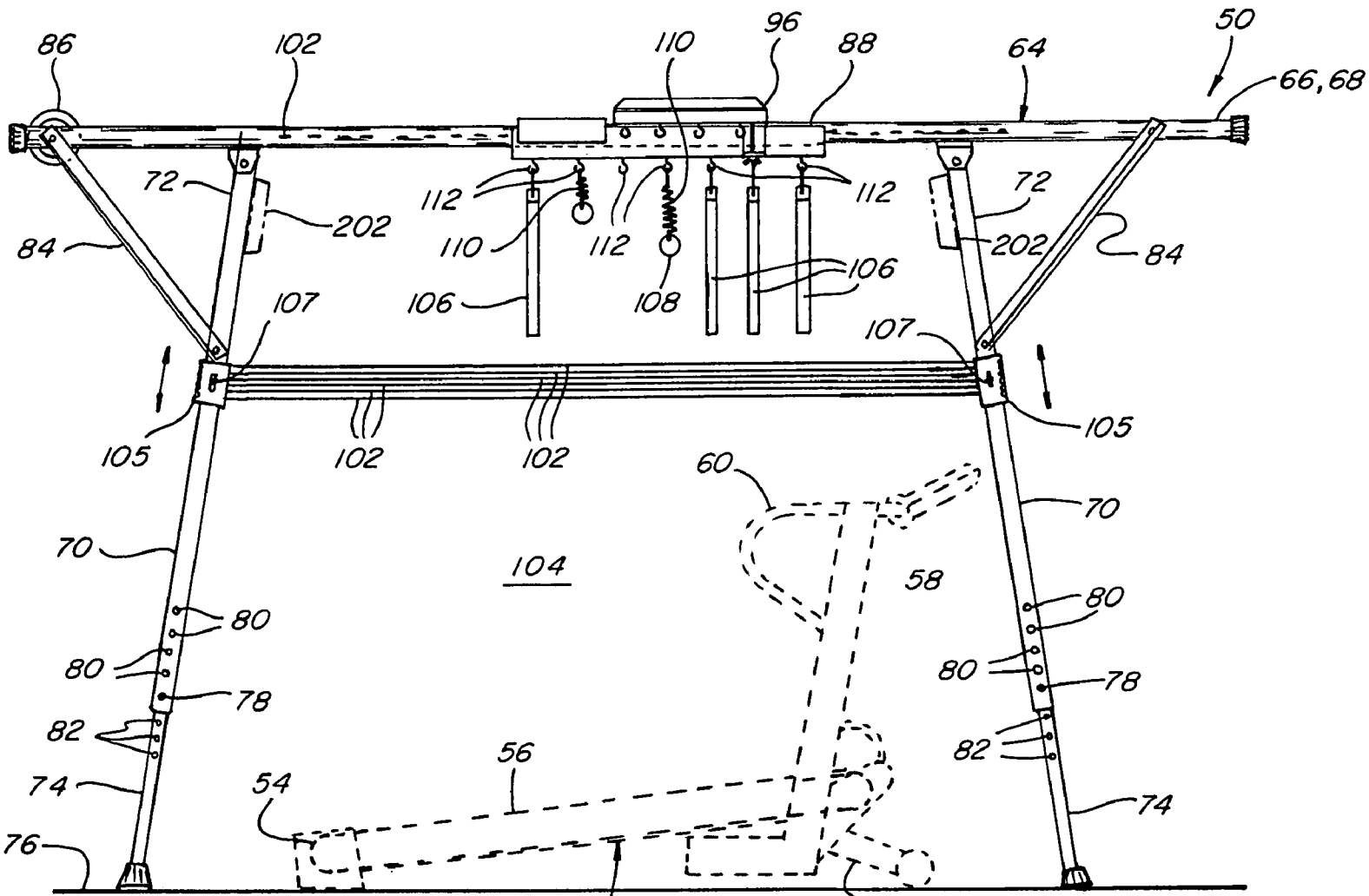
FIG. 1 is a side elevationable view of a variable unloading and resistance training and stretching apparatus according to the present invention, shown including various representative resiliently elongatable exercise elements at predetermined locations thereon, shown in association with a cardiovascular exercise device which is a conventional prior art treadmill.
Figure 2:
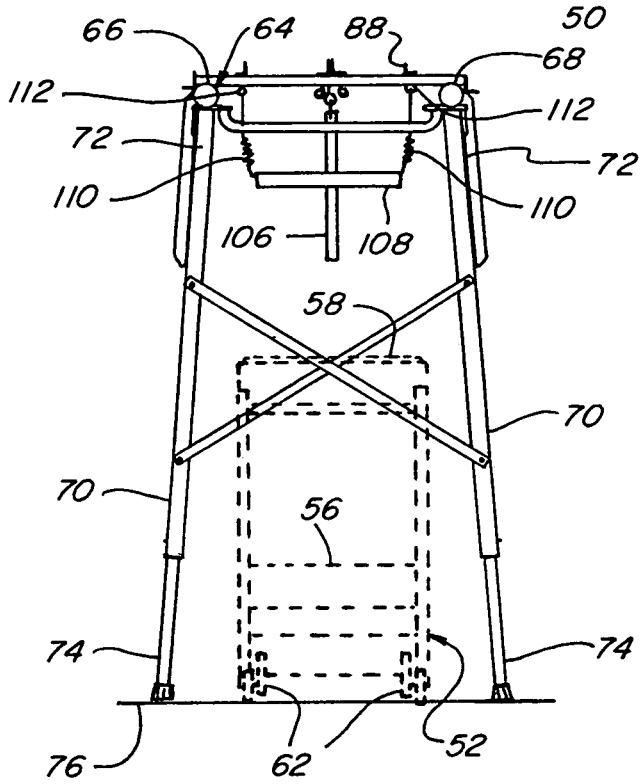
FIG. 2 is a forward end view of the apparatus and treadmill of FIG. 1.
Figure 3:
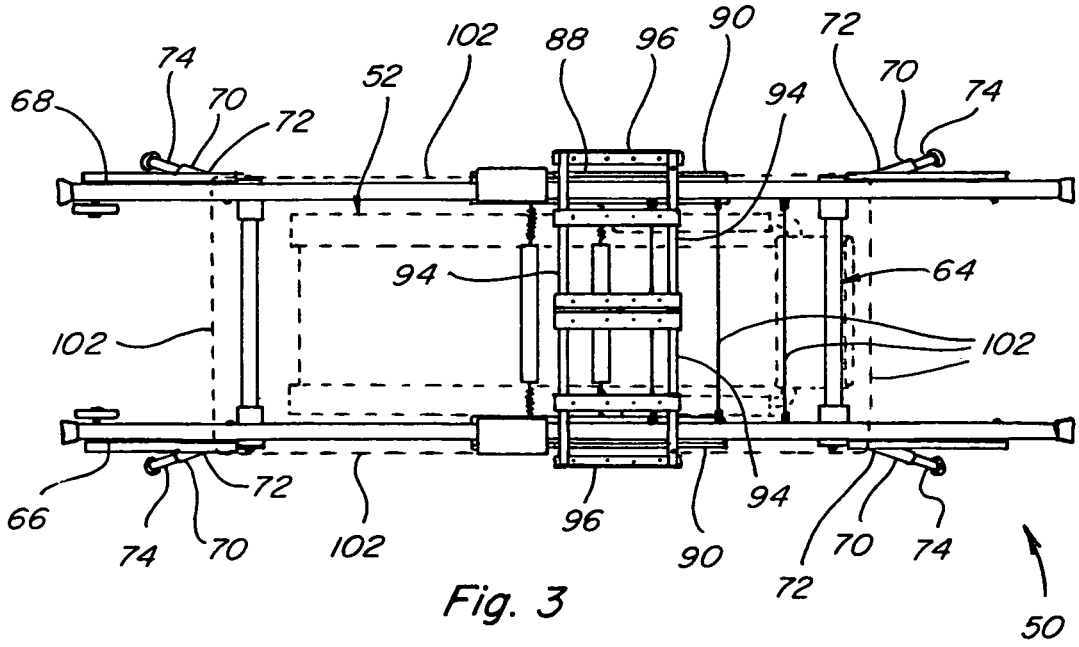
FIG. 3 is a top view of the apparatus of FIG. 1.

Referring now to the drawings, in FIGS. 1, 2 and 3, preferred variable unloading and resistance training and stretching apparatus 50 constructed and operable according to the teachings of the present invention is shown in association with a representative prior art cardiovascular exercise machine which here is a treadmill 52 of well known, conventional construction and operation. Essentially, treadmill 52 includes an endless belt 54 powered by a motor, belt 54 including a forwardly to rearwardly moving upwardly facing upper surface 56, the forward to rearward and side to side extent of which defines a predetermined weight bearing area which is contacted by the person's feet as part of the walking or running exercise. Treadmill 52 additionally includes an electrical console 58 including at least one control (not shown) for adjusting speed and inclination of surface 56, and at least one display (also not shown) for displaying information, such as speed, degree of inclination, calories burned, and the like. Treadmills such as treadmill 52 typically also includes at least one handle, such as a handle 60 that can be grasped by the user during the exercise, and the inclination of upper surface 56 can be varied in any suitable manner, such as by an electrically controlled pivoting leg 62.

Variable unloading and resistance training apparatus 50 is supported generally above the predetermined area defined by upper surface 56 of treadmill 52 and includes a rigid support structure 64 preferably including a pair of elongate horizontal support members 66 and 68 oriented and positioned in parallel, spaced relation extending forwardly to rearwardly above upper surface 56 of treadmill 52. Support structure 64 additionally includes four upstanding legs 70 located generally adjacent to and outwardly of the four corners of treadmill 52, each leg including an upper end 72 connected to one of the support members 66 or 68, and a lower end 72 located on a floor 76, the ground or another horizontal surface, for supporting support members 66 and 68 at a desired height and orientation above upper surface 56, as shown. Each leg 70 is additionally preferably adjustable in length in any suitable, convenient manner, for adjusting the height and orientation or degree of inclination, if any, of support structure 64 above surface 56, such as by adjustable telescopic engagement between upper and lower ends 72 and 74. Suitable detent elements such as pins 78 receivable through aligned holes 80 and 82 in ends 72 and 74, respectively, or clamps, set screws or the like (not shown) can be used for adjusting the length of legs 70 and thus, the height and orientation of support member 66 and 68 over surface 56, as desired. As an example, the orientation of support members 66 and 68 can be altered or adjusted by shortening or lengthening legs 70 at one end of support structure 64 such that support structure 64 can be inclined at a small acute angle to horizontal above surface 56, for instance, at a corresponding angle to floor 76, as desired.

For holding support members 66 and 68 and legs 70 in the desired relation one relative to the other, as shown, support structure 64 additionally includes a plurality of diagonal braces 84 connected between support members 66 and 68 and legs 70. Legs 70 are preferably pinned or otherwise pivotally connected to support members 66 and 68, such that when braces 84 are disconnected, legs 70 can be folded into parallel or almost parallel relation to support members 66 and 68 into a more compact size, for transportation and storage of apparatus 50. To facilitate movement in the folded state, support members 66 and 68 can each include a small wheel 86, a skid or the like at one end for easy movement of that end over a floor, the ground or other surface.

Figures 4, 5, 5A:
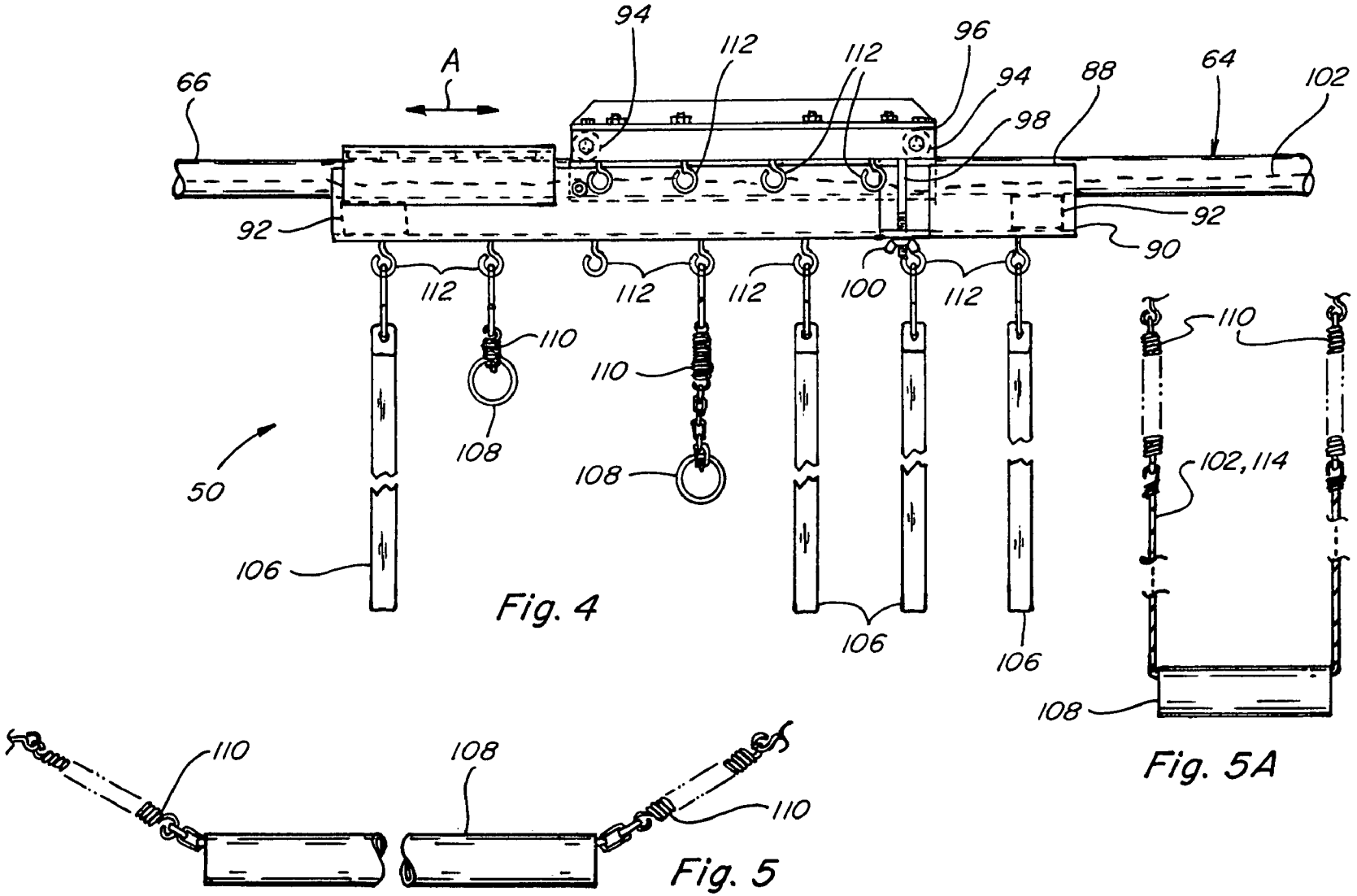
FIG. 4 is an enlarged, fragmentary side view of support structure of the apparatus, showing a movable member thereof supporting a plurality of exercise elements.
FIG. 5 is an end view of one representative type of exercise element of the apparatus of FIG. 1.
FIG. 5A is a side view of another representative exercise element usable with the apparatus of FIG. 1.

Referring also to FIG. 4, support structure 64 of apparatus 50 is shown including an optional movable frame member 88 supported on and spanning the space between support members 66 and 68, preferably for forward and rearward movement above and optionally beyond upper surface 56 of treadmill 52 or other exercise machine or device, as denoted by arrow A. Frame member 88 has a generally rectangular shape when viewed from above or below (FIG. 3), and includes a pair of forwardly to rearwardly extending elongate arms 90 of L-shape section oriented and positioned so as to extend parallel to support members 66 and 68, respectively. Arms 90 are each positioned just outwardly of and below the respective support member 66 and 68 and include smooth, low friction slide blocks 92 of low friction plastics or other similar material disposed in contact with support members 66 and 68 for ease of movement relative thereto. Frame member 88 includes cross bars 94 extending between and connecting arms 90 above support members 66 and 68 so as to move together therealong. Frame member 88 is shown additionally including a pair of brakes 96 adjacent one end thereof above and operative in cooperation with the corresponding slide block 92 so as to be squeezable or compressible together, for instance, using a threaded fastener 98 and wingnut 100, a lever or the like, for controlling movement of or holding frame member 88 at a desired or required location along support members 66 and 68. Each brake 96 preferably includes a friction lowering material, a low friction plastics material, or the like, on the surface in contact with support members 66 and 68 to allow easy movement of frame member 88 thereover when braking is not desired.

Importantly, support structure 64 supports and holds a plurality of resiliently biasable exercise elements in different positions generally above or above and beside upper surface 56 of treadmill 52. Here, representative exercise elements include, but are not limited to, a plurality of resiliently elongatable elastic cords 102 extending forwardly and rearwardly between legs 70 adjacent opposite sides of an area 104 over upper surface 56, as best shown in FIG. 1. Cords 102 can be of any desired composition and/or construction, such as of a rubbery resilient polymer, and can be solid or tubular in cross-section and have different cross-sectional extents, such as available from a variety of well known exercise equipment manufacturers. As will be shown, cords 102 are shown at a preferred location above surface 56 so as to be beside about the upper trunk or shoulders of the body of a person positioned on upper surface 56 when performing a cardiovascular exercise thereon such as running or walking in area 104. Cords 102 in their normal or free state, are shown as being generally parallel and horizontal, but could also be oriented at one or more desired angles relative to horizontal, as desired. For example, cords 102 are shown here supported by sleeves 105 that extend around legs 70, respectively, sleeves 105 and thus cords 102 being slidably movable along the legs and securable at a desired position using a suitable detent element 107 which for instance can be a set screw, releasable clamp, or the like. It should be noted that here the contemplated normal state for cords 102 extending between legs 70 is a partially stretched or elongated state, it thus being possible to further stretch or elongate all or a desired number of the cords for performing a particular exercise or stretch.

Essentially, as will be shown, when performing a cardiovascular exercise such as walking or running on a treadmill 52, a user can grasp one or more of cords 102 and elongate the cords in a variety of directions, including a downward direction, an upward direction, a forward direction, a rearward direction, and sideward directions toward and away from area 104, for performing a desired resistance exercise or exercises involving eccentric and/or concentric actions of desired muscles and muscle groups, as well as stretches. Importantly, any downwardly directed component of forces exerted by the person against cords 102 will result in a corresponding reduction in weight loads exerted by the user against upper surface 56 of treadmill 52, or a weight bearing element of another cardiovascular machine being used, which provides benefits and advantages, as will also be explained.

Support structure 64 is also shown supporting and holding a plurality of other exercise elements according to the invention above upper surface 36 and area 104, including downwardly extending elongate, resiliently biasable or elongatable straps 106, and horizontal bars 108 suspended from resiliently elongatable cords or springs 110, straps 106 and springs 110 being suspended from hooks or eyelets 112 or other suitable connectors on frame member 88. Further, additional cords 102 are supported by support structure 64 generally between support members 66 and 68 directly above surface 56 and area 104, as best shown in FIG. 3. Frame member 88 as well as support members 66 and 68 and other portions of support structure 64 can include additional connectors such as eyelets 112 at a variety of locations thereon to allow attachment of various other exercise elements, as required and/or desired.

FIG. 5 is an end view of the bar type exercise element 108 showing springs 110, which here, are conventional commercially available spring steel extension springs having known spring rates, but which could alternatively or additionally include or comprise cords such as polymeric cords 102 of solid or tubular construction and having known coefficients of elasticity, as required to provide a desired resistance to elongation or other resilient biasing characteristics.

FIG. 5A shows a variant of the exercise element including bar 108 and springs 110, wherein bar 108 is shorter than shown in FIG. 5 and is suspended from springs 100 on an elongatable cord 102, or alternatively, a non-elongatable cord 114. Here, it should be noted that bars 108 can be of any desired length, springs 110 can have any desired spring coefficient or rate, and the exercise element can be suspended from eyelets 112 or other suitable connectors or portions on support structure 64 such that bars 108 are oriented so as to extend horizontally, or at any desired angle to horizontal, and so as to extend in the forward and rearward direction, or in a side to side direction, relative to treadmill 52, as desired or required. Here, it should be noted that by positioning a plurality of eyelets 112 at locations along frame member 88 or at other spaced locations, the exercise elements such as cords 102 and bars 108 connected thereto can be precisely placed relative to a user, for performing a particular exercise or for achieving a comfortable or pain free position for an exercise.

Figure 6:
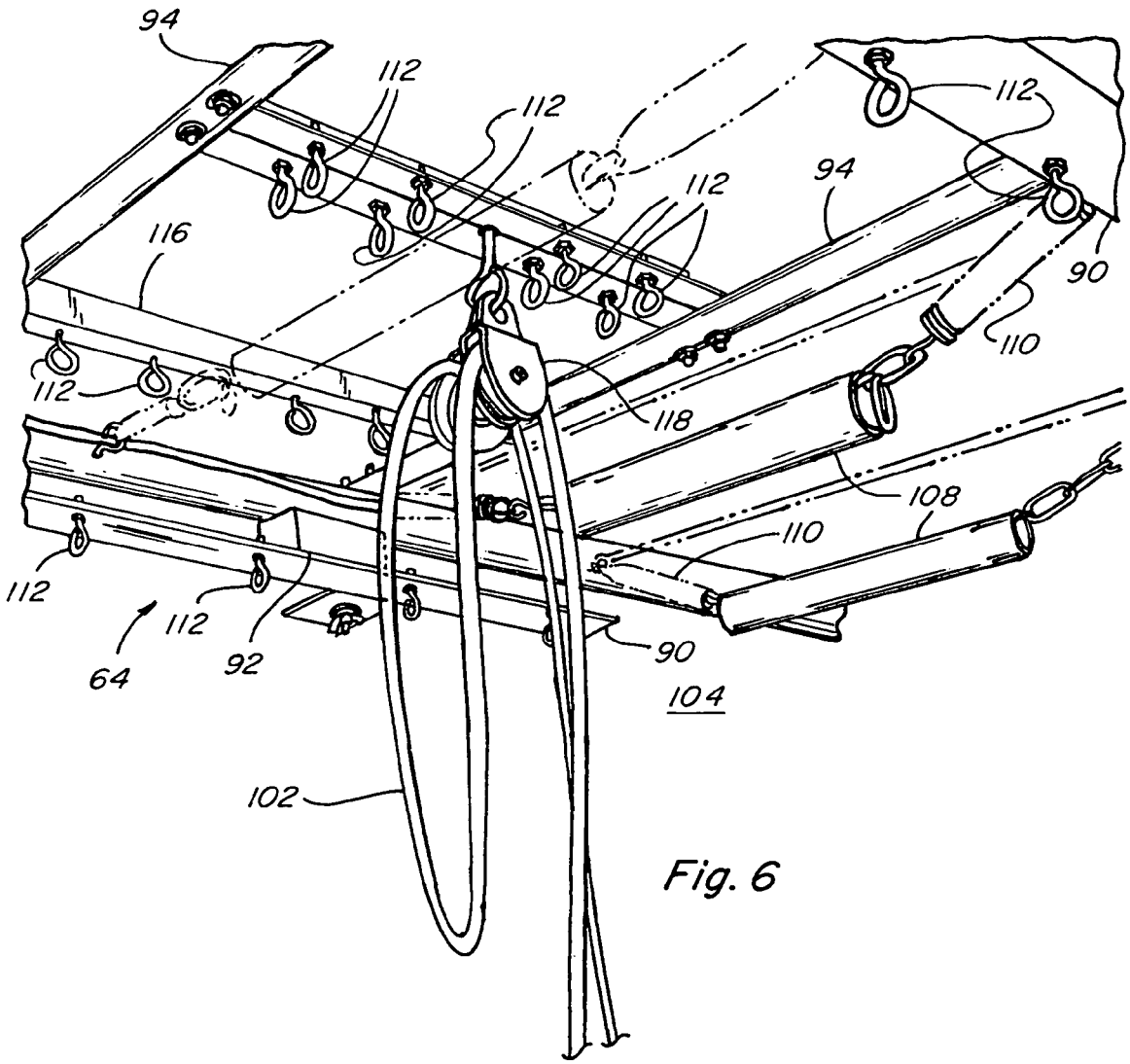
FIG. 6 is a fragmentary perspective view of the apparatus of FIG. 1, showing an additional type of exercise element attached thereto.

FIG. 6 shows support structure 64 including rows of eyelets 112 hanging downwardly from arms 90 and cross bars 94 of frame member 88, and also from additional cross bars 116 connected between cross bars 94. Eyelets 112 can be mounted so as to be non-rotatable, or rotatable, as desired. Several of the exercise elements including bars 108 and springs 110 are also shown, as is a representative slide block 92. Support structure 64 is also shown including still another exercise element, which preferably includes a double pulley 118 suspended from a rotatable eyelet 112 connected to one of the cross bars 116, which pulley 118 preferably supports another elongate, resiliently elongatable elastic cord 102 generally centrally above upper surface 56 in or adjacent to area 104.

Here, referring more particularly to FIGS. 1 and 4, it is noted that cord 102 supported by pulley 118 as well as bars 108 and straps 106 are preferably located in an upper region of or above area 104 so as to be in the vicinity of or above the head of a user walking or running on upper surface 56 of treadmill 52, such that the user is required to reach upwardly at least to about shoulder level to grasp those exercise elements and elongate them for resultingly performing a resistance exercise and unloading a portion of the user's weight applied against surface 56 through his or her legs and feet. An advantage of straps 106 that can be pointed out here is that they can be of any desired length, so as to be capable of being grasped at any location along their length. Straps 106, like cords 102 and springs 110, can be selected so as to have a desired elasticity, to provide a desired resistance exercise benefit and also desired unloading and stretching effects. Straps 106 are preferably constructed of an elastic rubbery material, a natural or synthetic latex, or the like, to provide a desired degree of resistance. For instance, it may be desired that one or more of the straps 106 be of a relatively strong rubbery elastic composition so as to require great effort to elongate, whereas others of straps 106 may be of a more easily stretchable material so as to be a desired degree easier to elongate and such that a range of resistances can be provided. As an example, some straps 106 may only be elongatable to a relatively short extent when a particular elongating force is applied thereto, whereas others may be significantly more elongatable when the same force is applied.

Figure 7:
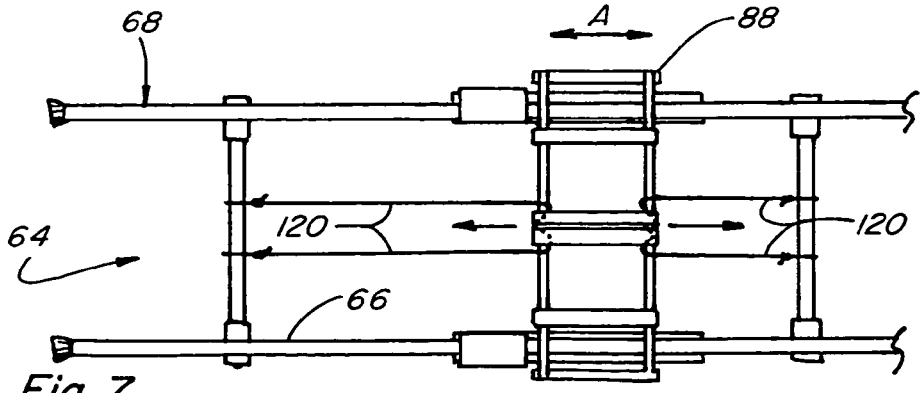
FIG. 7 is a fragmentary top view of the support structure of the apparatus of FIG. 1 showing resiliently elongatable biasing elements connected between the movable member and the support structure.

Referring also to FIG. 7, in addition to being forwardly and rearwardly movable along support members 66 and 68 of support structure 64, as denoted by arrow A, frame member 88 can be connected to support structure 64 by one or more resiliently biasable elements such as resiliently extendible or compressible members such as springs 120 shown, so that movement in one or both directions will be resiliently resisted by a desired biasing force. Thus, for instance, if an exercise elements connected to frame member 88, such as straps 106 and/or bars 108, is or are grasped and resiliently extended in a downward or upward direction, and is also pulled forwardly or rearwardly so as to also extend spring or springs 120 on one end of member 88, resistance in two directions will be experienced.

Figure 8:
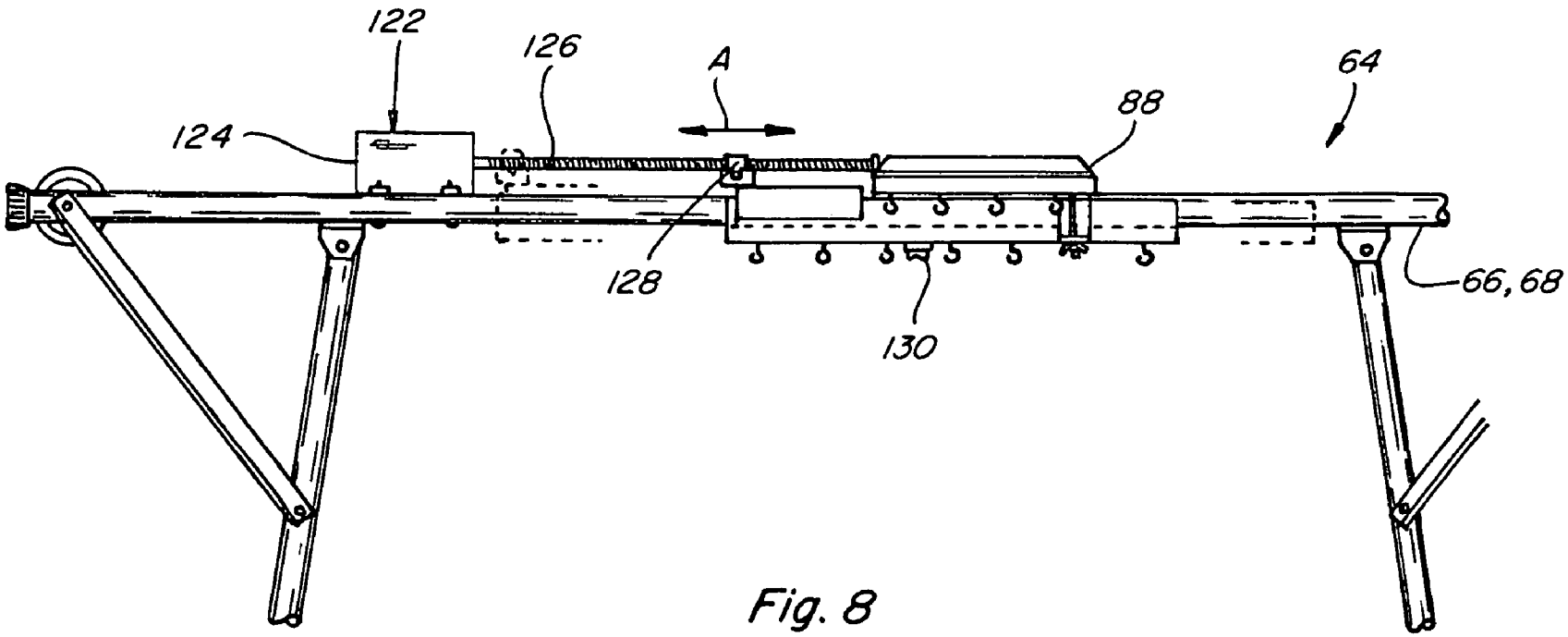
FIG. 8 is a fragmentary side view of the support structure and movable member, showing an optional power drive operable for moving the movable member forwardly and rearwardly relatively to the support structure.

In FIG. 8, support structure 64 is shown including an optional motorized drive 122 connected to frame member 88 for moving it forwardly and rearwardly along support members 66 and 68. Drive 122 includes a motor 124 rotatably drivingly connected to a lead screw 126 threadedly received in a bushing 128 connected to frame member 88. An operating switch 130 is connected to motor 124 by a conductive path 132 and can comprise, for instance, a two-way paddle switch or toggle switch, that can be operated for operating motor 124 to rotate lead screw 126 in a first direction for moving frame member 88 forwardly, and in an opposite direction for moving it in a rearward direction. Switch 130 can be located in any convenient and safe location, such as on one of support members 66 or 68. Motor 124 can be powered in any suitable convenient way, such as by plugging into an auxiliary power source on treadmill 52, or by ordinary household current, a battery, or other suitable power source.

Figure 9:
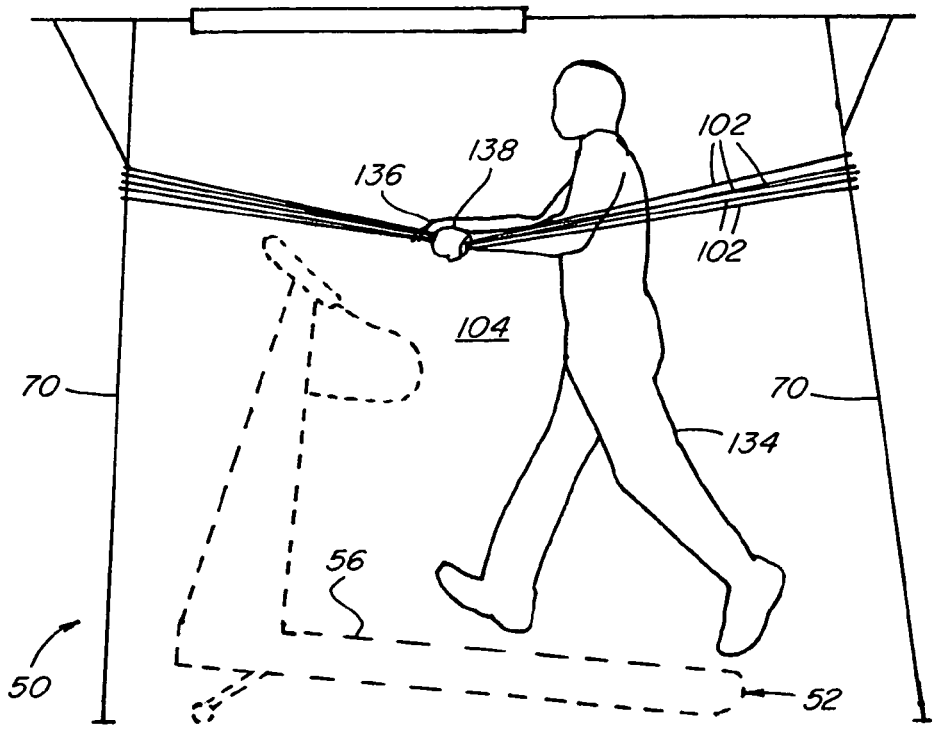
FIG. 9 is a simplified schematic representation of the apparatus and exercise device of FIG. 1, illustrating a person in one manner of using exercise elements of the apparatus for unloading and performing a resistance exercise.

In FIG. 9, a simplified schematic representation of apparatus 50 is shown, showing only the exercise elements consisting of the plurality of horizontally extending resiliently elongatable cords 102 suspended between forward and rearward legs 70 as described above. As will be illustrated by this and subsequent Figures, because cords 102 can be extended in all directions, including forwardly, rearwardly, sidewardly, upwardly, and downwardly (including for unloading), both symmetrically and asymmetrically, it is possible to perform a wide variety of exercises and stretches, in multiple planes. A man 134 is depicted in area 104 walking or running on upper surface 56 of treadmill 52. Cords 102 are located at a representative height generally just below the man's shoulders, on opposite sides of the man's trunk or body. Here, it should be noted that as a result of the adjustability of the height of cords 102, they can be located at any desired or required height based on factors such as the height of the person or the exercise to be performed. For this exercise, cords 102 on each side of the man's body are grasped in the right hand 136 and left hand 138 and pressed slightly downwardly, for unloading a portion of the weight of man 134 applied against surface 56 corresponding to the downward force exerted by hands 136 and 138 against cords 102. Man 134 can maintain his hands 136 and 138 in a steady position such as that shown, or can reciprocally, alternatingly or intermittently apply the downward force against cords 102 for providing a desired unloading effect on one or both of his legs, and for performing a desired resistance exercise.

Here, both hands are illustrated pressing downwardly simultaneously such that the man's triceps are shortening and thus are subject to concentric action. When done, man 134 can simply release cords 102, or he can oppose the return thereof to their initial position for eccentric action on the triceps. By extending the arms sidewardly and/or forwardly and/or rearwardly, and by curling the arms in one or more directions, exercises and/or stretches in multiple planes are performed, involving different muscle groups, and the shoulders can be more involved. Additionally, to add variety, with belt 54 of treadmill 52 moving at a slow speed, by holding cords 102 and ceasing walking, or by walking slower than the belt speed, man 134 can be move rearwardly for further stretching cords 102 between the hands and the point of attachment to forward legs 70, for increasing the resistance felt and/or for allowing the arms and/or shoulders to be stretched as the man's body moves rearwardly away from the hands.

Figure 10:
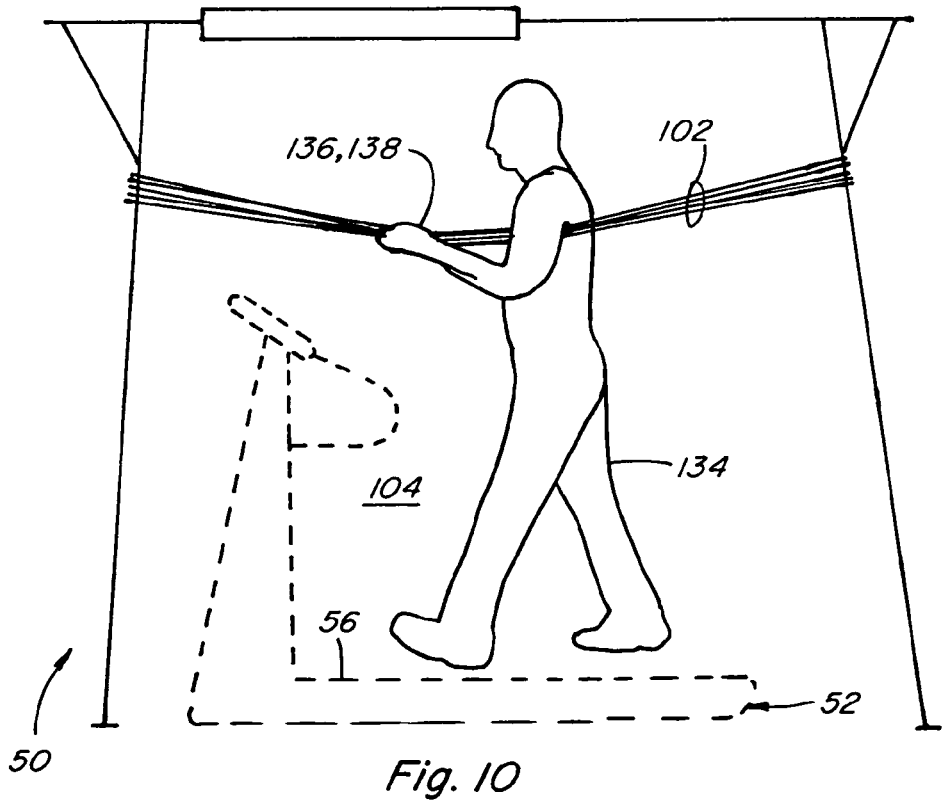
FIG. 10 is another simplified schematic representation of the apparatus and machine of FIG. 1, showing the person using the exercise elements to illustrate unloading and performing a resistance exercise in another manner.

In FIG. 10, man 134 is shown in a similar position in area 104 walking or running on surface 56 of treadmill 52 with cords 102 located in the man's armpits in supportive relation to the shoulders so as to carry at least a portion of the man's weight and thus unloading a corresponding portion of the man's weight from surface 56. Man 134 is additionally shown grasping cords 102 in hands 136 and 138 and pulling or pressing downwardly on cords 102 for further or differently unloading a corresponding portion of his weight from surface 56 and performing a different resistance exercise of the arms. Again, man 134 can move hands 136 and 138 further downwardly for increasing the resistance and unloading effect, and can jointly move hands 136 and 138 downwardly and/or sidewardly for performing symmetrical repetitions of a desired resistance exercise in multiple planes and providing a desired additional unloading effect, or do so reciprocally or alternatingly for an asymmetrical effect. Thus, a desired or required degree of unloading, if desired, and symmetrical and/or asymmetrical exercise and stretching benefit in multiple planes is illustrated.

Here, it should be noted that although cords 102 on both sides of man 134 are depicted as being elongated and extended in a downward direction, for additional variance, the cords on just one of the man's sides can be elongated in this manner, if desired, for an asymmetrical effect, such as for unloading only one side of the body or saggital plane. Man 134 can also easily move rearwardly with or on belt 54 for obtaining a stretch of the arms as noted above. Also again, as the man presses or pulls down on cords 102 the triceps are subjected to concentric action, and when used to resist upward movement of the cords, are subjected to eccentric action.

Figure 11:
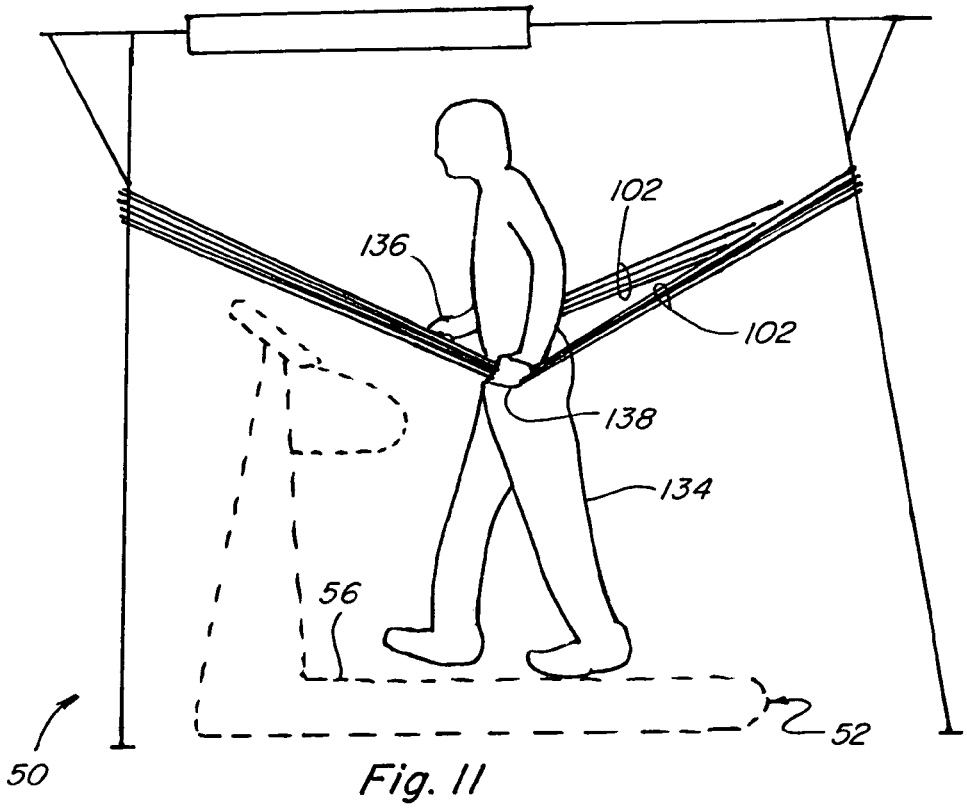
FIG. 11 is another simplified schematic representation of the apparatus and machine of FIG. 1, showing the person using the exercise elements to illustrate unloading and performing a resistance exercise in still another manner.

Referring to FIG. 11, man 134 is depicted walking or running on surface 56 of treadmill 52, while grasping a cord or cords 102 of apparatus 50 in hands 136 and 138 and resiliently pressing them downward to adjacent the waist of man 134, which is a substantially greater extension compared to that shown in FIGS. 9 and 10, such that a correspondingly greater unloading effect is achieved, as well as a more difficult resistance exercise. Here, it should be noted that the greater the extension or displacement of cords 102, the more resistance achieved. Thus, greater extension of cords 102 in the downward direction achieves a greater unloading effect. This should be contrasted to exercising with free weights such as dumb bells wherein the weight and therefore the unloading effect remains constant and is not changed by the degree of extension or position of the arm. Here, it should also be remembered that the amount of resistance or unloading can be varied by selectively grasping and extending different numbers of the cords 102 and by use of cords having different elastic coefficients. Again, man 134 can hold hands 136 and 138 in the position shown, or move them together symmetrically in one or more planes of movement, or reciprocally or alternatingly asymmetrically, for achieving a desired unloading and resistance exercise effect. It should also be noted that the downward extension of one or both arms can be timed to unload at a desired time such as when one or both of the man's legs are weight bearing.

Figure 12:
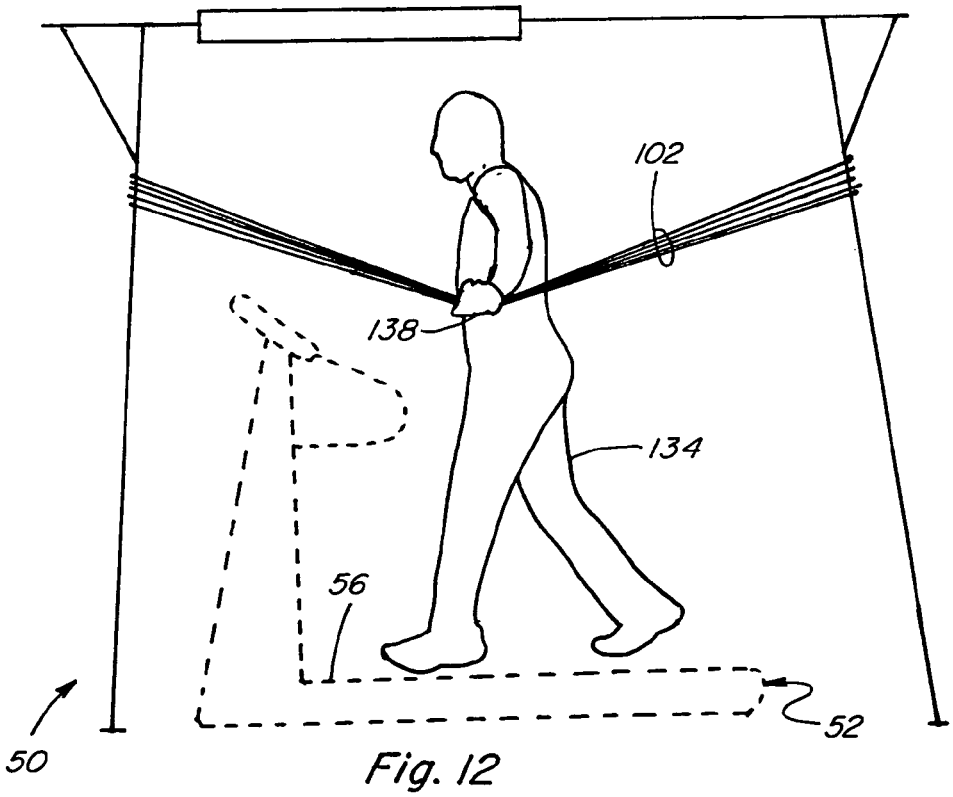
FIG. 12 is another simplified schematic representation of the apparatus and machine of FIG. 1, showing the person using the exercise elements to illustrate unloading and performing a resistance exercise in another manner.

In FIG. 12, man 134 is shown walking or running on surface 56 of treadmill 52 with cords 102 of apparatus 50 extended downwardly and sidewardly outwardly away from his body, for varying the unloading and resistance exercise effect in multiple planes.

Figure 13:
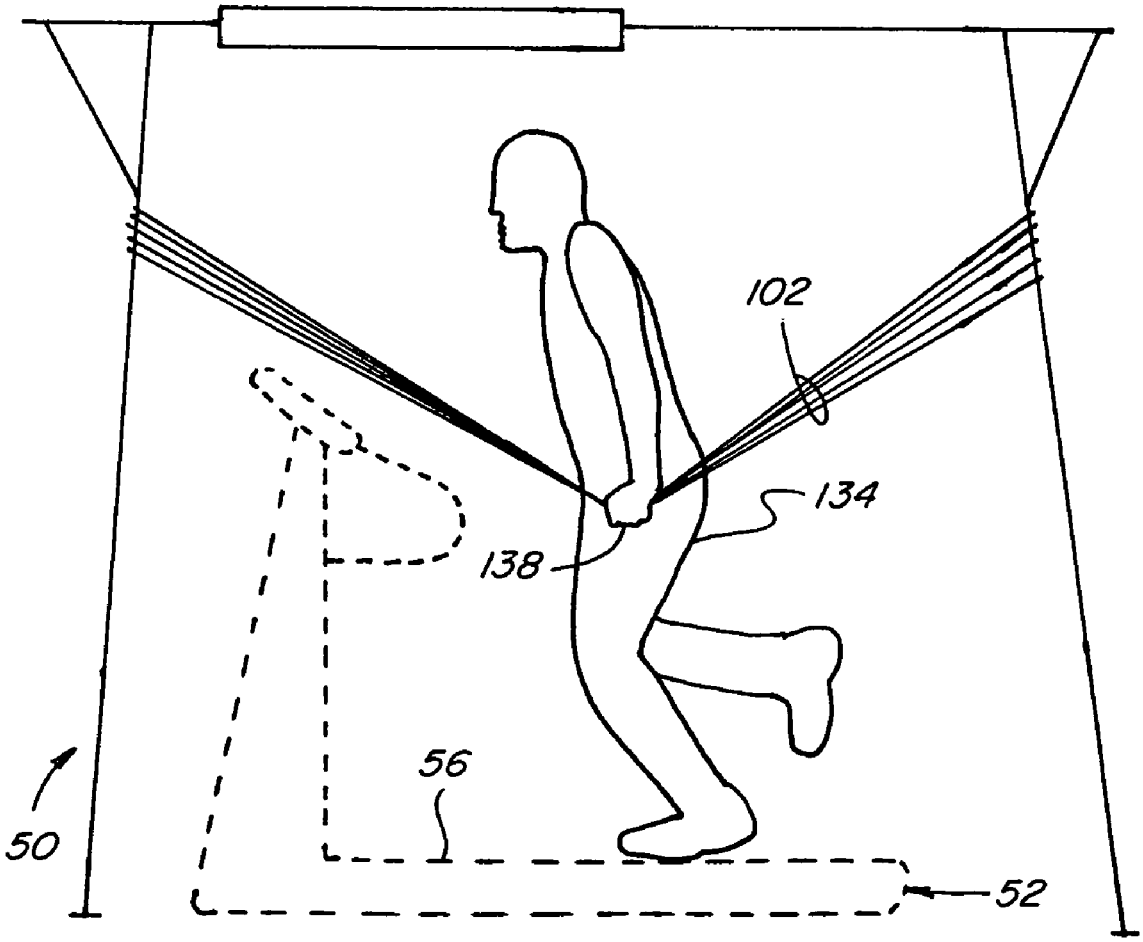
FIG. 13 is another simplified schematic representation of the apparatus and machine of FIG. 1, showing the person using the exercise elements to illustrate unloading and performing a resistance exercise in another manner.
Figure 41:
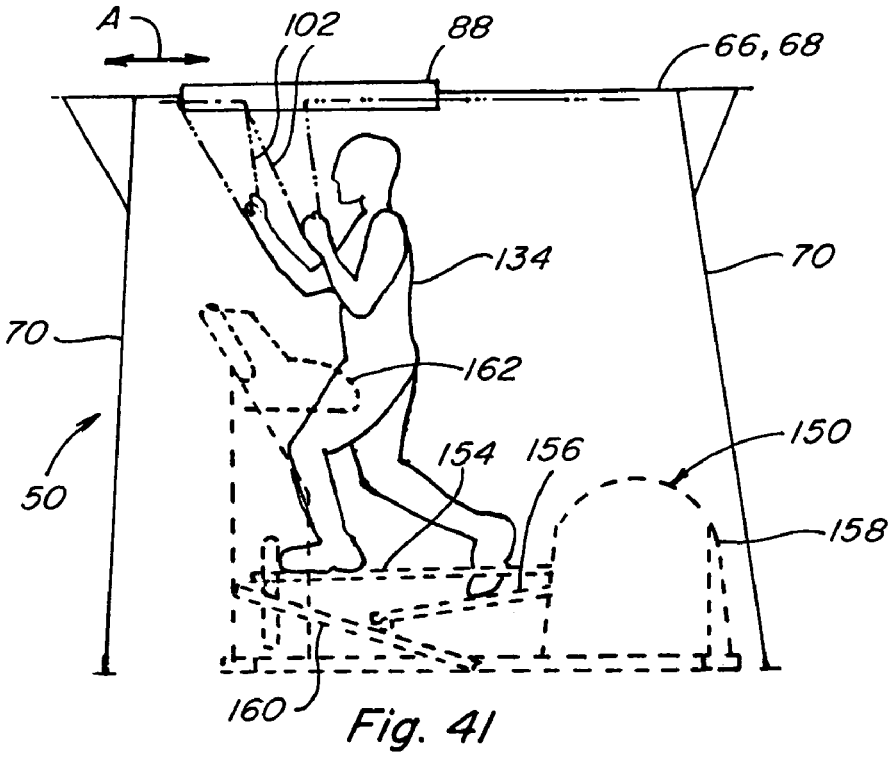
FIG. 41 is a simplified schematic representation of the apparatus of FIG. 1 including a representative exercise element thereof, and a person exercising therewith while performing a cardiovascular exercise on a representative elliptical machine.

In FIG. 13, man 134 is shown in a more strenuous running position on surface 56 of treadmill 52, leaning heavily on cords 102 of apparatus 50 grasped in hands 136 (not shown) and 138. This represents about a maximum unloading position and arm extension, it being further possible to extend the wrists if the user has adequate wrist strength to further extend cords 102 or if cords 102 are of an easier to stretch variety. In this position, as in any of the positions, a user can move the arms, for instance, upwardly and sidewardly for varying the planes of exercise and muscles affected. Additionally, a user can move forwardly or rearwardly on surface 56 to place one end of cords 102 in greater tension to also vary the resistance effect and/or provide a different stretch. This, along with the other variations, can be done at the same time, alternatingly, or in a desired sequence. As another example, cords 102 on one side of the body may be held in the full extension position as the cords 102 on the other side of the body are returned to the natural or free state position in an asymmetrical action. If the arms both remain fully extended downwardly, a constant, maximum unloading effect is achieved. Referring ahead to FIG. 41, this is also a desirable exercise for use with the elliptical trainer 150 of FIG. 41.

Figure 14:
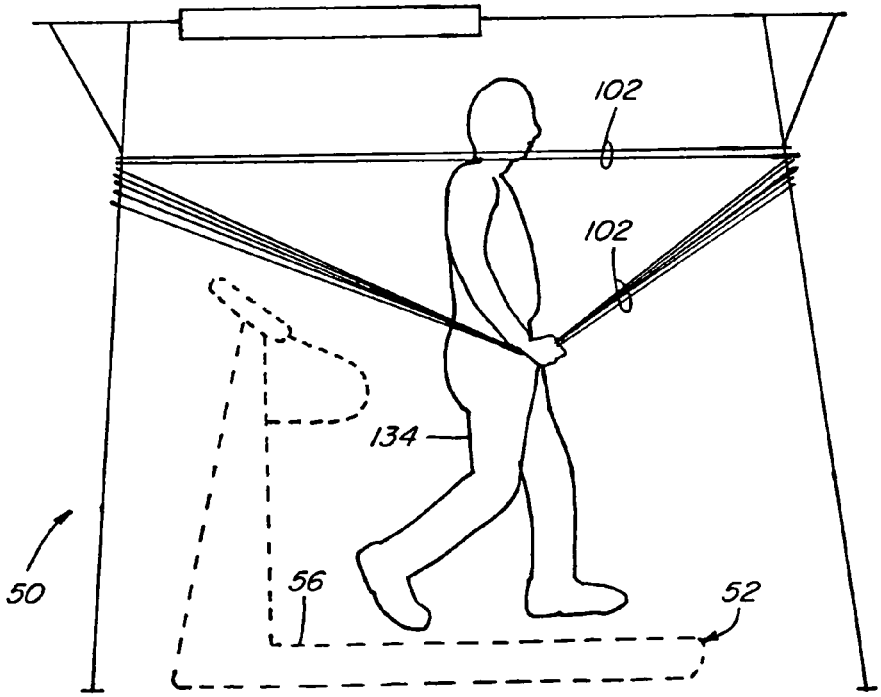
FIG. 14 is another simplified schematic representation of the apparatus and machine of FIG. 1, showing the person using the exercise elements to illustrate unloading and performing a resistance exercise in another manner.

In FIG. 14, another variation is shown wherein man 134 is walking or running backward on surface 56 of treadmill 52 while grasping a selected number of cords 102 of apparatus 50 and extending his arms downwardly for achieving a desired degree of unloading and resistance exercise effect, in any of the manners discussed above in reference to FIGS. 9-13. Again, cords 102 when extended such as shown can be pulled further forwardly, rearwardly, and/or sidewardly, to achieve desired effects, and the cords can be held as the man is carried rearwardly by belt 54 to increase resistance and/or perform a stretch.

Figure 15:
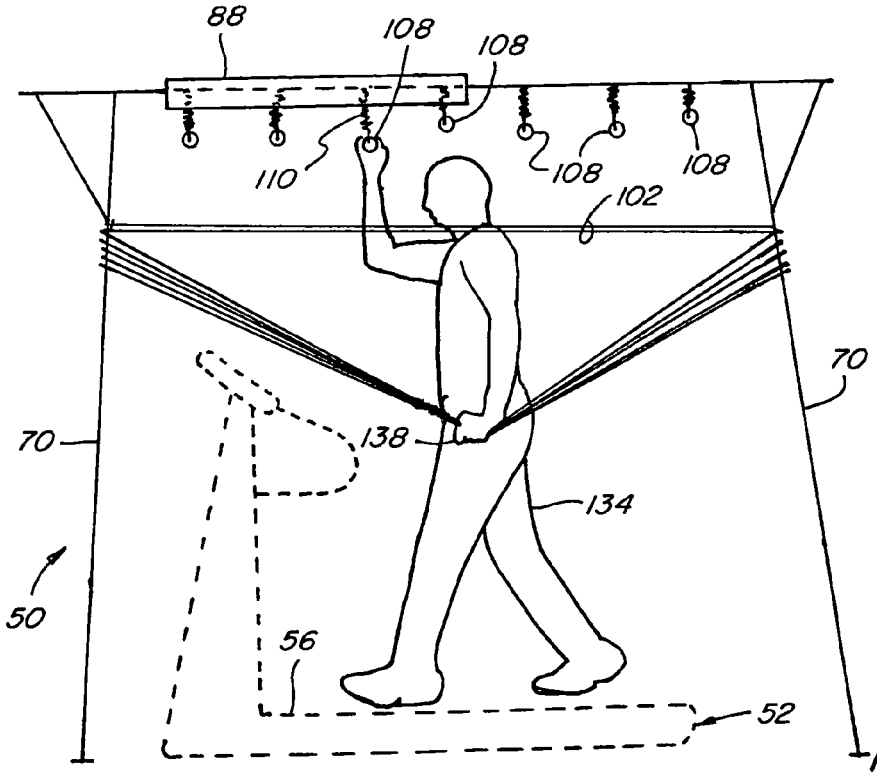
FIG. 15 is a simplified schematic representation of the apparatus of FIG. 1, showing additional, different exercise elements and illustrating one manner of their use while using the exercise elements shown in FIGS. 9-14.

Turning to FIG. 15, apparatus 50 is shown including a plurality of bars 108 suspended from springs 110 at forwardly to rearwardly spaced locations over treadmill 52, with a plurality of cords 102 extending forwardly and rearwardly between legs 70 at a lower position as before. Man 134 is shown in a walking or running position on surface 56 grasping a bar 108 in hand 106 and pulling downwardly against springs 110 to extend that exercise element, while hand 138 grasps a selected number of cords 102 and extends them downwardly to about a waist high position, thereby providing an illustration of one asymmetrical unloading and resistance movement. Note here that cords 102 on the far side of man 134 are omitted for clarity. Here, a user can alternatingly grasp and extend bars 108 and cords 102 in hands 136 and 138 to change the sides of the overhead and waist high unloading. This has been found to be beneficial in allowing a workout to be extended in duration because each arm can be used for unloading and resistance exercises in different manners, positions and orientations, allowing alternatingly exercising, resting and stretching of the affected muscle groups. For instance, a user may exhaust certain upper arm and shoulder muscle groups, for instance the triceps, when grasping and extending a bar 108 above the head, which muscle groups are exercised differently when cords 102 are grasped and extended downwardly. As a further variance, any number of cords 102 can be grasped at any desired location along their length and extended in a desired direction, and others of bars 108 can be utilized, for instance, those located more forwardly or rearwardly of the person's head, as desired. Different ones of bars 108 can be grasped and extended as desired to achieve comfort also.

Still further, it should be noted that when grasping a bar 108 suspended from frame 88 or any other exercise element attached to frame 88, frame 88, if in a movable mode, can be moved forwardly and rearwardly to compensate at least partially or adjust for variations of the man's position on the movable belt of the treadmill and for his movements while walking and/or running. Stated another way, if a user moves around on the surface of the treadmill, frame 88 can move forward and rearward with the user so as to remain in a generally constant location in relation to the user. Frame 88 can also be moved for varying the level of resistance and comfort, and for providing a stretch. If resistance to such movement is provided by springs 120 in either or both directions (FIG. 7), additional resistance benefit can also be realized as the user would be exerting effort against springs in two different directions. This is illustrated in subsequent figures.

Figure 16:
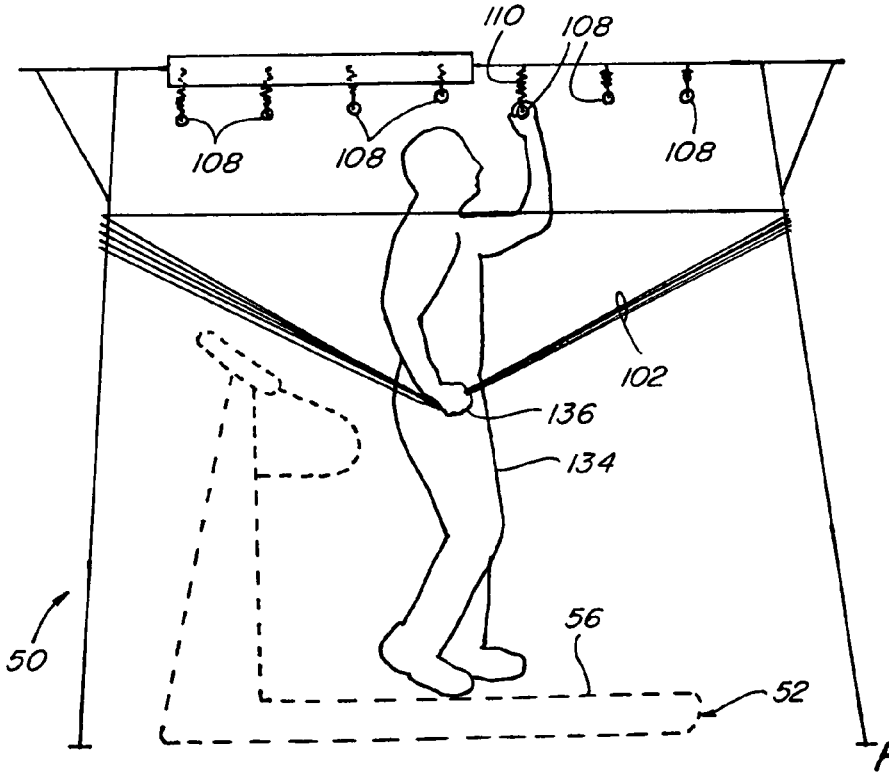
FIG. 16 is a simplified schematic representation of the apparatus of FIG. 1, showing additional uses of the exercise elements.

In FIG. 16, man 134 is shown walking or running backward on surface 56 of treadmill 52 while grasping a selected number of cords 102 in hand 136 and extending that arm downwardly, while other hand 138 grasps a selected bar 108 and pulls downwardly to extend springs 110. Again, this represents an asymmetrical unloading and resistance exercise which can be performed alternatingly with hands 136 and 138, in a variety of planes, and the degree of unloading and resistance will be a function of the relative resistance to elongation of cords 102 and springs 110. Also again, a user can vary the exercise by grasping a selected number of cords 102 at a desired location along the length thereof, and by grasping different ones of bars 108. Again, cords 102 on the far side of person 134 are shown deleted for clarity. By pushing downwardly and sidewardly inwardly and/or outwardly on cords 102, exercise movements in multiple planes are effected. Movement of bar 108 downwardly and forwardly and rearwardly, and even sidewardly, also provides exercise in multiple planes.

Figure 17:
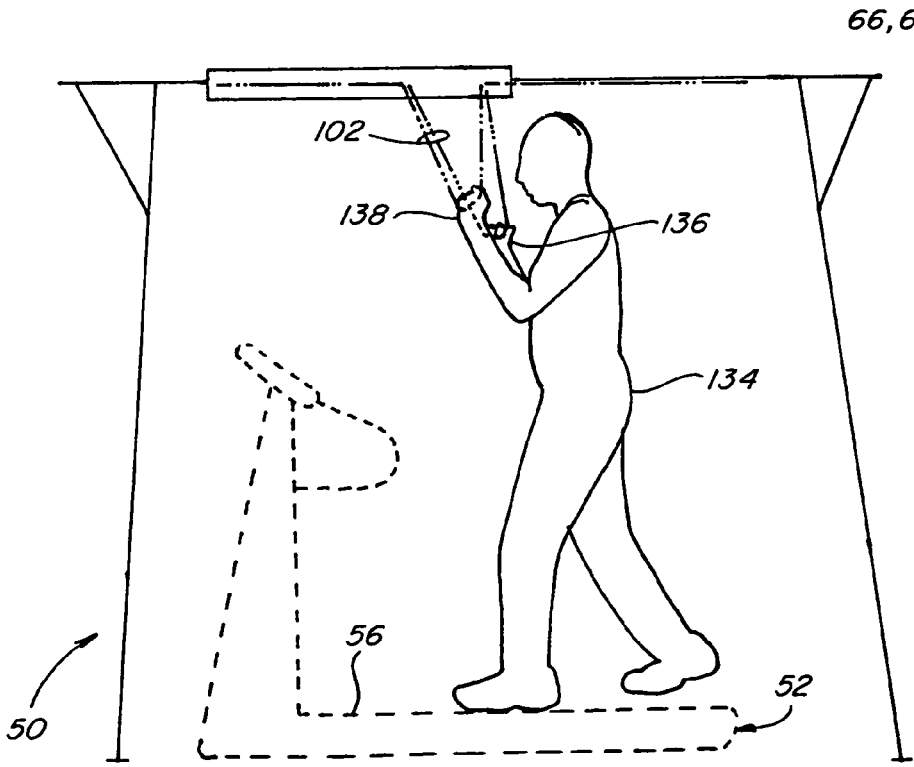
FIG. 17 is a simplified schematic representation of the apparatus of FIG. 1, showing additional, different exercise elements and illustrating their use.

FIG. 17 shows apparatus 50 with only cords 102 supported between support members 66 and 68. Here, cords 102 are grasped in hands 136 and 138 of man 134 and resiliently extended downwardly for providing a desired degree of unloading and resistance exercise benefit as man 134 walks or runs on surface 56 of treadmill 52. As can be observed, this provides a variation of an exercise similar to that performed using bars 108, but differing therefrom in the ability to extend cords in a larger variety of directions or planes, including more sideward directions, and to trace paths, such as an arcuate path, with the hands. Cords 102 can also be grasped more in front of the user and pulled toward the user's body to focus on different muscles, particularly the biceps. As an example, cords 102 located more forwardly of man 134 can be pulled downwardly largely by the triceps which are shortened so as to be concentrically exercised. Cords 102 can then be pulled rearwardly more toward man 134 so as to curl the arm or arms toward the chest or head in a concentric exercise of the biceps. Then, cords 102 can be allowed to return to their initial state by letting go or resisting the return to eccentrically exercise the triceps and biceps in a desired manner. Referring again to FIGS. 15 and 16, it should be noted that bars 108 can also be pulled in a curl toward the body or head to also concentrically exercise the biceps and then returned to the initial state resisted for eccentric action.

Figure 18:
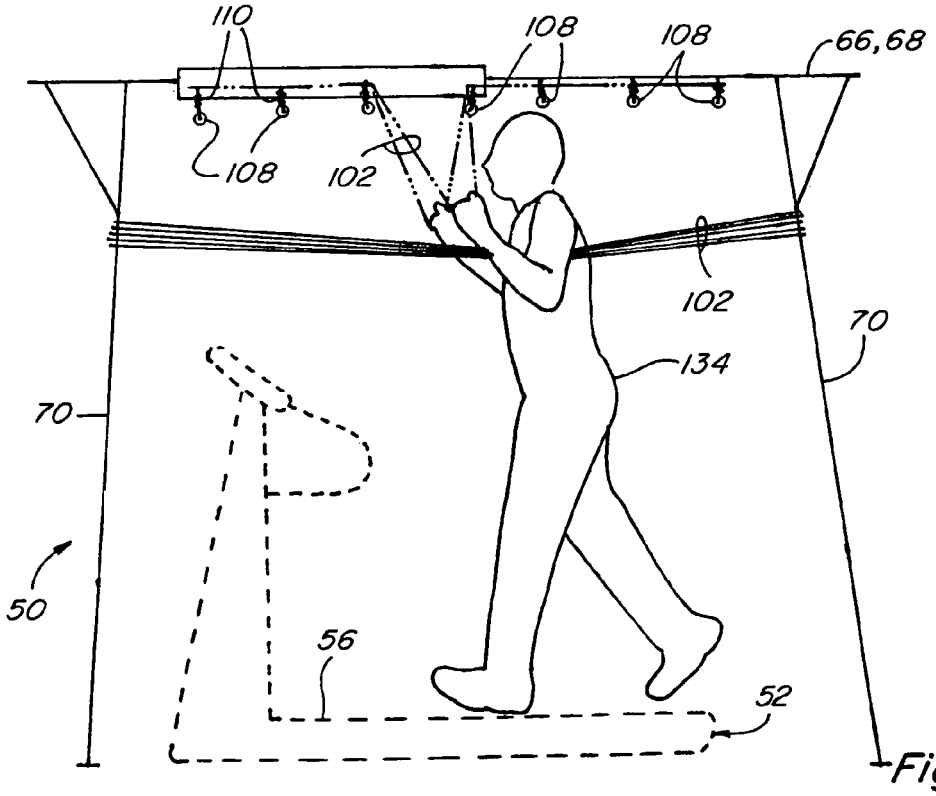
FIG. 18 is a simplified schematic representation of the apparatus of FIG. 1, showing additional uses of the different exercise elements of FIGS. 9-14 and 17.

FIG. 18 is similar to FIG. 17 but shows cords 102 extending between legs 70 of apparatus 50 and a plurality of bars 108 suspended from springs 110 along the length of support members 66 and 68, in addition to cords 102 as shown in the configuration of FIG. 17. Here, man 134 is shown walking or running on surface 56 of treadmill 52 with cords 102 supported by legs 70 between his upper arms and torso so as to provide some unloading, while hands 136 and 138 grasp and extend cords 102 supported by support members 66 and 68 to provide additional unloading and also more of a resistance exercise benefit. Again, cords 102 grasped in hands 136 and 138 can be simultaneously or alternatingly extended in any desired direction for performing a desired resistance exercise, including a concentric exercise of the biceps by a curling movement and/or a concentric exercise of the triceps by a downward pull, and eccentric exercises of those muscles performed by resisting return of cords 102 to the initial state.

Figure 19:
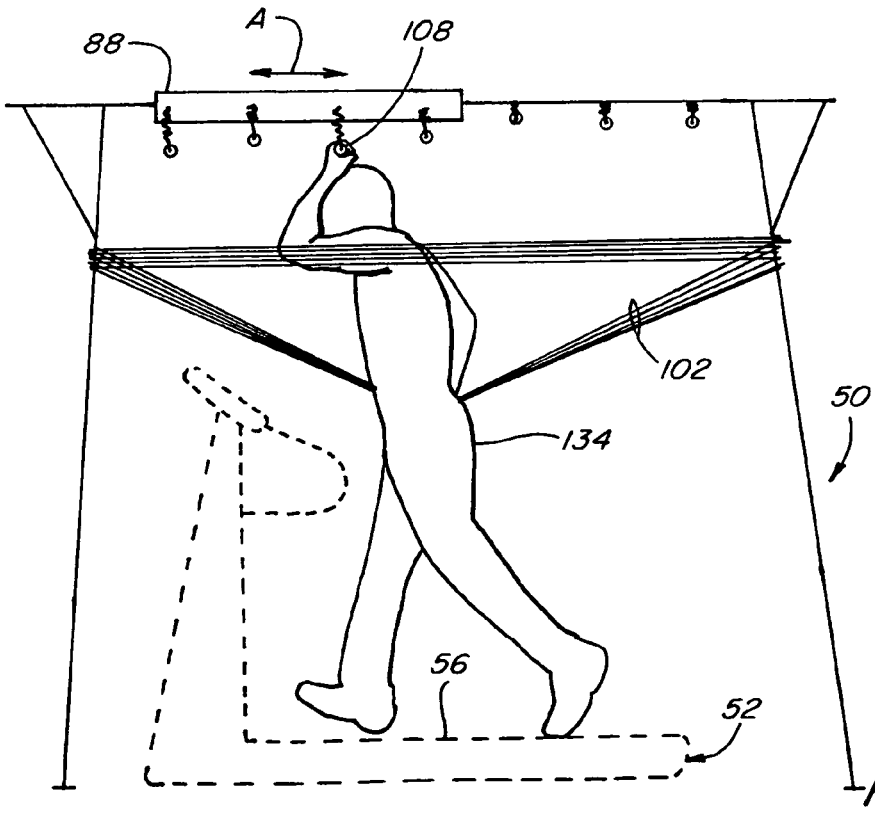
FIG. 19 is a simplified schematic representation of the apparatus of FIG. 1, showing additional uses of the different exercise elements.

In FIG. 19, still another asymmetrical, multiple plane variation is shown wherein man 134 is walking or running on surface 56 of treadmill 52 while grasping a selected number of cords 102 of apparatus 50 in one hand and while grasping a selected bar 108 above his head with the other hand and pulling down, for unloading, resistance exercise, and stretching effect. When a bar 108 suspended from frame member 88 is used, member 88 can be moved in the direction A for the effects discussed above, namely such that bar 108 remains in an approximately constant position in relation to man 134 as he moves or drifts about surface 56, or to increase or decrease resistance. Also, bar 108 can be pulled forwardly and/or downwardly for concentric action of the triceps and returned to the initial state for eccentric action, or bar 108 can be pulled downwardly and/or rearwardly for concentric action of the biceps, then returned to the initial state for eccentric action. These exercises can be done in a desired sequence with any of those discussed above. As noted above, movement of frame member 88 forwardly and/or rearwardly as denoted by arrow A in opposition to one or more resiliently extendible or compressible members such as springs 120 (FIG. 7) will provide the additional effect of providing resistance in another direction.

Figure 20:
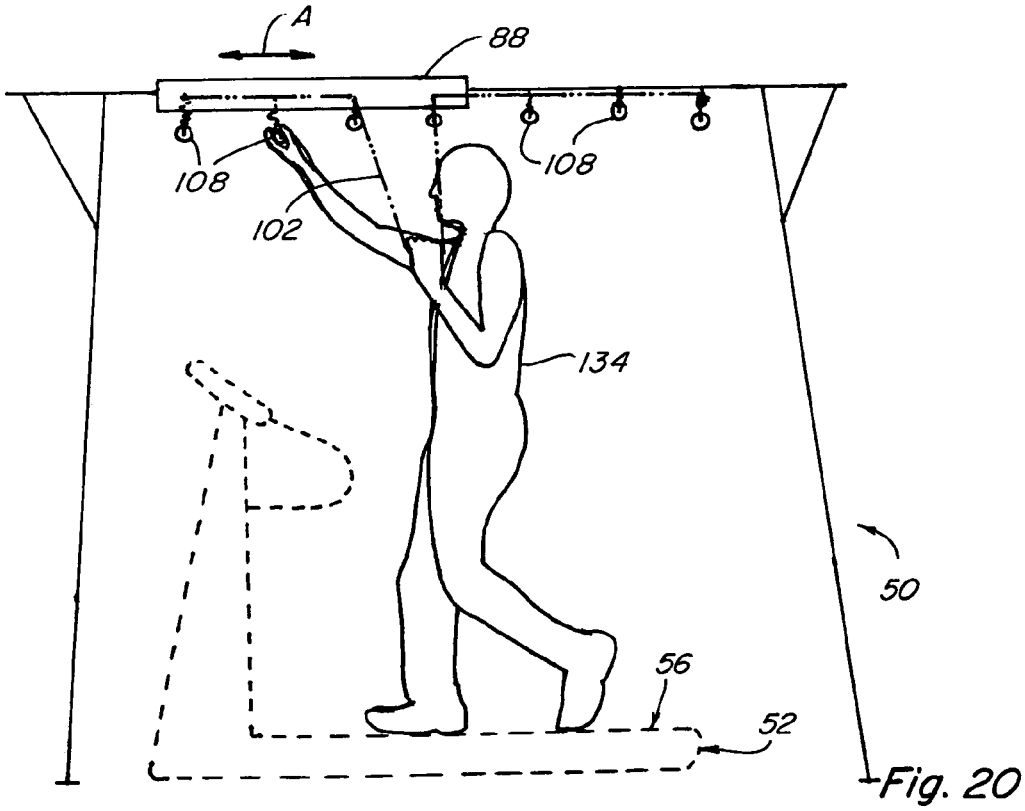
FIG. 20 is a simplified schematic representation of the apparatus of FIG. 1, showing additional uses of the different exercise elements.

Still another variation of an asymmetrical unloading and resistance exercise possible with apparatus 50 is shown in FIG. 20. Here, man 134 while walking or running on surface 56 of treadmill 52 grasps and downwardly extends a cord or cords 102 from above for a concentric action of the left biceps while reaching forwardly and upwardly and grasping and extending a selected one of several bars 108. If bar 108 is pulled toward the head in a curl of the right arm concentric action of the right biceps is achieved. Again, if a bar 108 on frame member 88 is utilized, movement thereof in direction A will provide additional effect. As noted above, movement of frame member 88 forwardly and/or rearwardly as denoted by arrow A in opposition to one or more resiliently extendible or compressible members such as springs 120 (FIG. 7) will provide the additional effect of providing resistance in another direction. And, standing on belt 54 so as to move rearwardly can be used to increase resistance or obtain a stretch.

Figure 21:
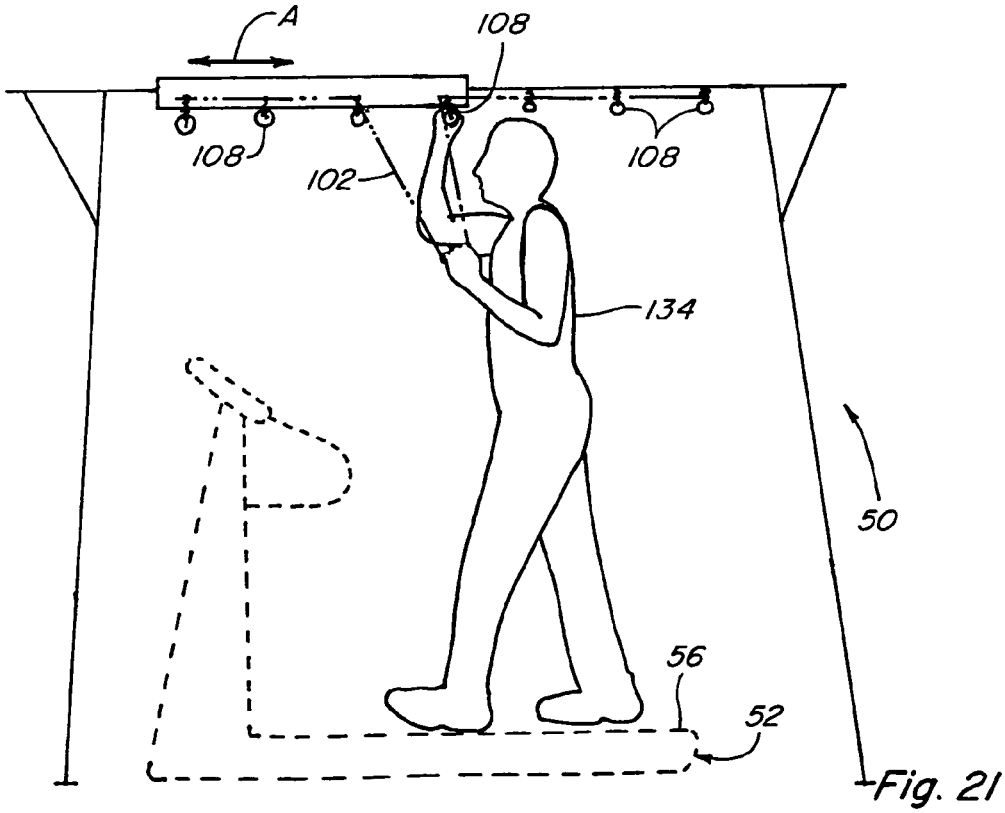
FIG. 21 is a simplified schematic representation of the apparatus of FIG. 1, showing additional uses of the different exercise elements.

FIG. 21 shows a variation of the exercise of FIG. 20, wherein man 134 walks or runs on surface 56 of treadmill 52, while grasping and pulling downwardly on one or more overhead cords 102 of apparatus 50 and grasping a selected one of overhead bars 108 closer in front of his head and also extending it downwardly, in an asymmetrical manner. Again, if a bar 108 on frame member 88 is utilized, movement thereof in direction A will provide the advantages set forth above. Namely, movement of frame member 88 forwardly and/or rearwardly as denoted by arrow A in opposition to one or more resiliently extendible or compressible members such as springs 120 (FIG. 7) will provide the additional effect of providing resistance in another direction. Or, frame member 88 can be fixed in position while man 134 drifts on surface 56 for different effect. Pulling downwardly will exercise the triceps more and pulling toward the body or head in a curling movement will exercise the biceps more.

Figure 22:
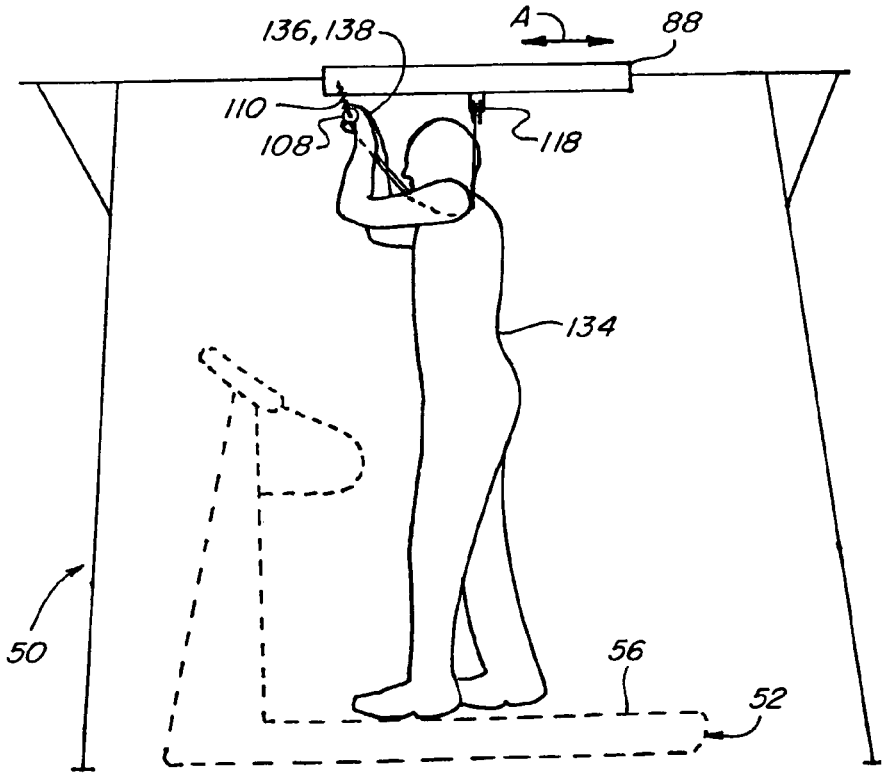
FIG. 22 is a simplified schematic representation of the apparatus of FIG. 1, showing the exercise elements of FIG. 6 and illustrating one manner of their use.

In FIG. 22, frame member 88 of apparatus 50 is shown supporting a pulley 118 having a cord 102 therethrough, and a single bar 108 suspended from springs 110. A man 134 is shown walking or running on surface 56 of treadmill 52 with the cords extending between his arms and trunk through the armpit area and grasped in hands 134 and 136 which also grasp bar 108 and extend it downwardly, for achieving an unloading and resistance exercise benefit. Again, if a bar 108 on frame member 88 is utilized, movement thereof in direction A will provide additional effect and freedom of movement on belt 54 as discussed above. Namely, movement of frame member 88 forwardly and/or rearwardly as denoted by arrow A in opposition to one or more resiliently extendible or compressible members such as springs 120 (FIG. 7) will provide the additional effect of providing resistance in another direction.

Figure 23:
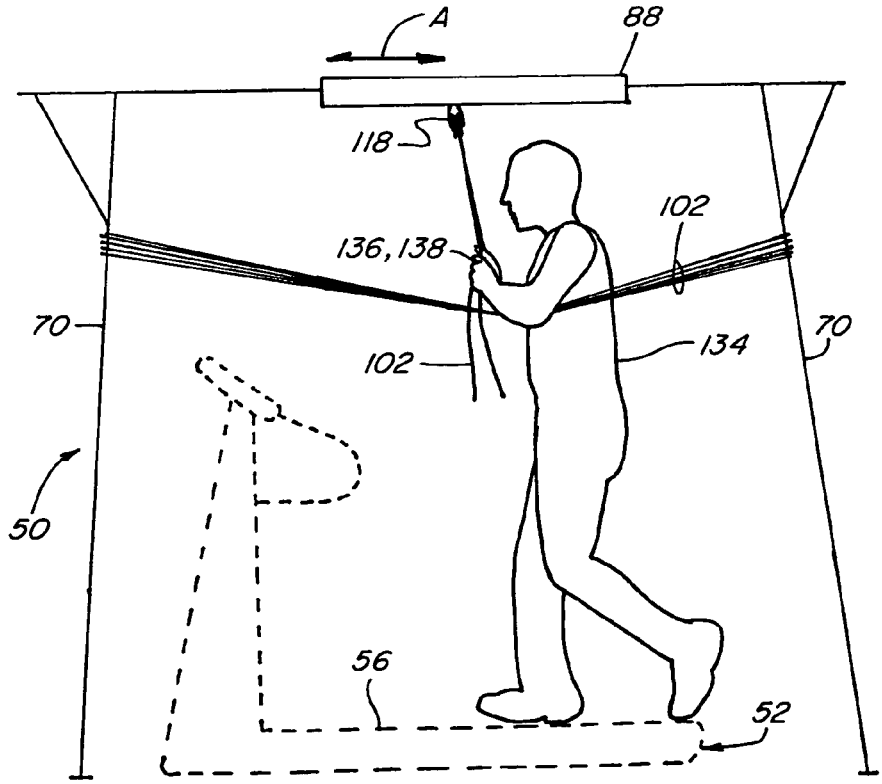
FIG. 23 is a simplified schematic representation of the apparatus of FIGS. 1 and 6, showing additional uses of the exercise elements.

In FIG. 23, man 134 is shown walking or running on surface 56 of treadmill 52 with cords 102 extending between legs 70 extended downwardly by the man's forearms, while the man's hands 136, 138 grasp ends of a cord 102 supported by pulley 118 suspended from frame member 88 of apparatus 50. Here, downward movement of the man's forearms will extend all of the cords 102 to provide desired unloading and resistance exercise effect. The man's arms can be moved downwardly against cords 102 and upwardly in resistance to upward movement thereof in a fly type exercise. Still again, variation or movement with man 134 can be achieved by moving frame member 88 in direction A. As noted above, movement of frame member 88 forwardly and/or rearwardly as denoted by arrow A in opposition to one or more resiliently extendible or compressible members such as springs 120 (FIG. 7) will provide the additional effect of providing resistance in another direction.

Figure 24:
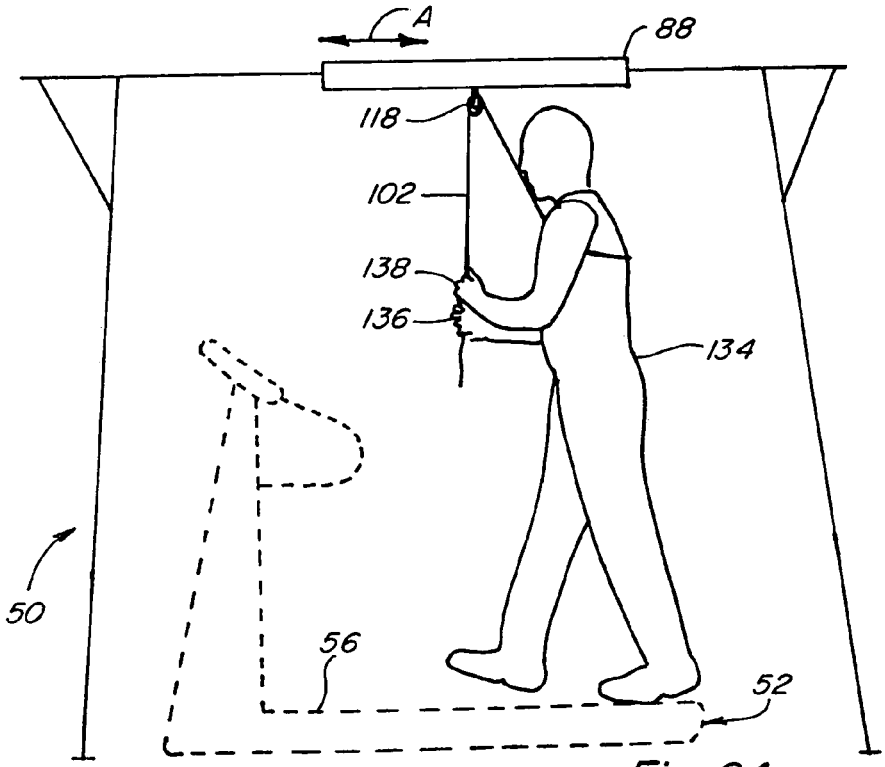
FIG. 24 is a simplified schematic representation of the apparatus of FIGS. 1 and 6, showing additional uses of the exercise elements.

FIG. 24 shows man 134 walking or running on surface 56 of treadmill 52 with cord 102 suspended from pulley 118 hanging from frame member 88 of apparatus 50, cord 102 looping around the rear of the man's torso with the loose ends of the cord being grasped in hands 136 and 138. Here, the degree of unloading and resistance exercise benefit can be easily varied by alternatingly raising or lowering hands 136 and 138 while grasping cord 102 for asymmetrical effect about the saggital plane, and/or moving frame member in direction A. Multiple planes of exercise can be achieved by movement of the arms forwardly, rearwardly, and sidewardly inwardly and outwardly. This movement principally exercises the triceps. As noted above, movement of frame member 88 forwardly and/or rearwardly as denoted by arrow A in opposition to one or more resiliently extendible or compressible members such as springs 120 (FIG. 7) will provide the additional effect of providing resistance in another direction.

Figure 25:
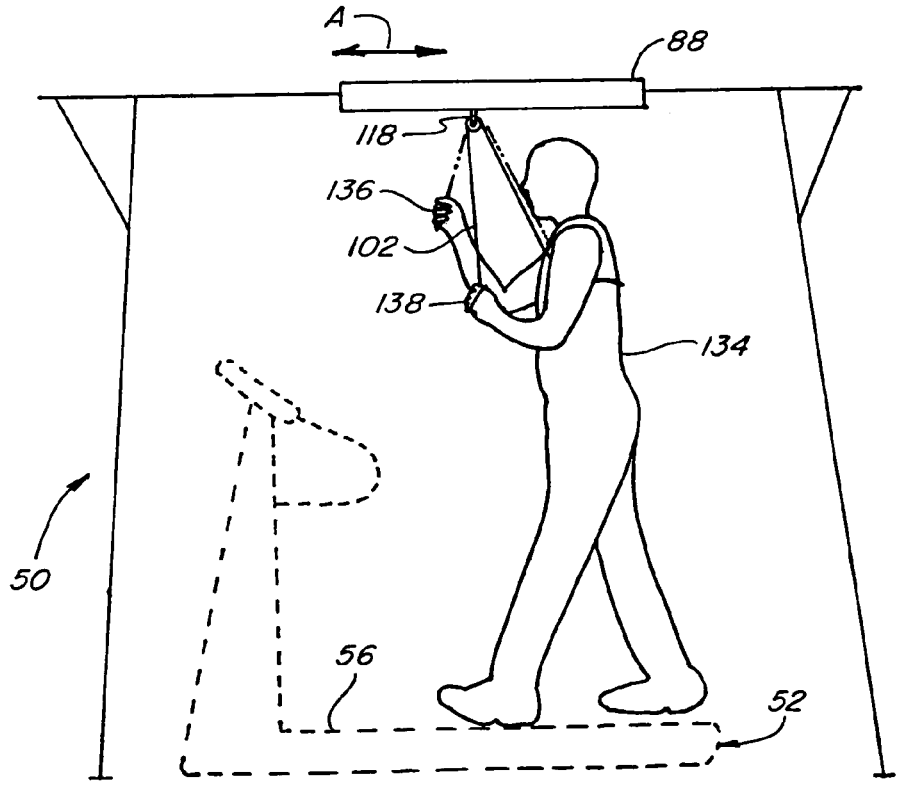
FIG. 25 is a simplified schematic representation of the apparatus of FIGS. 1 and 6, showing additional uses of the exercise elements.

FIG. 25 is a variation of the unloading and resistance exercise of FIG. 24, showing man 134 walking or running on surface 56 of treadmill 52 with cord 102 suspended from pulley 118 hanging from frame member 88 of apparatus 50 through the armpit area and around the back and held by hands 136 and 138 at different elevations above surface 56. This is representative of reciprocal movement of hands 136 and 138 upwardly and downwardly or in any other desired direction, which can be coordinated with the steps or strides of the person for asymmetrical unloading and desired resistance exercising. Again, movement of frame member 88 in direction A can vary effect. And, movement of frame member 88 forwardly and/or rearwardly as denoted by arrow A in opposition to one or more resiliently extendible or compressible members such as springs 120 (FIG. 7) will provide the additional effect of providing resistance in another direction.

Figure 26:
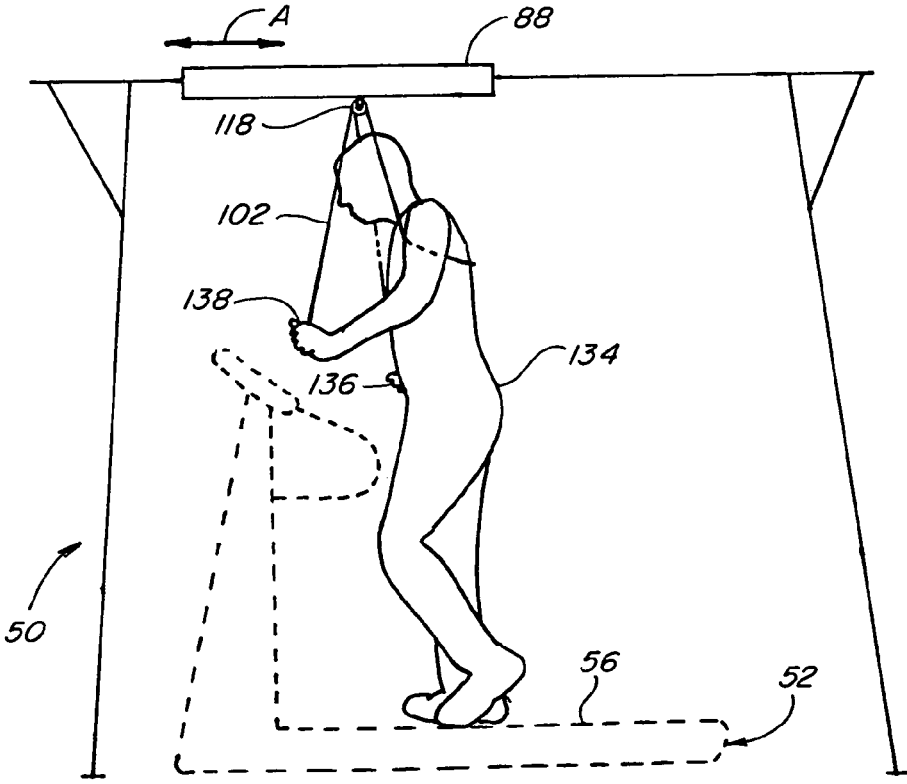
FIG. 26 is a simplified schematic representation of the apparatus of FIGS. 1 and 6, showing additional uses of the exercise elements.

FIG. 26 shows man 134 walking or running on surface 56 of treadmill 52 while grasping the ends of cord 102 suspended from pulley 118 of frame member 88 of apparatus 50, to illustrate movement of hands 136 and 138 in alternating, asymmetrical swinging movement typical when walking or jogging. Again, the unloading and resistance exercise can be coordinated with the steps or strides as desired, and the effect varied by movement of frame member 88 in direction A. Thus, by pulling down with one or both hands as steps are taken with the feet, desired unloading of one or both legs can be achieved. As noted above, movement of frame member 88 forwardly and/or rearwardly as denoted by arrow A in opposition to one or more resiliently extendible or compressible members such as springs 120 (FIG. 7) will provide the additional effect of providing resistance in another direction.

Figure 27:
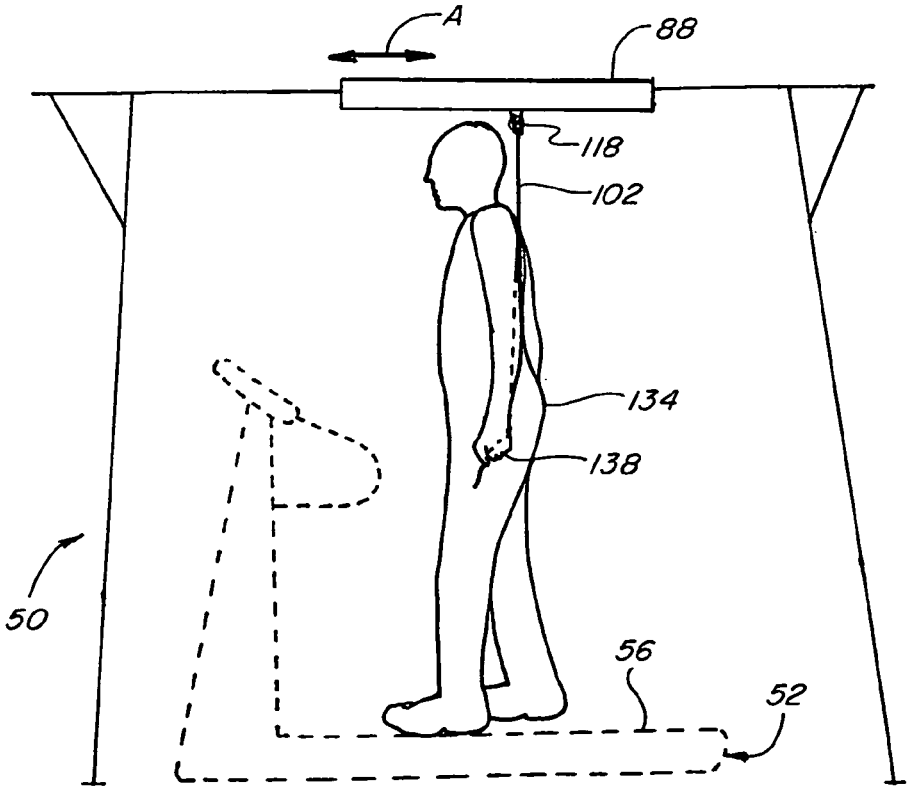
FIG. 27 is a simplified schematic representation of the apparatus of FIGS. 1 and 6, showing additional uses of the exercise elements.

In FIG. 27, man 134 is shown standing, walking or running on surface 56 of treadmill 52 while grasping ends of cord 102 suspended from pulley 118 and frame member 88 of apparatus 50, with his hands represented by hand 138 at waist level or below and cord 102 behind his back, which provides a different manner of unloading, resistance training and stretching. Here, it should be noted that frame member 88 is more rearwardly situated than depicted in FIG. 26, illustrating the versatility afforded by the movability of frame member 88 in direction A. As noted above, movement of frame member 88 forwardly and/or rearwardly as denoted by arrow A in opposition to one or more resiliently extendible or compressible members such as springs 120 (FIG. 7) will provide the additional effect of providing resistance in another direction.

Figure 28:
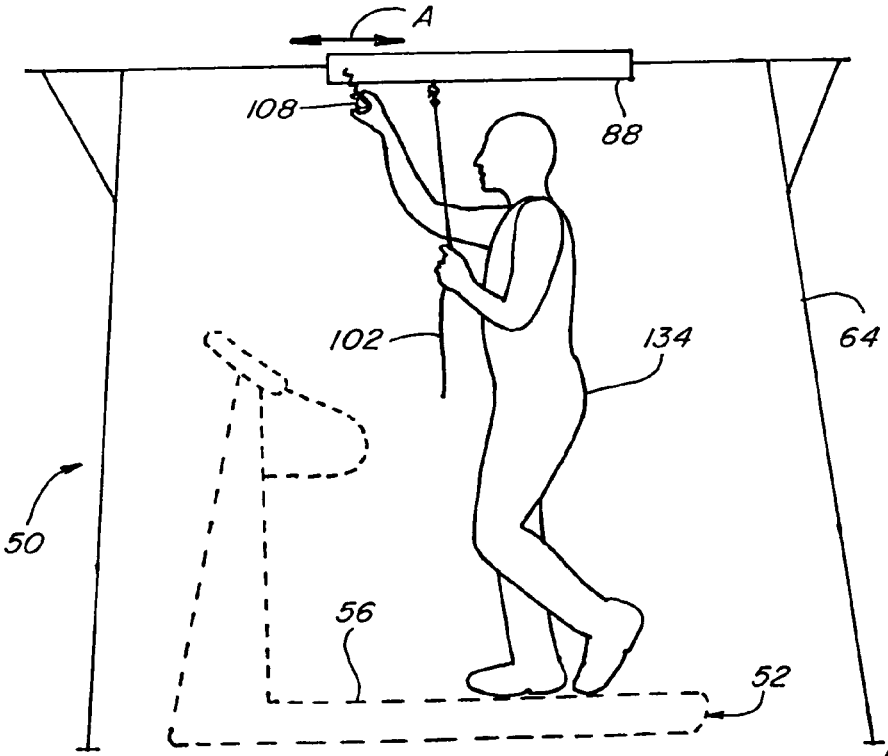
FIG. 28 is a simplified schematic representation of the apparatus of FIG. 1, showing additional uses of the exercise elements.

In FIG. 28, man 134 is shown walking or running on surface 56 of treadmill 52 while grasping and extending downwardly a cord 102 and a bar 108 suspended above his head from frame member 88 of support structure 64 of apparatus 50. This is representative of still another asymmetrical unloading and resistance exercise achievable with the present invention. Again, movement of frame member 88 in direction A can vary effect. And, movement of frame member 88 forwardly and/or rearwardly as denoted by arrow A in opposition to one or more resiliently extendible or compressible members such as springs 120 (FIG. 7) will provide the additional effect of providing resistance in another direction.

Figure 29:
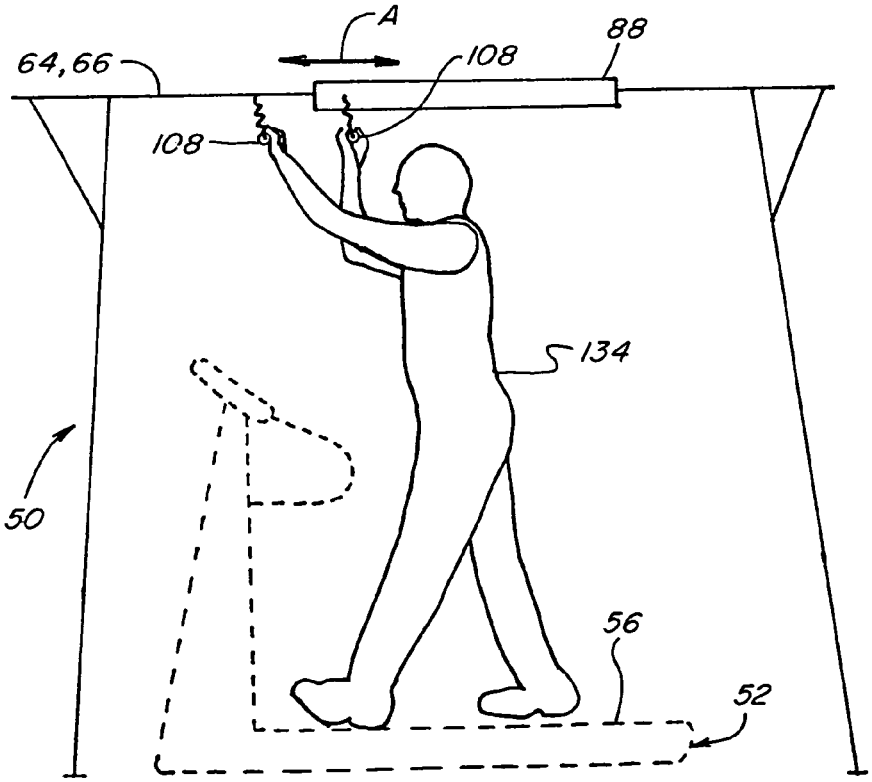
FIG. 29 is a simplified schematic representation of the apparatus of FIG. 1, showing additional uses of the exercise elements.

FIG. 29 shows man 134 walking or running on surface 56 of treadmill 52 while reaching forwardly and upwardly and grasping different bars 108 suspended from frame 88 and support members 64 and 66, respectively, for achieving a desired unloading and resistance exercise effect, it being contemplated that here, and also when exercising as shown in FIG. 28, a user can alternatingly grasp and extend the different exercise elements for varying the routine. Again, if a bar 108 on frame member 88 is utilized, movement thereof in direction A will provide additional effect. And, movement of frame member 88 forwardly and/or rearwardly as denoted by arrow A in opposition to one or more resiliently extendible or compressible members such as springs 120 (FIG. 7) will provide the additional effect of providing resistance in another direction. Also again, concentric and eccentric exercise effects can be obtained, the arms being movable while pulling bars 108 in a curl for concentric exercise of the biceps then return resisted for eccentric action, and bars 108 being pullable or pushable downwardly for concentric action of the triceps and the upward movement resisted for eccentric action.

Figure 30:
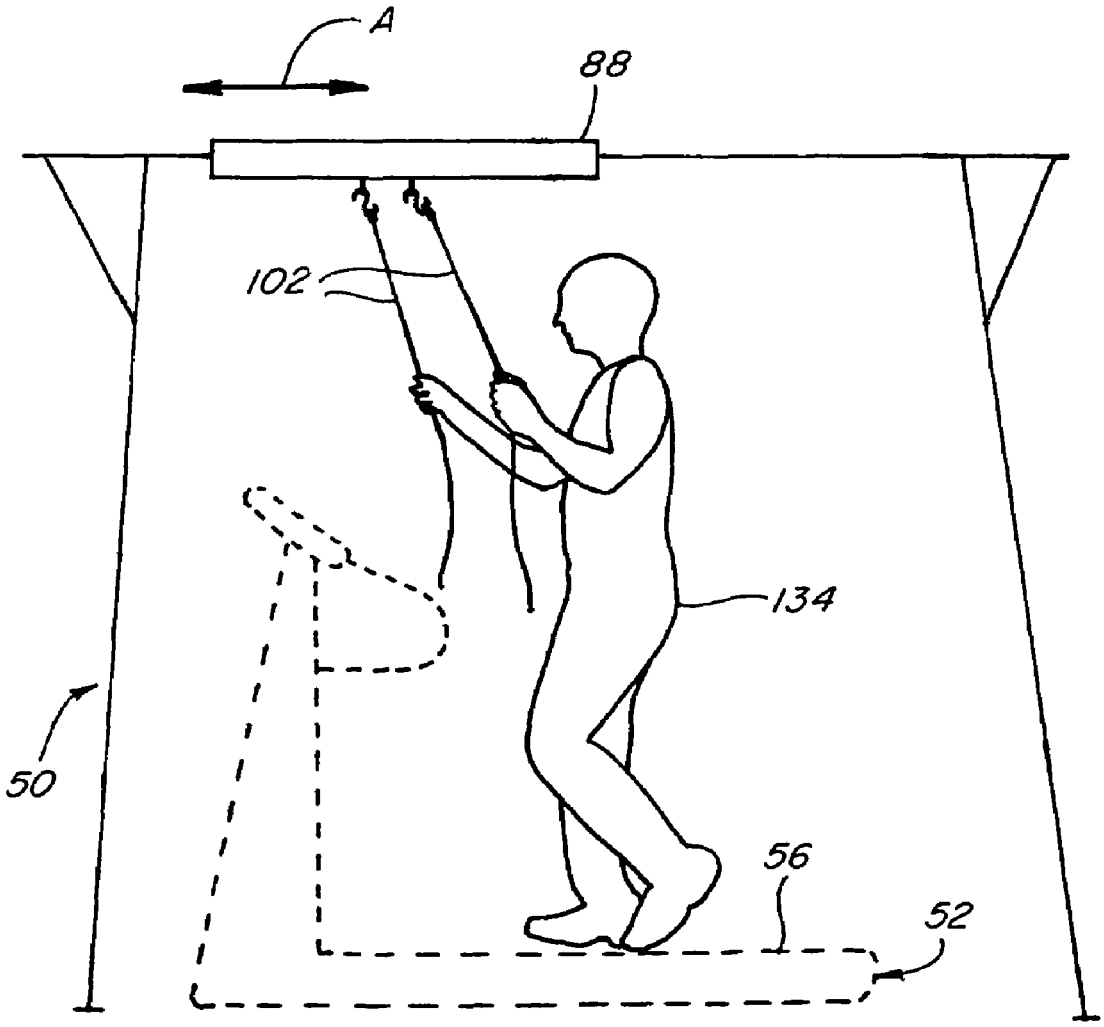
FIG. 30 is a simplified schematic representation of the apparatus of FIG. 1, showing additional, different exercise elements and illustrating their use.

FIG. 30 shows man 134 walking or running on surface 56 of treadmill 52 while separately grasping cords 102 suspended from frame member 88 of apparatus 50 and extending the cords either simultaneously or alternatingly in any desired direction and motion, including in sideward and forward and rearward directions to provide desired unloading and resistance exercise benefit, principally of the triceps. Here again, it is contemplated that frame member 88 can be movable forwardly and rearwardly as denoted by the arrow A, either freely, or in opposition to one or more resiliently extendible or compressible members such as springs 120 (FIG. 7) to provide the additional effect of providing resistance in another direction.

Figure 31:
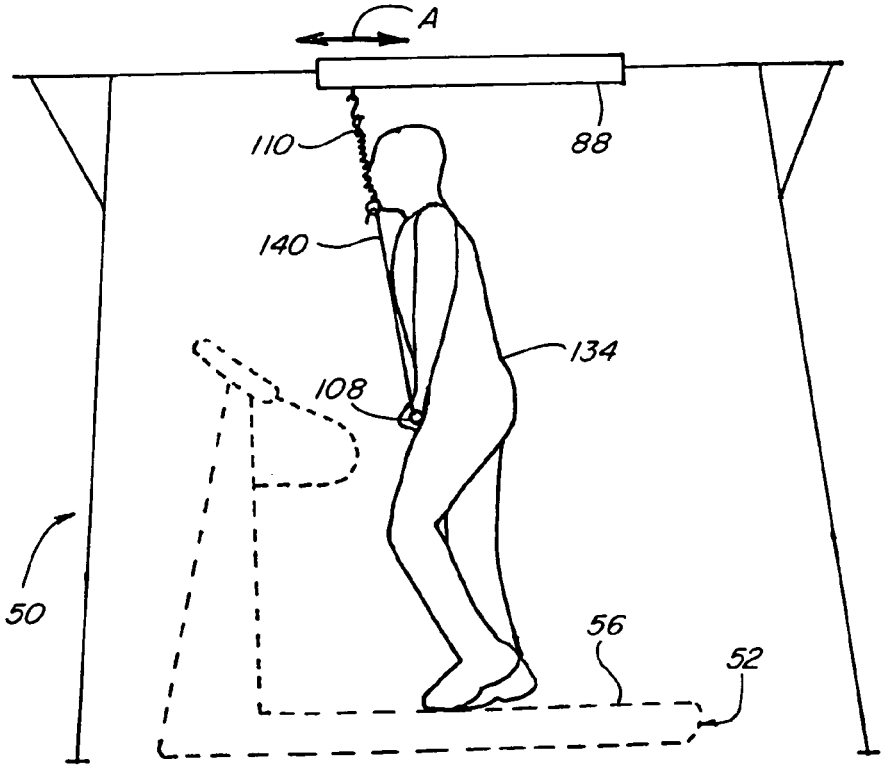
FIG. 31 is a simplified schematic representation of the apparatus of FIG. 1, showing additional, different exercise elements and illustrating their use.
Figure 32:
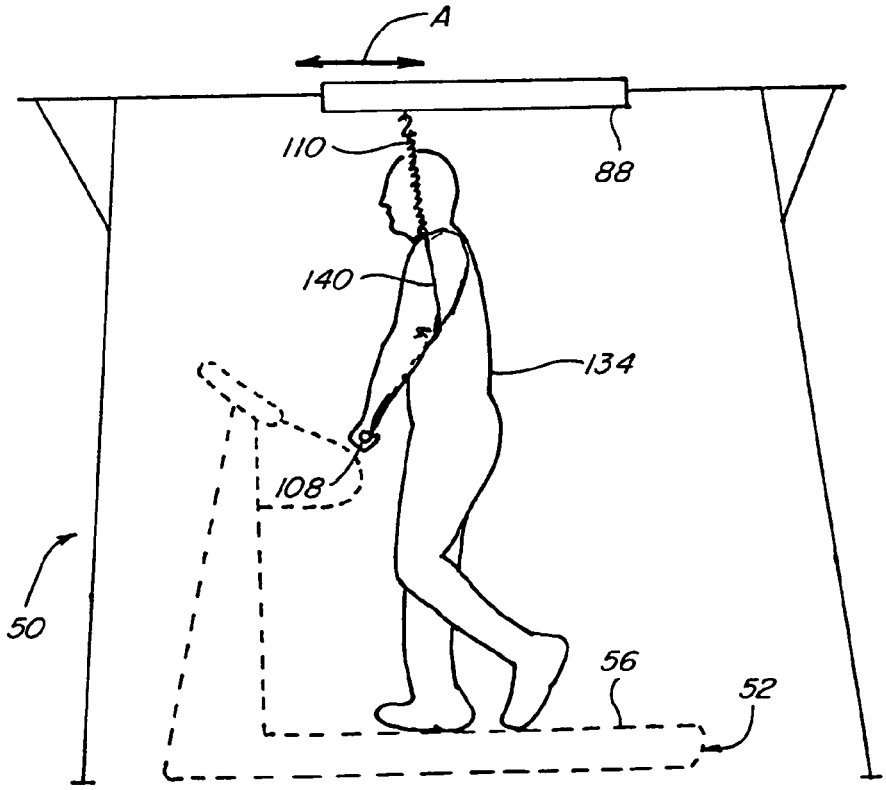
FIG. 32 is a simplified schematic representation of the apparatus of FIGS. 1 and 31, showing additional uses of the exercise elements.

FIGS. 31 and 32 show apparatus 50 configured to include a bar 108 suspended from frame member 88 by springs 110 which are resiliently extendable, and cords 140, which can be of fixed length or resiliently extendable or stretchable, as desired. Here, man 134 grasps bar 108 while walking or running on surface 56 of treadmill 52 and grasping and pulling down bar 108 to about waist level, in one instance with cords 140 directly in front of him, and in the second instance, with the cords under his arms, to provide a desired extent of unloading and resistance exercise. Again, frame member 88 can be movable in the directions shown by arrow A either freely or against a biasing member in one or both directions for varying the effect.

Figure 33:
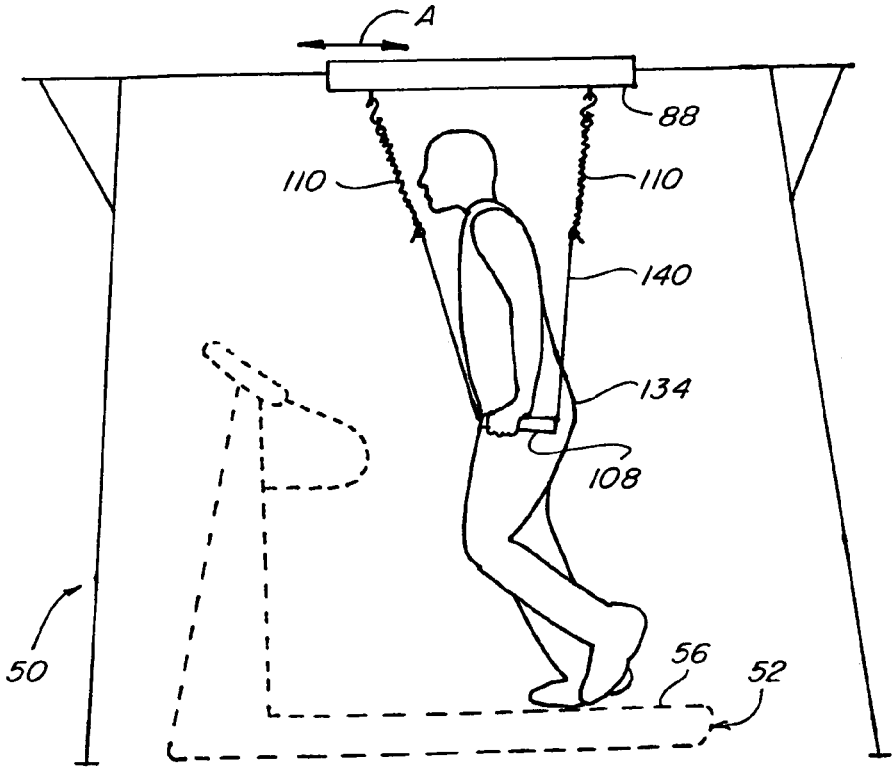
FIG. 33 is a simplified schematic representation of the apparatus of FIG. 1, showing additional, different exercise elements and illustrating their use.

FIG. 33 shows apparatus 50 configured to include a pair of bars 108 suspended by springs 110 and cord 140 from frame member 88 so as to be positioned beside a person such as man 134 when walking or running on surface 56 of treadmill 52. This allows man 134 to grasp handles 108 and extend them downwardly beside his trunk or waist and also to move them forwardly and rearwardly as well as sidewardly to achieve the desired unloading and resistance exercise effect. Here again, it is possible to extend bars 108 simultaneously or alternatingly, and also to use them to move frame member 88 either freely in the directions denoted by arrow A or in opposition to one or more biasing elements. This configuration can have particular utility for unloading, because movable member 88 allows bars 108 to be easily moved forwardly and rearwardly by the user as they move around on belt 54.

Figure 34:
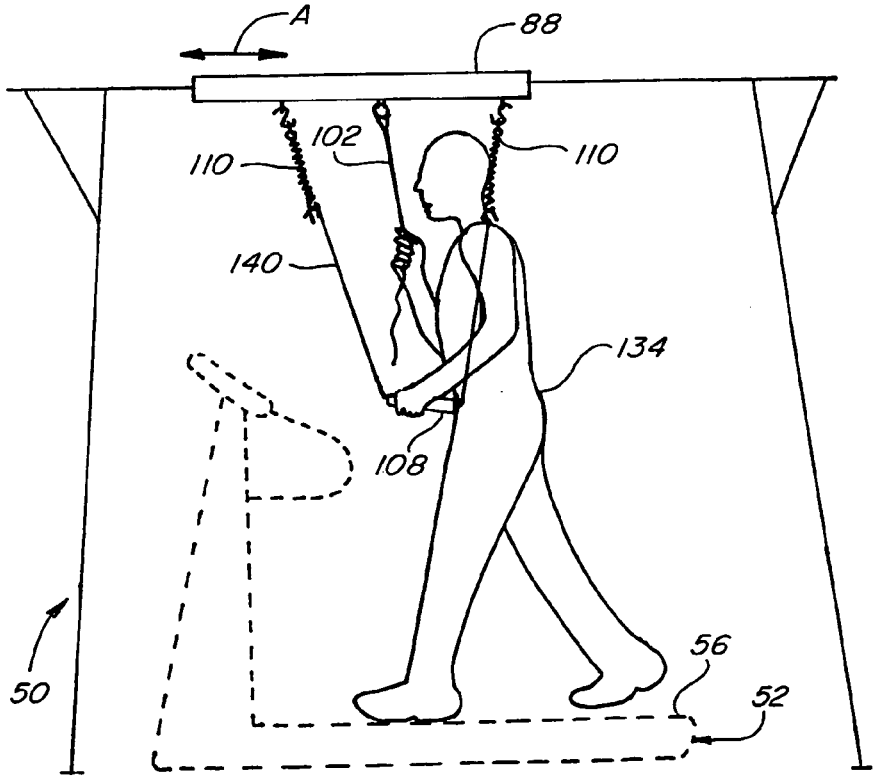
FIG. 34 is a simplified schematic representation of the apparatus of FIGS. 1 and 33, showing additional uses of the exercise elements.

FIG. 34 shows apparatus 50 configured for performing an asymmetrical variant of the unloading and resistance exercise of FIG. 33, here, instead of grasping two bars 108, man 134 is depicted grasping a single bar 108 oriented in a forward and rearwardly extending direction and suspended from frame member 88 by springs 110 and cord 140, and a cord 102 also suspended from frame member 88. While walking or running on surface 56 of treadmill 52, man 134 can simultaneously or alternatingly downwardly extend cord 102 and bar 108 to achieve desired unloading and resistance exercise benefit. This again represents an asymmetrical configuration. Also, both cord 102 and bar 108 can be moved in multiple planes. Cord 102 can be stretched downwardly for exercising the triceps, or pulled toward the body or head to exercise the biceps. Here again, it is contemplated that frame member 88 can be movable forwardly and rearwardly as denoted by the arrow A, either freely or in opposition to a resiliently biasable element in one or both directions, for improving comfort and compensating for movement of the user on belt 54.

Figure 35:
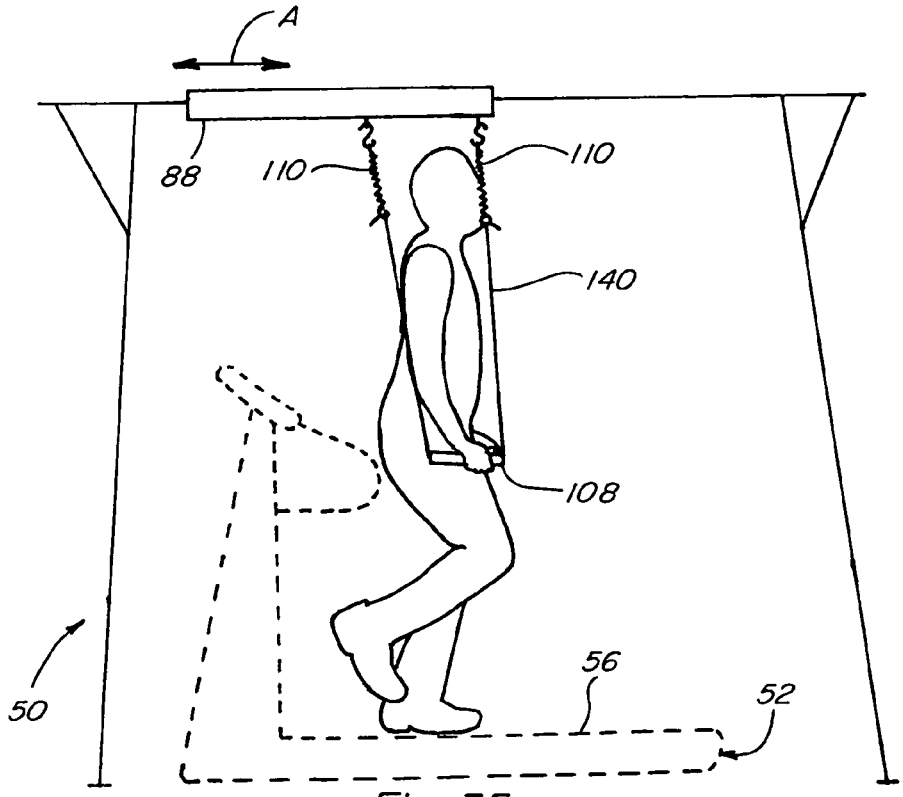
FIG. 35 is a simplified schematic representation of the apparatus of FIGS. 1 and 33, showing additional uses of the exercise elements.
Figure 36:
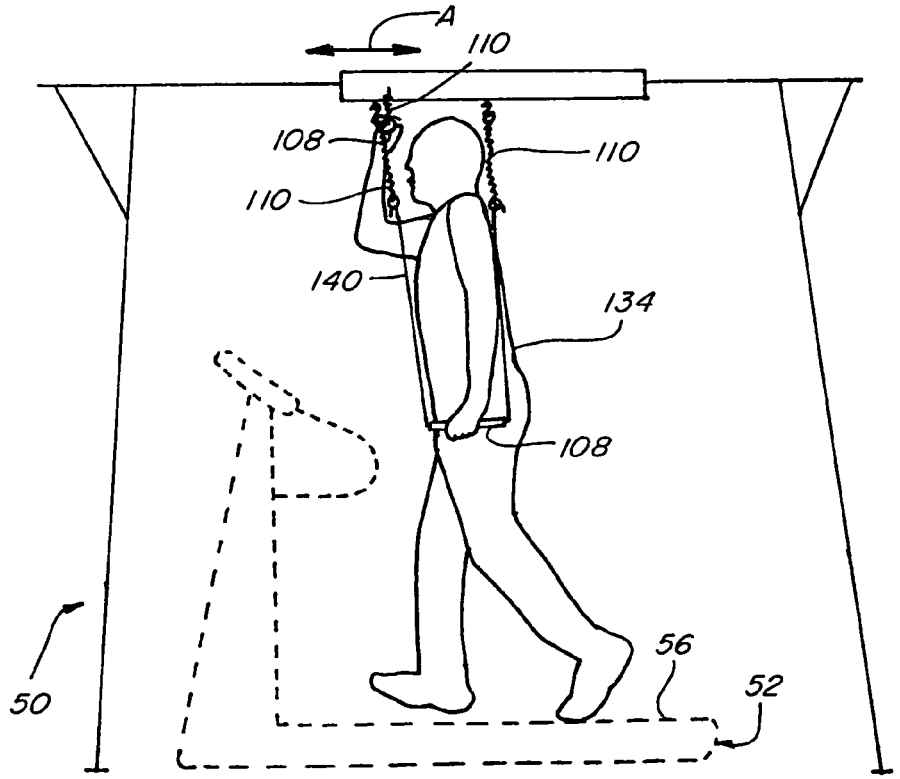
FIG. 36 is a simplified schematic representation of the apparatus of FIGS. 1 and 36, showing additional uses of the exercise elements.

FIGS. 35 and 36 show still further variance of unloading and resistance exercises possible using bars 108 suspended by springs 110 and cords 140 from frame member 88 of apparatus 50. In FIG. 35, man 134 is shown walking or running backward on surface 56 of treadmill 52 while grasping and extending bars 108 downwardly to achieve desired unloading and resistance exercise benefit. Again, this can be done with both hands simultaneously or alternatingly, in multiple planes, and frame member 88 can be moved in the forward and rearward directions as denoted by arrow A, either freely or in opposition to a biasing element. In FIG. 36, another asymmetrical unloading and resistance exercise variant is shown, wherein a first bar 108 suspended by springs 110 in a side to side orientation, and a second bar 108 suspended by a cord 140 and springs 110 in a forward and rearward orientation, both from frame member 88 of apparatus 50, are grasped in the hands of man 134 and extended downwardly as the man walks or runs on surface 56 of treadmill 52 to achieve desired unloading and resistance exercise benefit. Again, the hands can be switched as desired and frame member 88 can be moved in the directions denoted by arrow A either freely or in opposition to a biasing element or elements to enhance and vary the unloading and resistance benefit achieved. Here again, bar 108 can be pulled down to exercise the triceps, or pulled toward the user's head to exercise the biceps.

Figure 37:
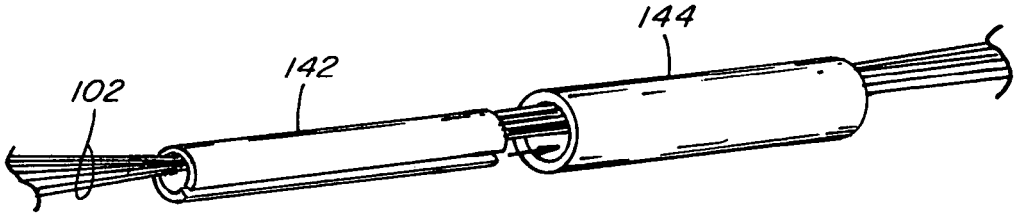
FIG. 37 is an enlarged fragmentary view of exercise elements of the apparatus of FIG. 1, showing tubular handles therearound.

FIG. 37 shows additional elements for use with cords 102 extending between forward and rear legs 70 of apparatus 50 (FIG. 1), which elements include tubular handles 142 and 144 which can extend around one or a group of cords 102 and be selectably grasped as desired or required for extending cords 102 in a desired direction for achieving unloading and resistance exercise effects. Here it should be noted that tubular handle 144 has a passage therethrough sufficiently large for receiving handle 142 in telescoping relation as desired. An advantage of handles 142 and 144 is that when unloading and performing a resistance exercise, the handles can be easily moved along cords 102 for changing the grasping position and/or varying the exercise and stretching effect. Additionally, the different external diameters of handles 142 and 144 facilitate grasping with different size hands. Handles 142 and or 144 can optionally be slit longitudinally to facilitate placing cords 102 therein and removing the cords therefrom, as shown.

Figure 37A:
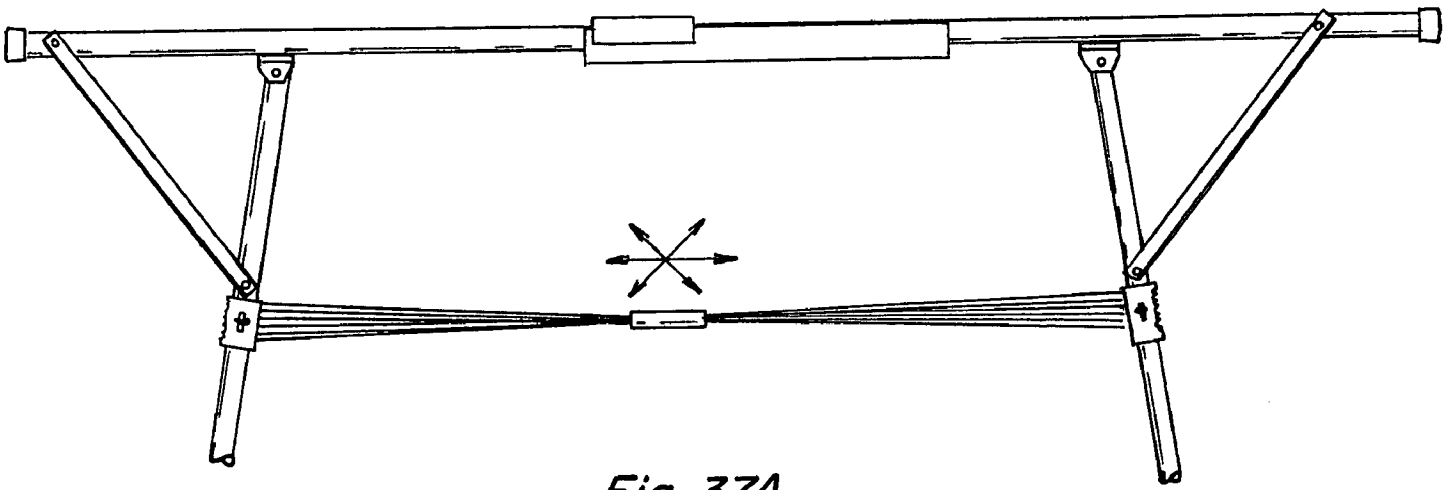
FIG. 37A is a fragmentary side view of the apparatus of FIG. 1, showing the exercise elements and handles of FIG. 37 and illustrating directions of possible movement thereof.

FIG. 37A is a side view of apparatus 50 including cords 102 extending between forward and rearward legs 70 and passing through handles 142 and 144 so as to be capable of being grasped and moved in any of the directions shown by the arrows, for multi-planar exercise and stretching benefit.

Figure 37B:
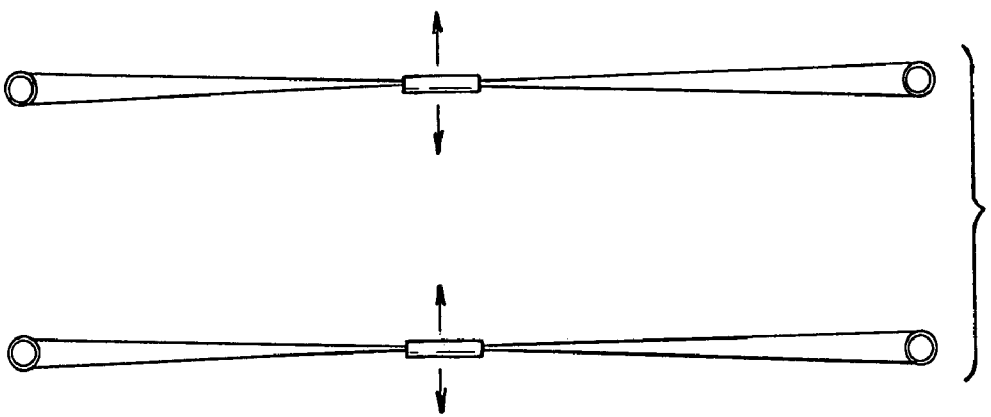
FIG. 37B is a simplified top view of the apparatus of FIG. 1 showing the exercise elements of FIGS. 37 and 37A and illustrating further directions of possible movements thereof.

FIG. 37B is a top view of apparatus 50 showing cords 102 extending between forward and rearward legs 70 and passing through handles 142 and 144 and movable sidewardly inwardly and outwardly as denoted by the arrows, again to illustrate the multi-planar benefits achievable.

Figure 38B:
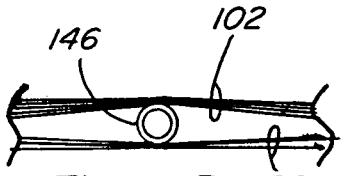
FIG. 38B is a side view of the exercise elements and cross bar of FIG. 38 shown together in a different way.
Figure 38:
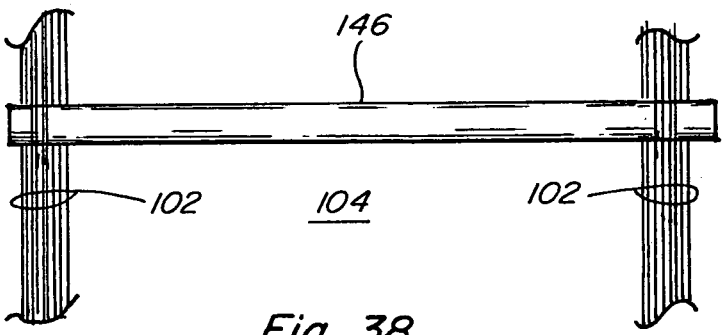
FIG. 38 is an enlarged fragmentary top view of exercise elements of the apparatus of FIG. 1, showing an optional cross bar extending therebetween.
Figure 38A:
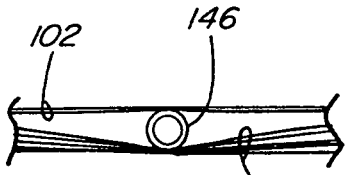
FIG. 38A is a side view of the exercise elements and cross bar of FIG. 38.

FIG. 38 shows still another exercise element of the present invention, which is an elongate bar 146 that can be extended across area 104 above surface 56 of treadmill 52 (FIG. 1) in front of or behind a user so as to be graspable and movable upwardly or downwardly for resiliently extending cords 102, downward movement of bar 146 achieving unloading, and upward movement increasing the load applied through the user's body against surface 56. The degree or amount of resistance encountered will be a function of the amount of the extension of cords 102, and also the number of cords extended by the movement. For instance, in FIG. 38A, bar 146 is shown inserted between one cord 102 and a group of three cords 102 such that when bar 146 is displaced upwardly, less resistance will be encountered compared to if a greater number of cords 102 were located above bar 146.

Figure 38C:
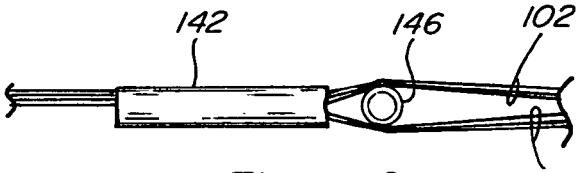
FIG. 38C is a side view of the exercise elements and cross bar of FIG. 38 in association with one of the handles of FIG. 37.

In FIG. 38B, two cords 102 are located above bar 146 and two below, to illustrate another variant. In FIG. 38C, bar 146 is disposed beneath two cords 102 and above two cords 102, with handle 142 slid along the cords to a position close to bar 146, such that bar 146 will be prevented from moving in a direction toward handle 142, and such that greater resistance will be achieved due to the holding together of cords 102 on that side of bar 146. Another or a similar arrangement could be used on the opposite side of bar 146 to limit movement thereof in that direction.

Figure 38D:
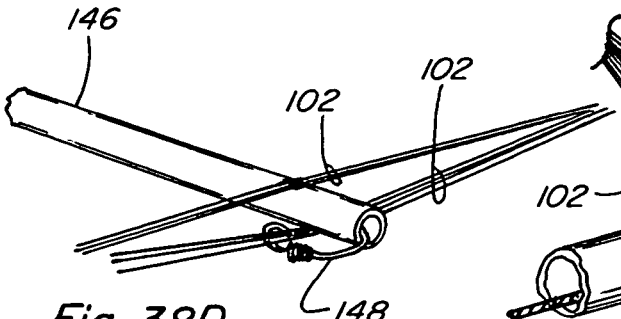
FIG. 38D is a fragmentary perspective view of the exercise elements and cross bar of FIG. 38 showing one manner of connecting them.
Figure 38E:
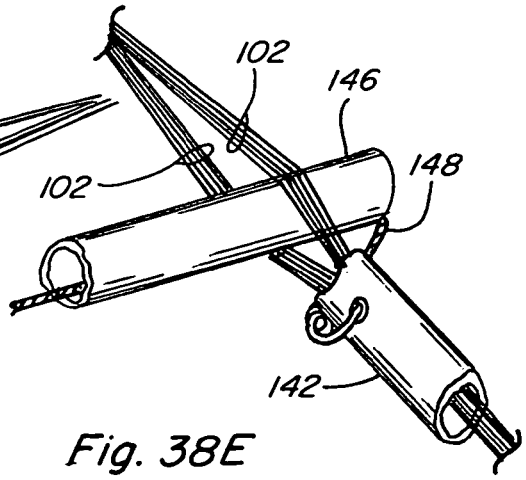
FIG. 38E is a fragmentary perspective view of the exercise elements, cross bar and handle of FIG. 38C showing another connector therebetween.

FIGS. 38D and 39E show two manners of connecting bar 146 to cords 102 and/or handles 142 or 144. In FIG. 38D, a cord 142 extending through bar 146 includes a hook for looping around selected ones or all of cords 102. In FIG. 38E, cord 148 is shown extending through bar 146 and hooked to handle 142. Here, it should be recognized and understood that a variety of other manners of connection of bar 148 to cords 102 and to handles 142 or 144 can be utilized, including, but not limited to, hook and loop type fasteners, straps, ropes, clips, snaps and other widely available and well known fasteners.

Figure 39:
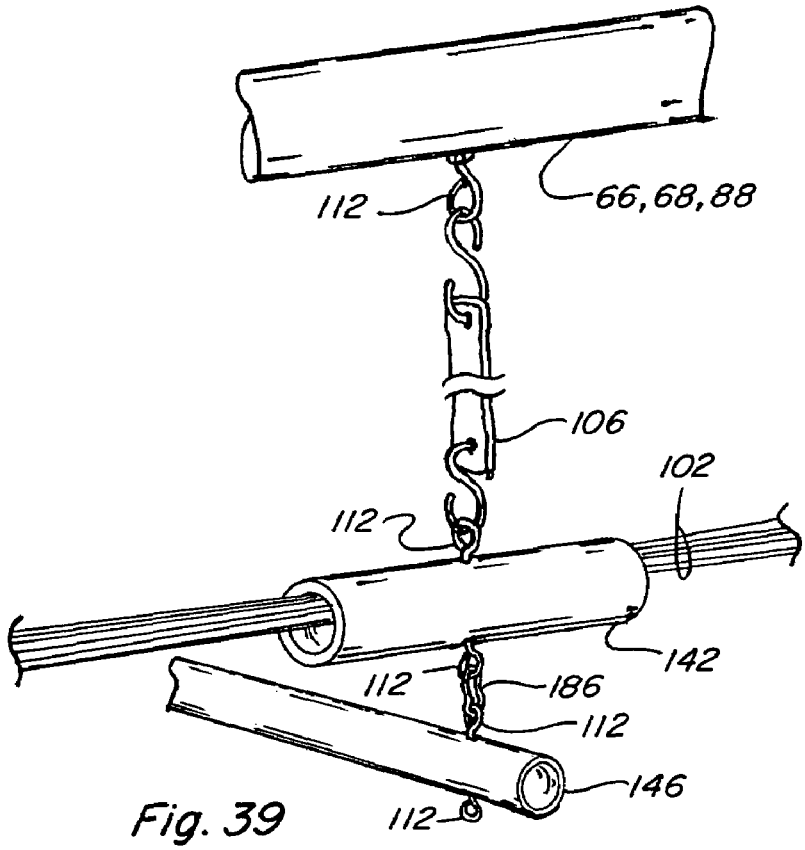
FIG. 39 is a fragmentary perspective view of the exercise elements, cross bar and handle of FIG. 38C showing another connector therebetween.

FIG. 39 shows still another variant for supporting a bar 146 in sidewardly extending relation across the area above a treadmill or other cardiovascular exercise device or machine. Here, a handle 142 extending around cords 102 extending between the legs of the support structure includes upper and lower eyelets 112, the lower eyelets being connected to eyelets 112 on bar 146 by a removable link 186 or other connector. Additionally, a cord or strap 106 which can be optionally of fixed length or resiliently elongatable has a lower end connected to eyelet 112 of handle 142, and an upper end connected to an eyelet 112 on one of support members 66 or 68 or frame member 88. This is beneficial in that it increases the downward force necessary for movement of bar 146 downward, and, if non-extendable or stiff enough, can serve to support bar 146 for use as a stabilizing railing for rehabilitation sessions, more infirm users, and the like.

Figure 39A:
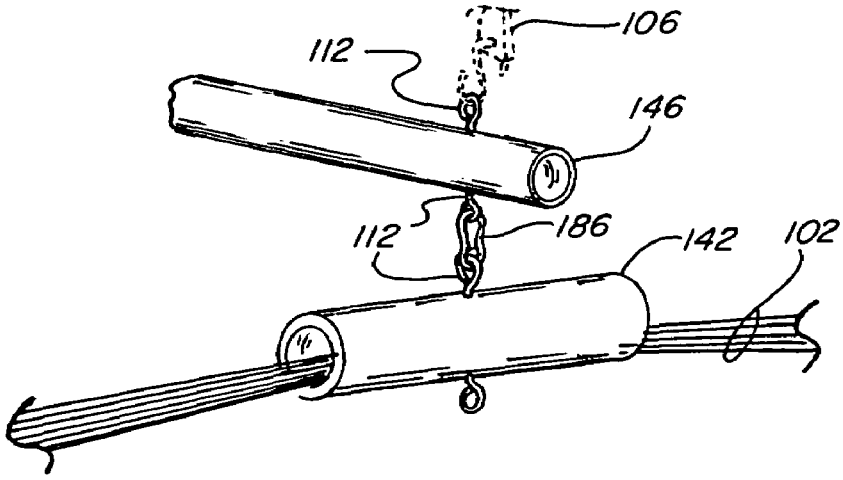
FIG. 39A is a fragmentary perspective view of the exercise elements, cross bar and handle of FIG. 38C showing another connector therebetween.

FIG. 39A differs from FIG. 39 in the location of bar 146 above cords 102 and handle 142. Here, bar 146 includes an upper eyelet 112 connected to strap 106, and a lower eyelet 112 connected by removable link 186 to an upper eyelet 112 on handle 142. Here again, with use of sufficiently stiff straps 106, bar 146 can be utilized as a railing, and grasped and raised to extend cords 102 which extend between the legs of the support structure of the present apparatus.

Figure 40:
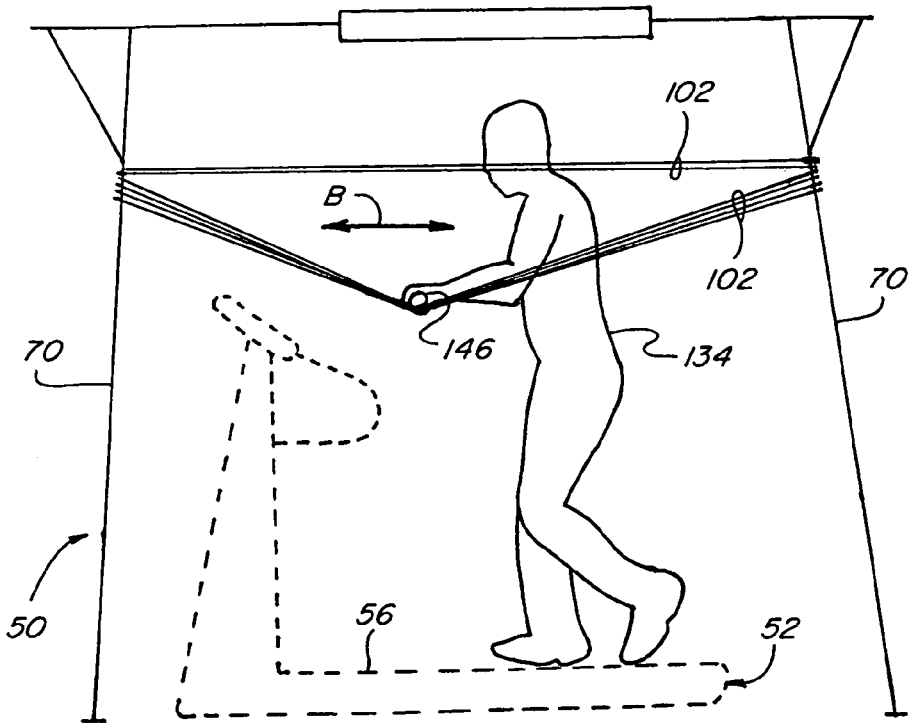
FIG. 40 is a simplified schematic representation of the apparatus of FIG. 1 including the cross bar of FIG. 38, showing one manner of unloading and performing a resistance exercise therewith.

In FIG. 40, usage of bar 146 is illustrated. Man 134 is shown walking or running on surface 56 of treadmill 52, grasping bar 146 in both hands to extend a plurality of cords 102 extending between legs 70 of apparatus 50 downwardly for achieving unloading and resistance exercise benefit, namely, exercise of the triceps. Here, it can be observed that bar 146 can be moved longitudinally along cords 102 to a desired position, as denoted by arrow B, both with cords 102 in their free state and extended as shown. To vary the exercise, bar 146 can be removed and placed between, above, or below, a desired number of cords 102 for achieving a desired level of resistance. This exercise is also well adapted for use with the elliptical trainer 150 of FIG. 41.

Figure 40A:
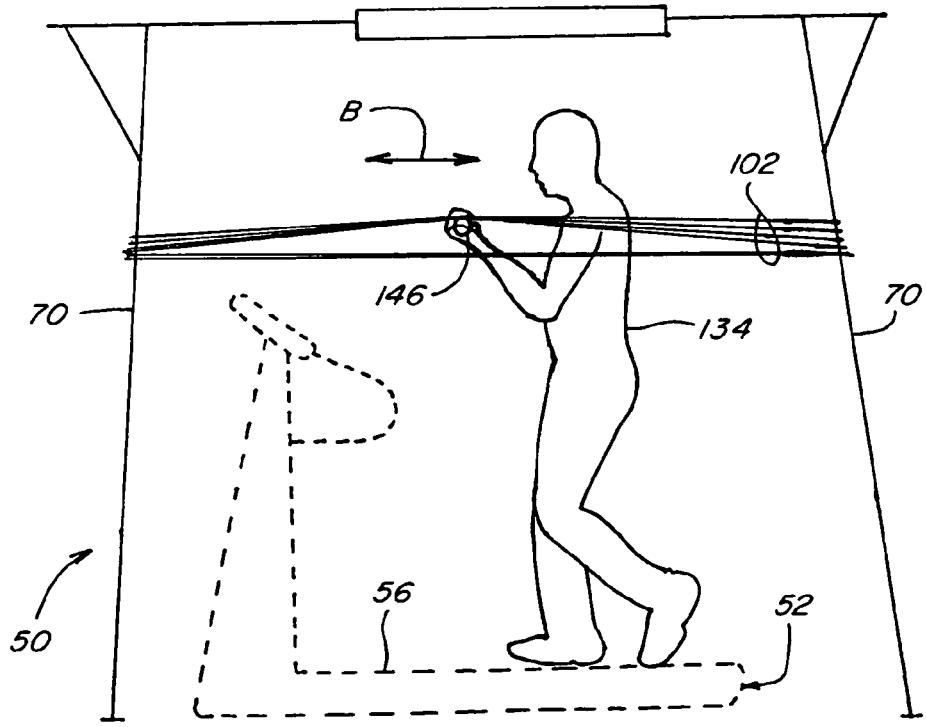
FIG. 40A is a simplified schematic representation of the apparatus of FIG. 1 and the cross bar of FIG. 38, showing another manner of exercising therewith.

FIG. 40A is a variation of the exercise with bar 146, wherein man 134 is walking or running on surface 56 of treadmill 52 and curling or moving bar 146 upwardly against a plurality of cords 102 extending between legs 70 of apparatus 50, to mainly exercise the biceps. Again, to vary the exercise, bar 146 can be removed and placed between, above, or below, a desired number of cords 102 for achieving a desired level of resistance.

Figure 40B:
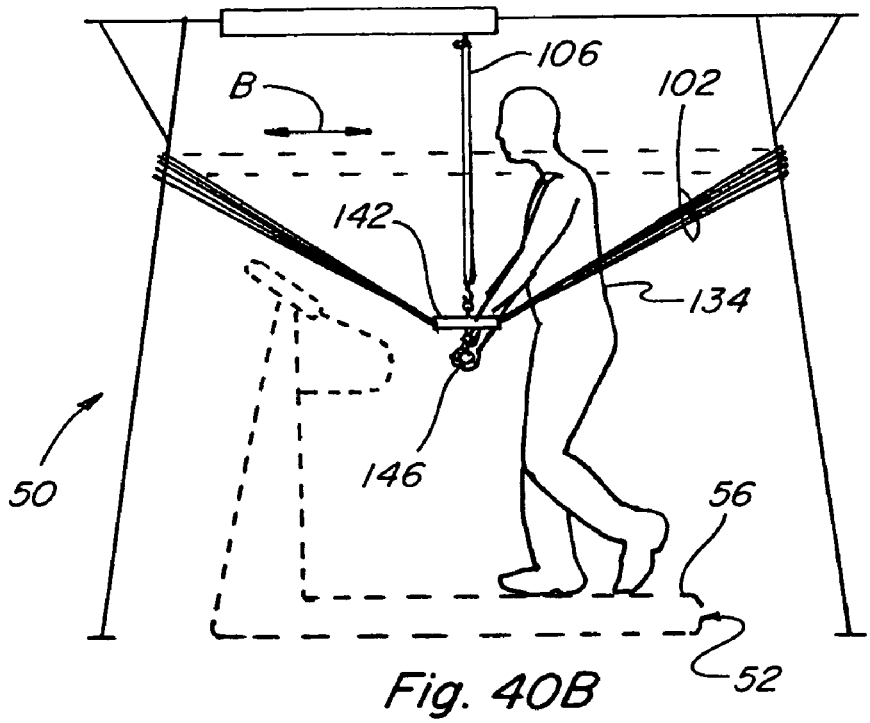
FIG. 40B is a simplified schematic representation of the apparatus of FIGS. 1 and 39, showing one manner of unloading and performing a resistance exercise therewith.

FIG. 40B shows the variant of apparatus 50 of FIG. 39, wherein man 134 grasps bar 146 suspended by handles 142 and applies a downward force thereagainst, to resiliently extend cords 102 and straps 106 while walking or running on surface 56 of treadmill 52 for achieving unloading and resistance exercise effect. Here, forward or rearward movement of bar 146 in the direction B is possible so as to vary the exercise and allow the person to move to various locations on surface 56.

Figure 40C:
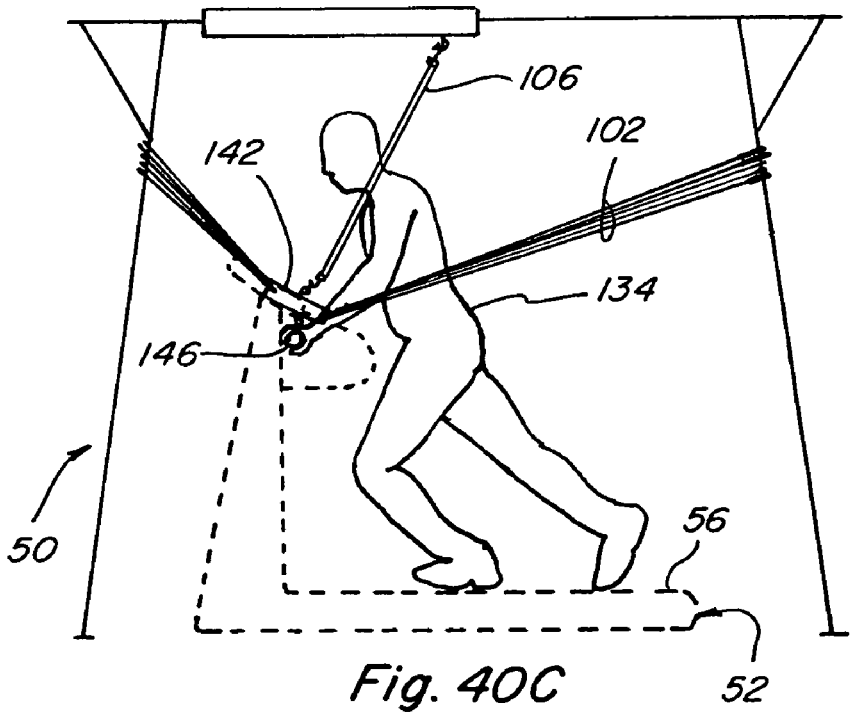
FIG. 40C is another simplified schematic representation of the apparatus of FIGS. 1 and 39, showing another manner of unloading and performing a resistance exercise therewith.

FIG. 40C illustrates man 134 running or walking on surface 56 of treadmill 52 and exerting a downward and more forwardly directed force against bar 146 suspended from handles 142 of apparatus 50. Here, the portions of cords 142 rearward of handles 142 are stretched and elongated, whereas more forward portions of the cords may be more limp or not elongated at all. Straps 106 are also significantly elongated so as to be representative of the more strenuous use of bar 146. An advantage of this exercise is that a user is able to use significant leg and trunk muscles to exert the forwardly directed force against surface 56 of the treadmill, for more of a core body benefit.

Figure 40D:
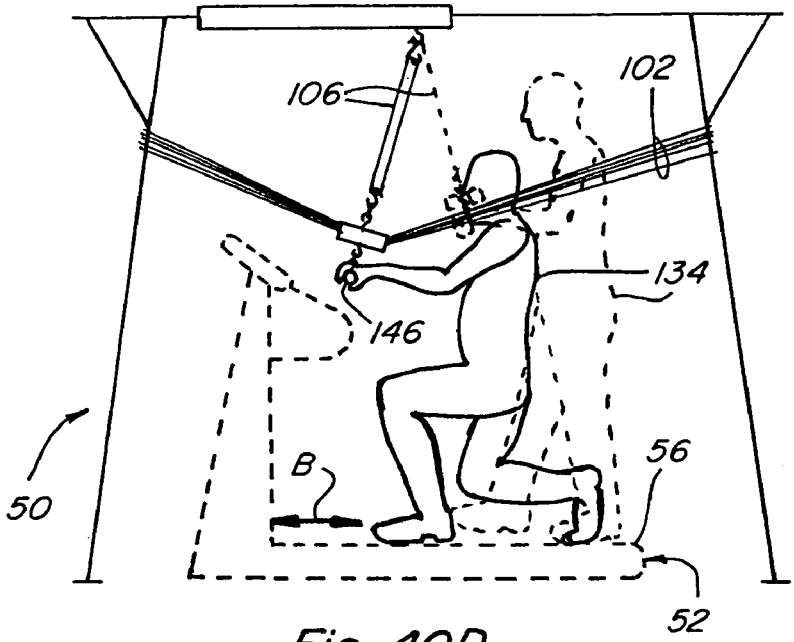
FIG. 40D is still another simplified schematic representation of the apparatus of FIGS. 1 and 39, showing another manner of exercising therewith.

In FIG. 40D, another variant of usage of bar 146 of apparatus 50 is shown, wherein man 134 holds bar 146 to extend cords 102 and straps 106 for performing lunge type exercises on surface 56 of treadmill 52, again, for more core body benefit. It is also possible to move bar 146 forwardly and rearwardly as denoted by arrow B to facilitate movement on surface 56 and for varying the exercise.

In FIG. 41, apparatus 50 is shown in association with another cardiovascular exercise device, which is a conventional, well known commercially available elliptical trainer 150, such as available from Lifefitness Division of Brunswick Corp. of Lake Forest, Ill., and Precor U.S.A of Woodinville, Wash., both of U.S.A. Essentially, elliptical trainer 150 includes a pair of surfaces or pedals 154 and 156 extending between a crank mechanism 158 and a pair of adjustable ramps 160. Movement of the legs of man 134 rotate crank mechanism 158 by a kind of up and down cycling movement such that pedals 154 and 156 can move upwardly and downwardly along ramps 160. A user such as man 134 can apply or direct his or her entire weight against pedals 154 and 156, or can partially unload by grasping and holding handles 162 on opposite sides of or across a console of trainer 150. Apparatus 50 is shown including representative cords 102 disposed in front and rear extending relation between support members 66 and 68 of apparatus 50, cords 102 being grasped by man 134 and pulled downwardly, either together or alternatingly for asymmetrical effect, and in one or more planes of movement, for unloading and providing a desired resistance exercise benefit. Here again, cords 102 can be grasped at any desired location or locations along their lengths and extended in a desired direction for achieving a sought after benefit. Here, it should be noted that any of the previously described exercise apparatus can be utilized with trainer 150, including cords 102 extending between legs 70, one or more straps 106, bars 108, a pulley 118 and cord 102, as well as bar 146, as desired. And, if frame member 88 is used, movement of frame member 88 forwardly and/or rearwardly as denoted by arrow A in opposition to one or more resiliently extendible or compressible members such as springs 120 (FIG. 7) will provide the additional effect of providing resistance in another direction.

Figure 42:
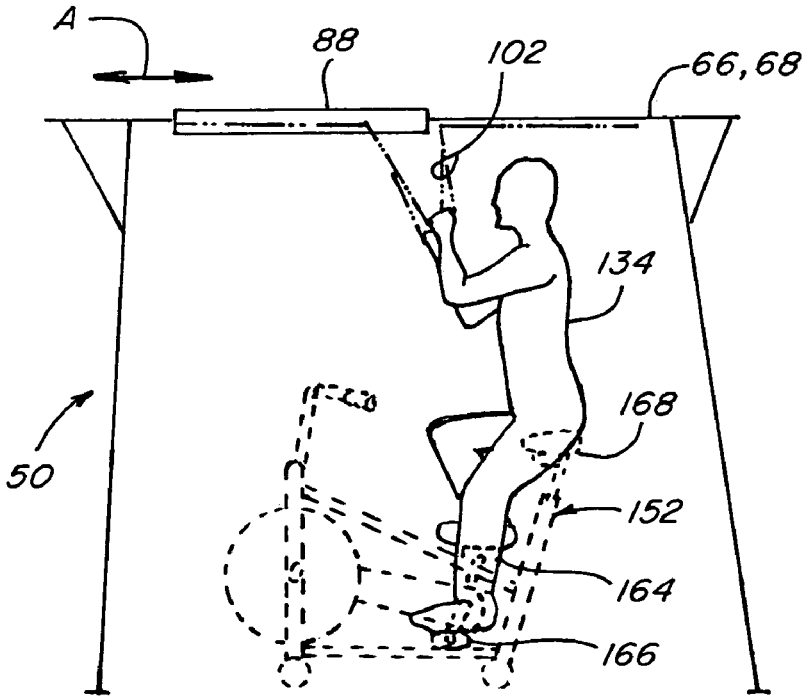
FIG. 42 is a simplified schematic representation of the apparatus of FIG. 1 including a representative exercise element thereof, and a person exercising therewith while performing a cardiovascular exercise on a representative stationary cycle.

In FIG. 42, apparatus 50 is shown in association with still another cardiovascular exercise machine, which is a conventional well known commercially available stationary exercycle 152, such as available from Lifefitness and Precor. Exercycle 152 includes a pair of weight bearing elements including pedals 164 and 166 connected to a crank mechanism, and also a seat 168. Man 134 is seated on seat 168 with his feet on pedals 164 and 166. The man's feet are moved in a cycling motion in the well known manner for performing a cycling exercise. At the same time, man 134 can grasp one or more exercise elements, such as representative cords 102 shown, and resiliently extend the exercise elements in a downward direction as shown, or in any other desired direction, simultaneously, or alternatingly, for achieving a desired unloading and resistance exercise benefit, including in multiple planes of movement. Referring also to FIG. 41, if the exercise elements are connected to frame member 88, it can be moved forwardly and/or rearwardly as desired, as denoted by arrows A, either freely or in opposition to one or more biasing elements for varying the exercise and for achieving a comfortable position.

Figure 43:
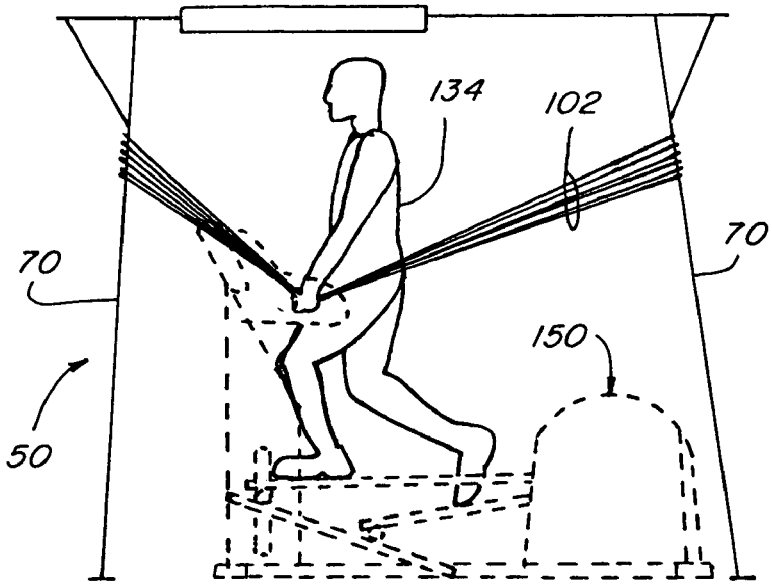
FIG. 43 is a simplified schematic representation of the apparatus of FIG. 1 showing a person exercising using different exercise elements while performing a cardiovascular exercise on an elliptical machine.

In FIG. 43, man 134 is shown exercising on elliptical trainer 150 while grasping a plurality of cords 102 extending between legs 70 of apparatus 50 and extending them downwardly for achieving unloading and resistance exercise benefit. Again, asymmetrical and multi-planar exercise and stretching movements can be made.

Figure 44:
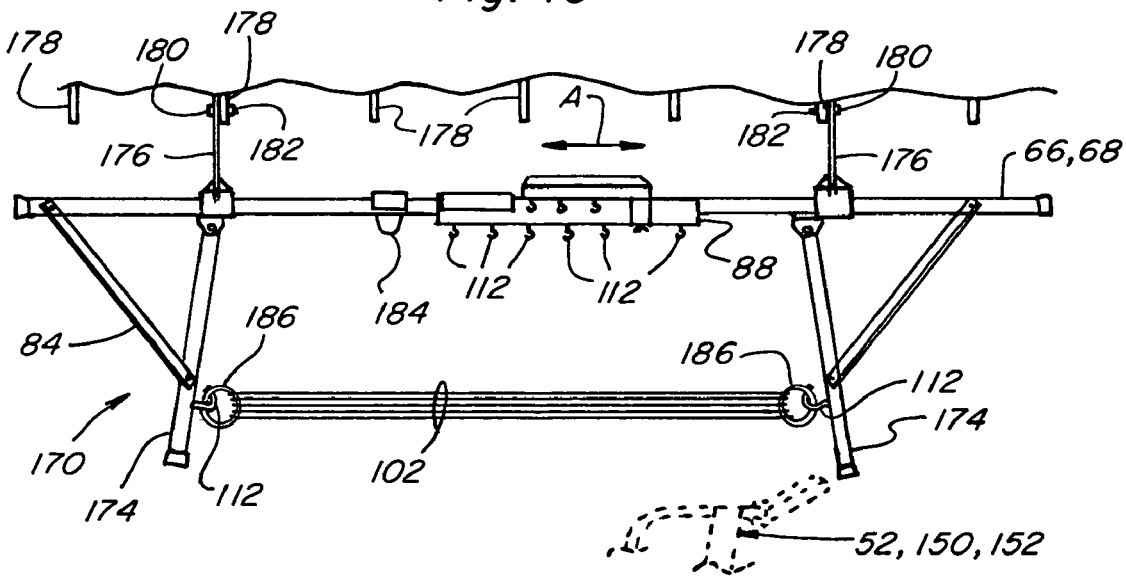
FIG. 44 is a side view of exercise apparatus according to the present invention, similar to the apparatus of FIG. 1, but including support structure for suspending the apparatus from a ceiling.

FIG. 44 shows an alternative embodiment of variable unweighting and resistance training apparatus 170, constructed and operable according to the teachings of the present invention, like parts of apparatus 50 and apparatus 170 being identified by like numbers. Apparatus 170 includes a support structure 172 including a pair of spaced, parallel, elongate support members 66 and 68, four stub legs 174 connected to support members 66 and 68 so as to extend downwardly therefrom in a manner similar to legs 70 of apparatus 50, a plurality of braces 84 extending between members 64, 66 and legs 174, and a plurality of hanger brackets 176 connected to support members 66 and 68 extending upwardly therefrom for fixed or adjustable connection to overhead structure, such as a ceiling or floor joists 178 located above a room containing an exercise device or machine represented by treadmill 52, elliptical trainer 150 and stationary cycle 152. Hanger brackets 176 can be of any suitable construction such as of sheet metal, angle or any cross sectional beam, and can be provided in any sufficient length and number for supporting apparatus 170 at a desired height above an exercise machine such as treadmill 52, elliptical trainer 150, or cycle 152 under anticipated loading conditions. Additionally, brackets 176 can be attached to joists 178 or other overhead structure in any suitable manner utilizing any suitable elements, such as bolts and nuts 180 and 182. Apparatus 170 can include any of the exercise elements usable with apparatus 50, including, but not limited to, a plurality of elongate resiliently extendable cords 102 extending forwardly and rearwardly between stub legs 174 in position to be on the opposite sides of a person exercising on treadmill 52, elliptical trainer 150 and stationary cycle 152, for use in the manners described hereinabove. Apparatus 170 can additionally include frame member 88 supported on support members 66 and 68 for forward and rearward movement, as denoted by arrow A, either freely or in opposition to one or more resilient biasing elements such as springs 120 or the like. Frame member 88 can also be movable using a suitable motorized drive, such as drive 122 shown in FIG. 8. Support structure 172 and frame member 88 can include a variety of elements for supporting the above-described exercise elements therefrom, including, but not limited to, a plurality of eyelets 112 for supporting exercise elements such as one or more bars 108 from springs 110, cords 102, pulleys 118, or the like, as desired. Here, it should be noted that as one variant for attachment of cords 102 between stub legs 174, and also legs 70 of apparatus 50, eyelets 112 can be provided in the leg 174 or 70 and cords 102 extended through a link 186 which is connectable between the eyelets. In this way, sets of cords 102 having varying resiliency and resistance characteristics can be utilized as desired.

Figure 45:
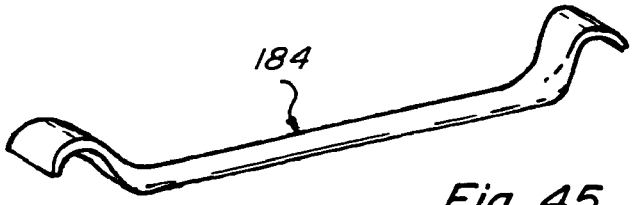
FIG. 45 is a perspective view of an optional pull-up bar for use with the apparatus of FIGS. 1 and 44.

Referring also to FIG. 45, a removable rigid cross bar 184 is positionable extending between support members 66 and 68 at about the same level thereof, of either apparatus 50 or 170. Bar 184 is positionable on support member 66 and 68 at a desired longitudinal location thereon. Bar 184 can be grasped in one or both hands for providing unloading and resistance exercise benefit. Bar 184 can also be used as a conventional pull-up or chin-up bar.

Figure 46:
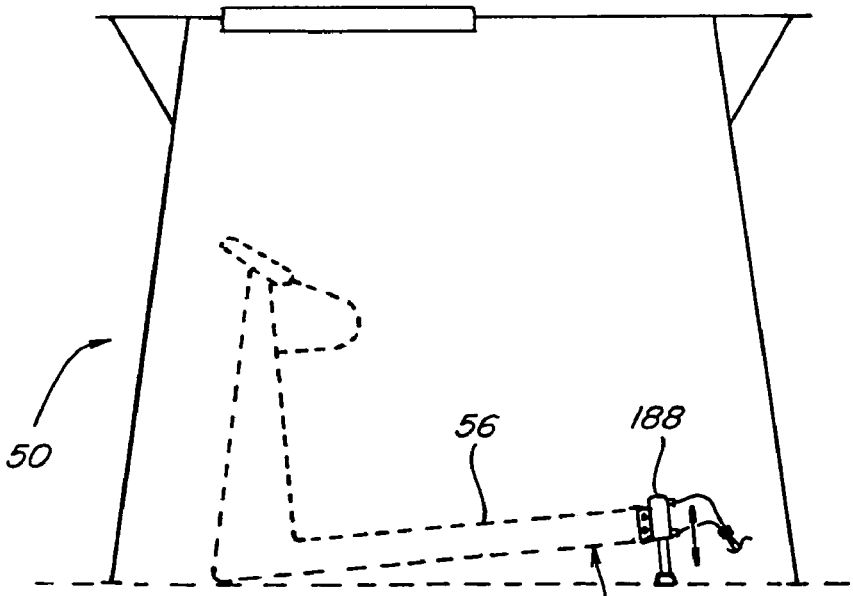
FIG. 46 is a side view of the apparatus and treadmill of FIG. 1 with an optional lifter mechanism for raising the rear end of the treadmill.

In FIG. 46, a rear lifter mechanism 188 is shown lifting a rear end of treadmill 52 above a floor or other surface on which apparatus 50 and treadmill 52 is located. This allows varying the angle of surface 56 so as to extend more horizontally or downwardly toward the forward end of the treadmill for varying the exercise effect, and/or for adjusting the relative locations of apparatus 50 and treadmill 52 for better fit or comfort during use. Lifter mechanism 188 can include one or more conventionally constructed and operable jacks, such as, but not limited to, scissors jacks, hydraulic jacks, screw jacks, or the like, and can be manually operable and/or powered in a suitable conventional manner.

Figure 47:
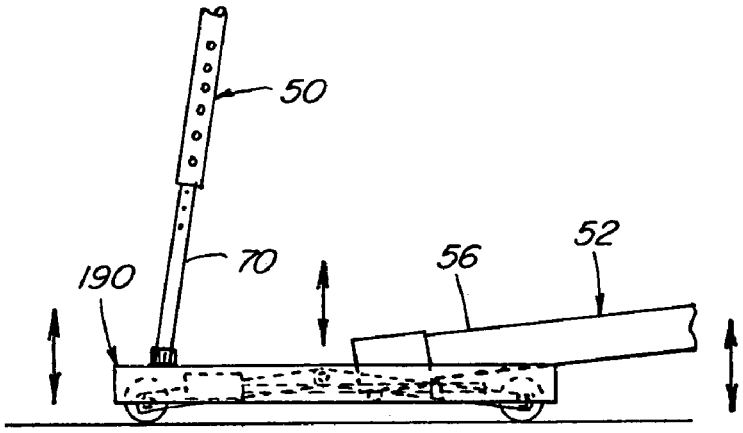
FIG. 47 is a fragmentary side view of the rear ends of the apparatus and treadmill of FIG. 1 with an optional lifter mechanism for lifting the rear ends together or separately.

FIG. 47 shows the rear legs 70 of apparatus 50 and the rear end of treadmill 52 supported on an alternative lifter mechanism 190 operable for lifting or raising and lowering them simultaneously and equally as illustrated by the arrow at the center of mechanism 190, or separately, as illustrated by the arrows adjacent the ends of mechanism 190. Lifter mechanism 190 can include one or more conventionally constructed and operable jacks, such as, but not limited to, scissors jacks, hydraulic jacks, screw jacks, or the like, and can be manually operable and/or powered in a suitable conventional manner. Using mechanism 190, the incline of surface 56 of the treadmill can be adjusted, and also the relative vertical distance between the exercise elements and surface 56.

Figure 48:
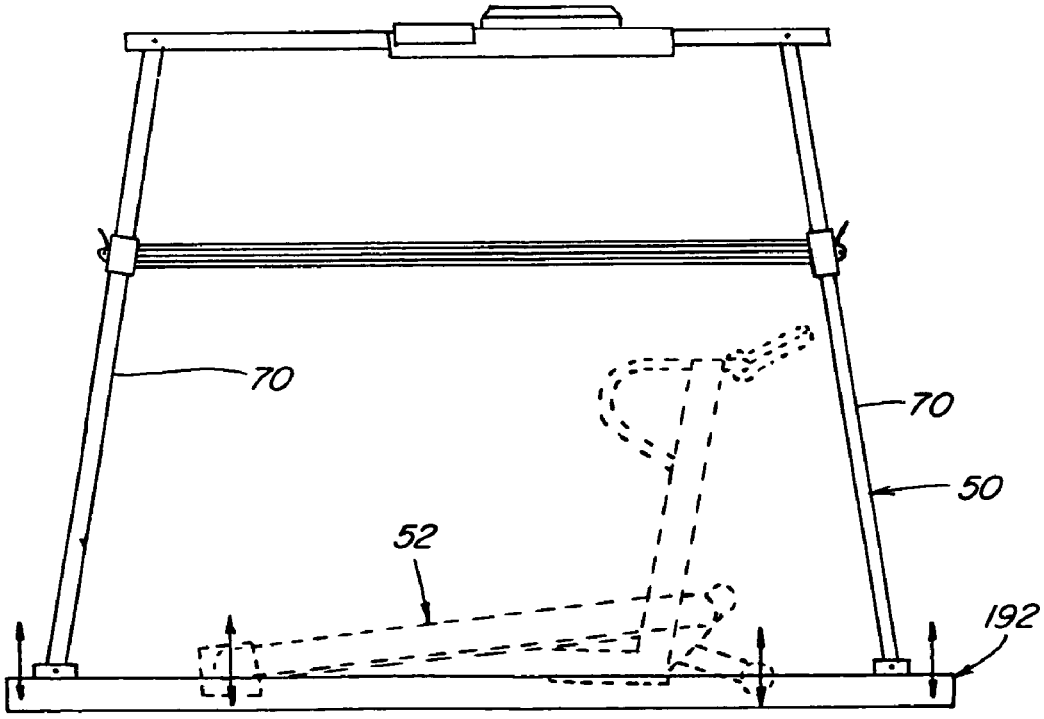
FIG. 48 is a side view of the apparatus and treadmill of FIG. 1 with an optional lifter mechanism for lifting the forward and rear ends thereof together or separately.

FIG. 48 shows legs 70 of apparatus 50 and treadmill 52 supported on still another lifter mechanism 192 which can include a plurality of conventionally constructed and operable jacks, such as, but not limited to, scissors jacks, hydraulic jacks, screw jacks, or the like, which can be manually operable and/or powered in a suitable conventional manner for variably raising and lowering forward and rearward legs 70 and the forward and rearward ends of the treadmill, as illustrated by the arrows.

Figure 49:
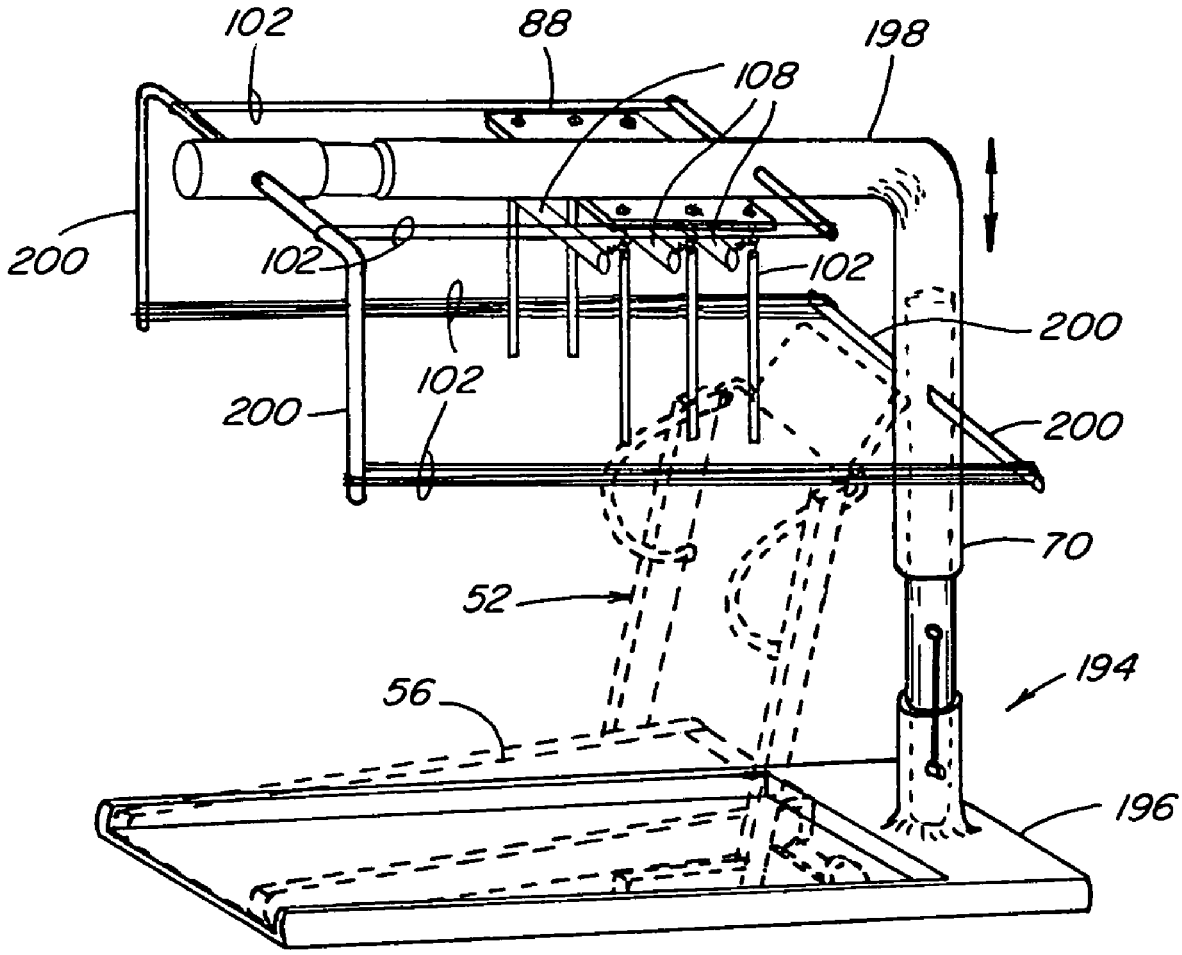
FIG. 49 is a perspective view of the treadmill of FIG. 1 with an alternative support structure for the apparatus of the invention.

In FIG. 49 another variable unloading and resistance training and stretching apparatus 194 constructed and operable according to the present invention is shown, like parts of apparatus 194 and apparatus 50 being identified by like numbers. Apparatus 194 is shown supported on and balanced by a generally horizontal base 196. Base 196 is generally U-shape and receives treadmill 52. Base 196 supports a single upstanding leg 70 that can be of tubular or solid construction and telescoping or otherwise variable in length optionally using one or more fluid cylinders. Leg 70 supports a generally horizontal support structure 198 extending forwardly and rearwardly over upper surface 56 of treadmill 52. Support structure 198 can support a frame member 88, either at a fixed location or movably as explained above for supporting one or more exercise elements, such as, but not limited to, cords 102 and/or bars 108 such as shown, for use in the above described manner. Support structure 198 can also be telescoping in a manner similar to leg 70 optionally using one or more fluid cylinders or otherwise can be variable in length to allow varying the tension in cords 102 for increasing and decreasing the resistance levels provided thereby. Arms 200 shown projecting from leg 70 and structure 198 support a plurality of cords 102 along opposite sides of a space above surface 56, which are also usable in the above described manner.

It is contemplated that the various exercise elements disclosed hereinabove, namely, cords 102, straps 106, bars 108, pulley 118, handles 142 and 144, and bar 148, can be used on apparatus 50 and 194 in any combination to achieve the desired unloading or unweighting and resistance exercise effect. Thus, it is anticipated that such exercise elements can be provided in any desired combination, it being preferred that exercise elements be provided in combinations including ones located beside opposite sides of the person's trunk or body, and above or forwardly of the person's head, which has been found to provide sufficient alternative positions for a typical exercise and/or stretching session. As an example, while using a selected cardiovascular exercise machine or device, a user may unload and exercise with one or both arms at a lower position, for instance, any of those discussed above for exercising the triceps, then when the effected muscle groups of the arm or arms are suitably exhausted, switch to exercise elements at another location such as a higher location, for exercising the biceps. Again, different exercise elements located at the same or close locations and movement of the overhead frame member can be utilized to vary the exercise, unloading, and stretching effects.

The present apparatus in its various forms as illustrated by apparatus 50 and 194 can be advantageously used in a variety of locations, including, but not limited to, homes, gyms, fitness clubs, nursing homes, offices, hospitals, and aboard mobile locations such as aircraft, trains and boats, to enable a wide variety of users to receive benefits from a desired combination of fitness, strength, and cardiovascular exercises, and stretches.

The present apparatus can also include additional optional features, including, but not limited to media devices such as music and/or video players for playing exercise music, instructions, news and the like, as illustrated by speakers 202 located on legs 70 of apparatus 50 in FIG. 1.

Figure 50:
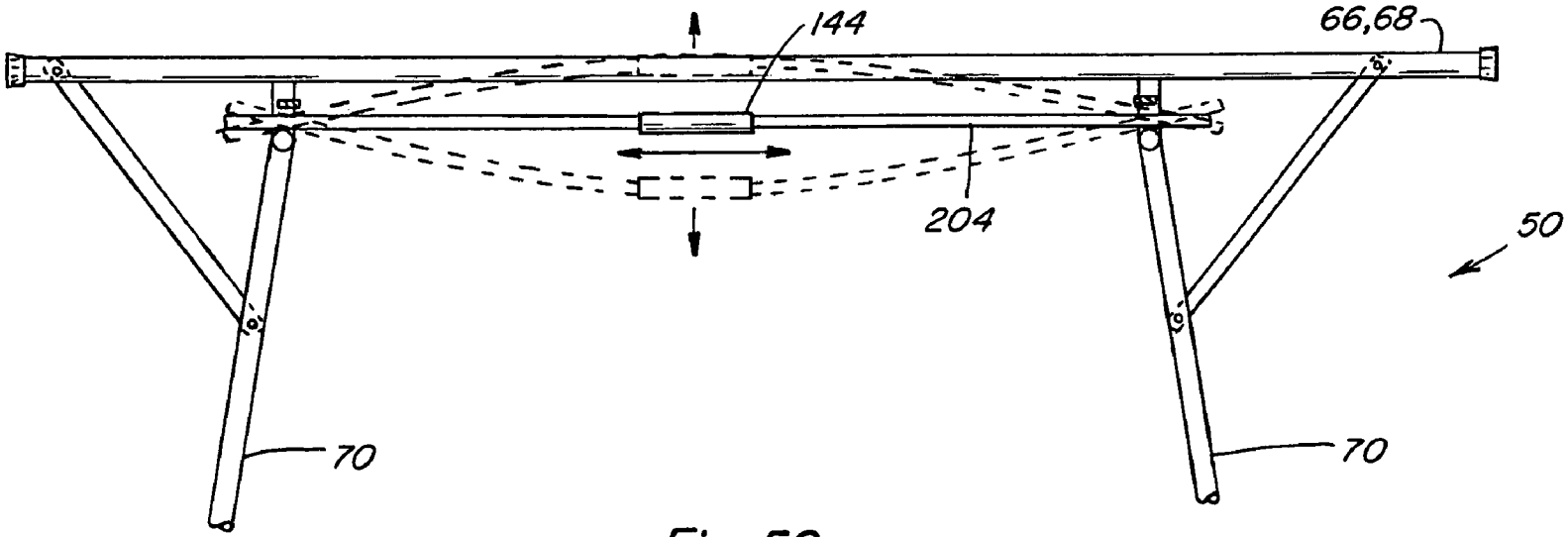
FIG. 50 is a fragmentary side view of the apparatus of FIG. 1 showing additional exercise elements therefor.

FIG. 50 shows still another alternative exercise element for use with apparatus 50, which is a bar 204 which can be substantially rigid, for instance, of a rigid tubular metal construction, or flexible, for instance, constructed of a flexible polymeric material, such as a fiberglass, plastics composite, or other resiliently flexible material, supported in spanning relation between forwardly and rearwardly located legs 70. Bar 204 includes an optional handle 144 therearound and slidable therealong, as denoted by the arrow. Bar 204 itself or handle 144 can be grasped and if bar 204 is flexible, bar 204 can be resiliently flexed upwardly, downwardly and sidewardly inwardly and outwardly as desired or required for unloading and performing resistance exercise. The slidability of handle 144 along bar 204 again allows for movement of a user on a cardiovascular machine such as treadmill 52 shown and discussed above, or any of the other cardiovascular machines with which apparatus 50 is used, and also sliding movement of the hands along bar 204, to achieve a comfortable position or a position for exercising a muscle group in a particular way. Handles 144 can be moved along bars 204 together or reciprocally, as desired.

Figure 50A:
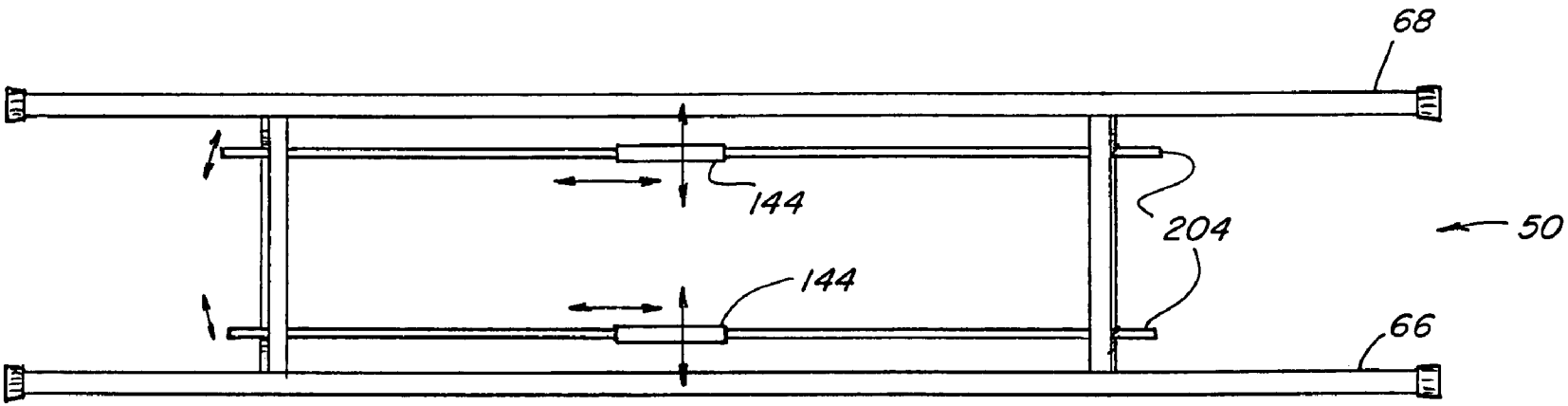
FIG. 50A is a simplified top view of the apparatus of FIG. 1, showing the exercise elements of FIG. 50 thereon.

FIG. 50A is a top view of apparatus 50 showing a pair of bars 204 suspended between support members 66 and 68 and usable in the manner described in reference to FIG. 50 above. Here, handles 144 are shown movable longitudinally along bars 204 as illustrated by the longitudinal arrows. One or both ends of bars 204 can optionally be supported so as to be movable sidewardly relatively to support members 66 and 68 as illustrated by the arrows at the ends of the bars 204, to allow varying the forward and rearward orientation of bars 204 for comfort or therapeutic benefit, and for allowing varying the path of movement of the hands and arms during exercise. Here, it should be noted that bars 204 are shown in FIGS. 50 and 50A at a high position on legs 70, in the vicinity of support members 66 and 68. However, it should also be noted that bars 204 can be likewise utilized at other locations, such as lower locations extending between forward and rearward legs 70 similar to the locations of cords 102 extending therebetween and discussed above. As another advantage, if bars 204 are flexible, handles 144 can be similarly flexible so as to be more easily movable along flexed regions of bars 204.

Figure 50B:
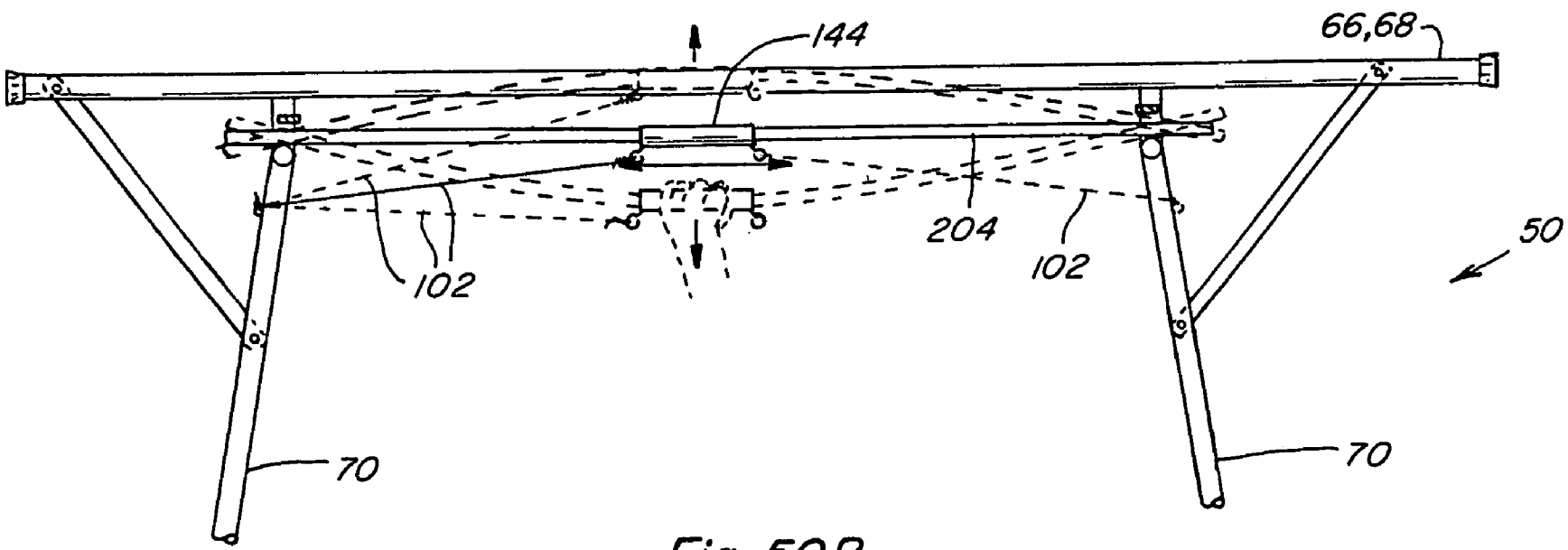
FIG. 50B is another fragmentary side view of the apparatus of FIG. 1 showing additional exercise elements therefor.

FIG. 50B shows a variant of apparatus 50 as shown in FIGS. 50 and 50A, wherein a cord 102 is connected between handle 144 and at least one of legs 70 for resisting forward and/or rearward movement of handle 144 along bar 204 to provide resistance effect. Again, bar 204 is shown as being flexible and movable independently of members 64, 66, such that as handle 144 is slid along bar 204, it can be flexed as desired for comfort and/or resistance benefit.

Figure 50C:
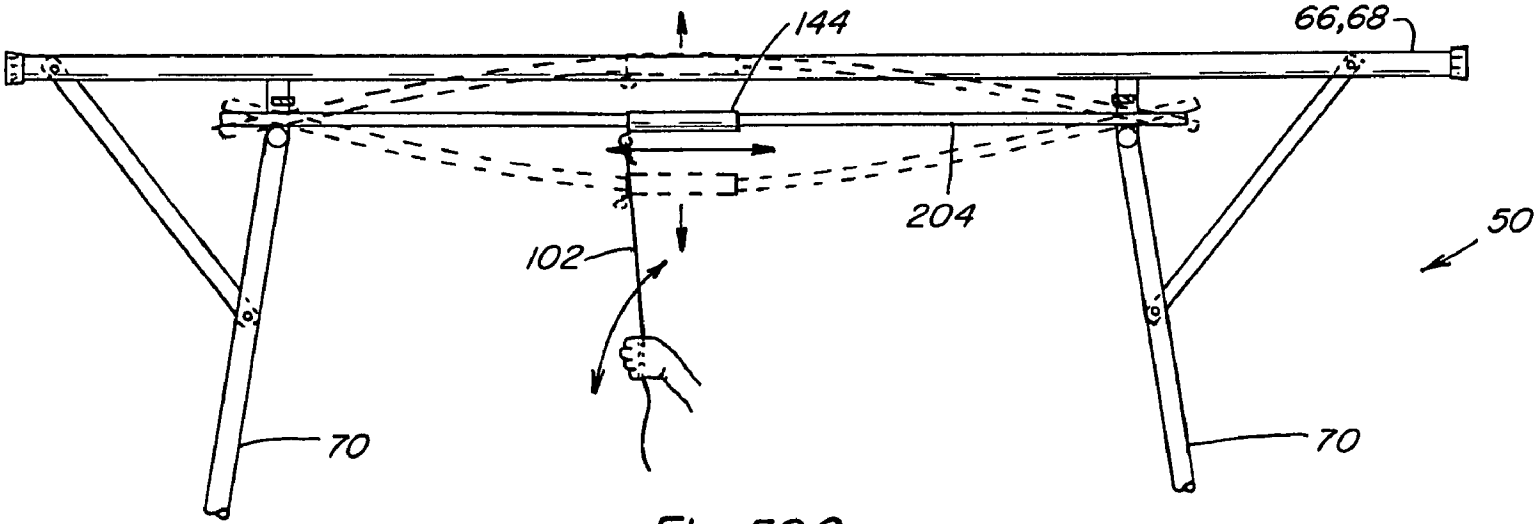
FIG. 50C is another fragmentary side view of the apparatus of FIG. 1 showing additional exercise elements therefor.

FIG. 50C shows another variant of apparatus 50 as shown in FIGS. 50, 50A and 50B. Here, a cord 102 is attached to handle 144 and grasped by a user and moved downwardly and upwardly in an arc or other movement to move handle 144 forwardly and rearwardly along bar 204. Again, bar 204 is supported below support members 64, 66 and is shown as being flexed downwardly, but could be flexed by pulling cord 102 and/or grasping handle 144, in a variety of other directions as represented by the arrows and dotted lines.

Figure 50D:
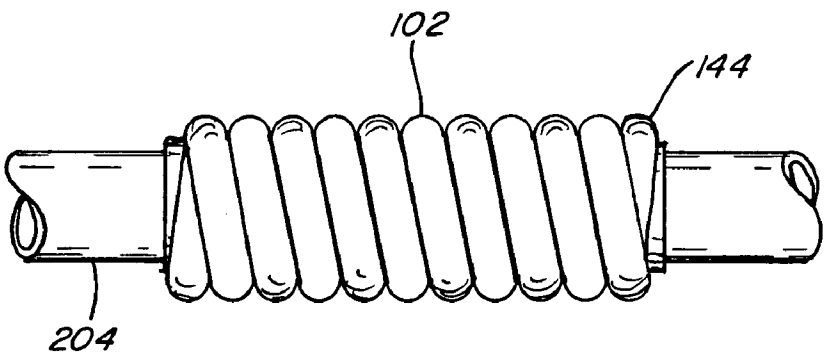
FIG. 50D is an enlarged fragmentary side view of one of the exercise elements of FIGS. 50, 50A, 50B and 50C including an optional grip therefor.

In FIG. 50D, handle 144 on bar 204 is shown wrapped with a cord 102 for improved cushioning and comfort.

Figure 51:
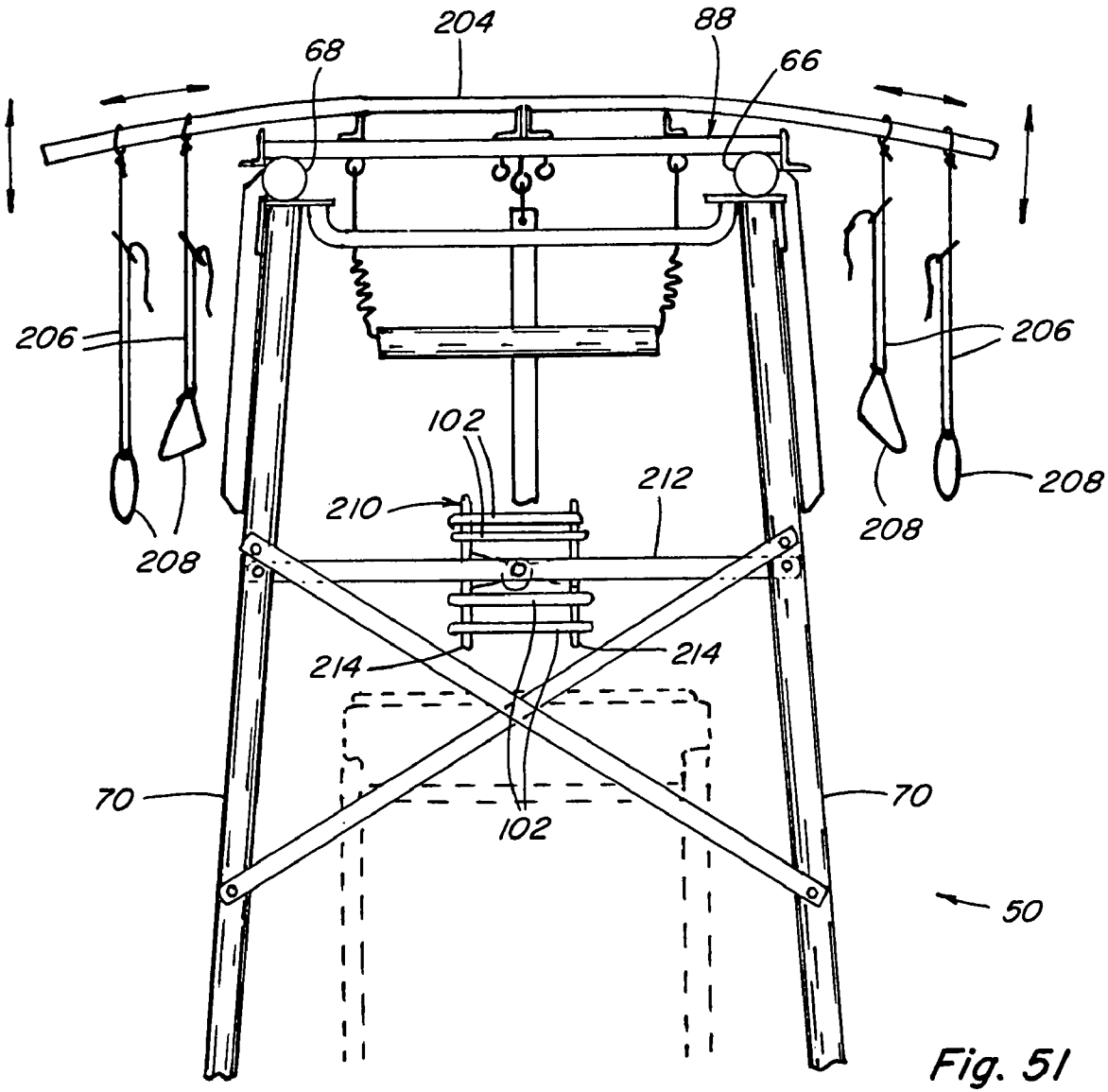
FIG. 51 is a fragmentary end view of the apparatus of FIG. 1, showing still additional exercise elements associated therewith.

FIG. 51 shows still additional exercise elements on apparatus 50, including a bar 204 mounted across movable member 88 so as to extend transversely relative to forwardly and rearwardly extending support members 66 and 68. Bar 204 can be stiff or flexible and is sufficiently long so as to extend sidewardly beyond support members 66 and 68. Bar 204 includes a plurality of exercise elements suspended therefrom, here the exercise elements including cords 206. Cords 206 shown are adjustable in length and positionable at variable locations along bar 204 as desired or required for comfort or achieving a desired exercise benefit, as illustrated by the longitudinally extending arrows. Cords 206 can have a desired degree of resilient elongatability, or can be non-elongatable, as desired. Additionally, cords 206 can be adjustable in length, and can include handles 208 on the ends thereof. For use, handles 208 or cords 206 themselves can be grasped and pulled in directions including directly downwardly; downwardly and sidewardly inwardly and/or outwardly; and/or downwardly and forwardly and/or rearwardly, to just elongate the cords, or also for resiliently flexing bar 204 if flexible, as illustrated by the vertical arrows. In this regard, it is anticipated that a variety of different combinations can be used, including, but not limited to, bar 204 being flexible and some or all of cords 206 being elongatable; bar 204 being stiff and some or all of cords 206 being elongatable; and bar 204 being flexible and some or all of cords 206 being non-elongatable, to provide the capability for varying the unloading, exercising and stretching capabilities possible. Note also that bar 204 is shown supported on movable frame member 88 such that the position of bar 204 over the cardiovascular exercise machine can be varied, and, if frame member 88 is connected to apparatus 50 by one or more resilient members (FIG. 7) movement thereof along support members 66, 68 will provide an additional direction of resistance. Thus, as an example, a user could grasp any of cords 206 and/or handles 208 to elongate the cords 206 in a variety of downward and sideward and/or forward and rearward directions, and/or flex bar 204 upwardly, downwardly, forwardly and/or rearwardly, for obtaining resistance in one or more planes. The user can also or in a desired sequence pull the cords 206 and/or handles 208 in a direction to move frame member 88 along support members 66, 68 to elongate resilient members connecting it to the apparatus 50, in a manner similar to that explained above, to obtain resistance in an additional plane.

Figure 51B:
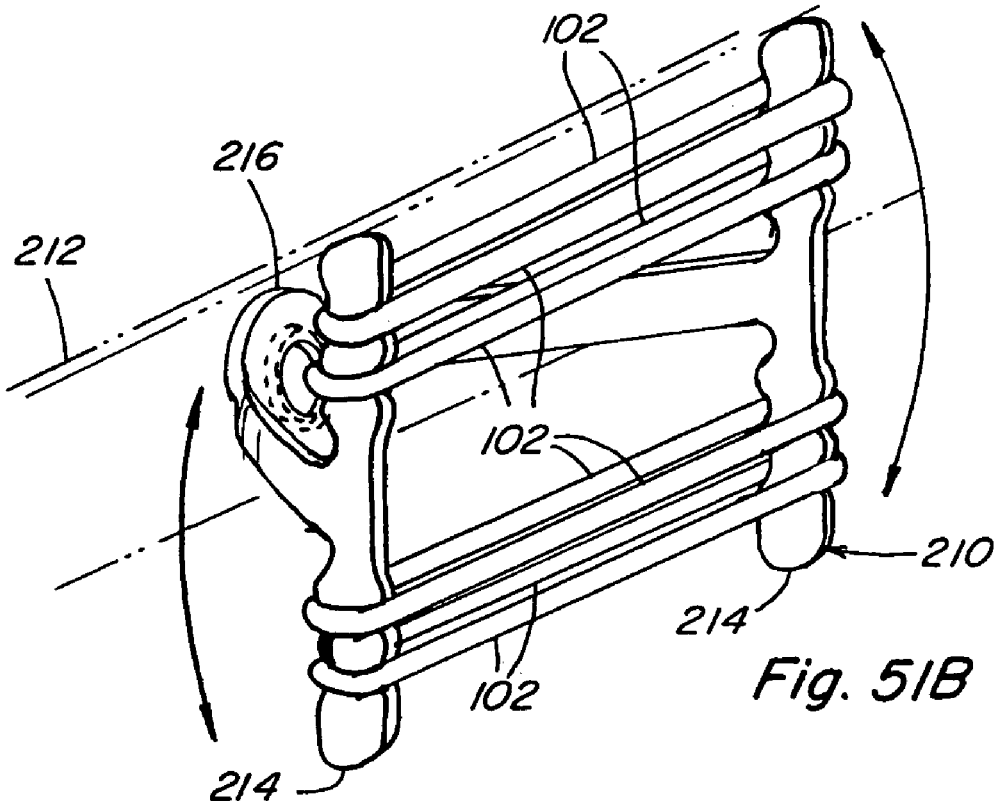
FIG. 51B is a perspective view of the exercise element of FIGS. 51 and 51A.
Figure 51A:
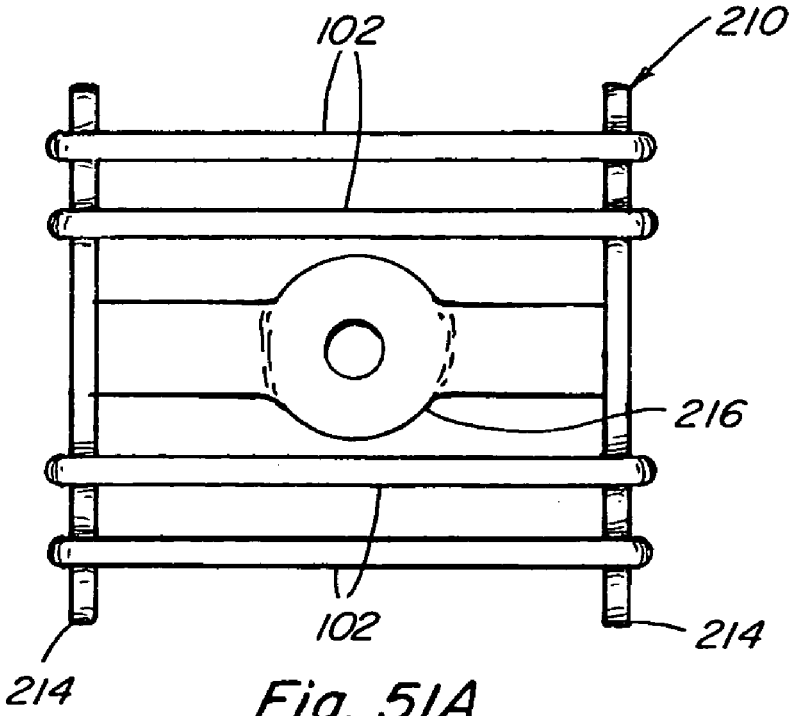
FIG. 51A is an end view of one of the exercise elements of FIG. 51.

FIG. 51 and also FIGS. 51A and 51B show also a still additional exercise element which includes a frame member 210 mountable at a desired location on apparatus 50, such as, but not limited to, between forward legs 70, such as on a cross bar 212 mounted to and extending between forward legs 70. Frame member 210 includes a pair of spaced apart bars 214 between which are supported and extend a plurality of elastic cords 102. Cords 102 can be grasped and pulled rearwardly and upwardly, downwardly, and/or sidewardly away from frame member 210, for performing a resistance exercise and/or stretch in variety of ways and in a variety of planes. One or more of cords 102 can be grasped at one time in one or both hands, and stretched as desired or required to achieve a desired benefit. Frame 210 can be fixedly mounted to cross bar 212, or rotatably mounted thereto for rotation about an axis through hub 216, as illustrated by the arrows in FIG. 51B, using a suitable bolt or other convenient fastener, such as bolt 180 and nut 182 discussed previously. Frame 210 can also be mounted so as to be movable upwardly, downwardly, and/or sidewardly. Cords 102 can be of the same or different elasticity, as desired or required. Cords 102 can also be provided in the form of endless loops or bands that can be stretched between bars 214, or can be tied or otherwise suitably affixed thereto. In use, one or more of cords 102 can be grasped and resiliently extended for performing an arm curl or other exercise, or can be held as the user moves rearwardly on belt 54 of the treadmill for performing a stretch. Here it should be noted that exercise elements such as cords 102 can be supported by rear legs 70 in a similar manner such as by a frame 210 and a cross bar 212, and used similarly, for instance, by grasping a cord or cords 102 and pulling forwardly and upwardly, downwardly, and/or sidewardly away from frame member 210, for performing resistance exercises and/or stretches in a variety of ways and planes. A frame 210 supporting cords 102 can also be supported at a location above a user, such as on support members 66, 68 or on movable frame member 88, as desired. Additionally, cords 102 and/or other exercise elements attached at forward and rearward locations such as just described can be used together in an asymmetrical manner. For instance, one or more forwardly located cords 102 can be grasped in one hand, and one or more rearwardly located cords 102 grasped in the other hand, and the cords sequentially or simultaneously extended. This can be done solely by the arms, solely by the trunk, or a combination of both to achieve a desired exercise benefit, such as core body strengthening.

Figure 52:
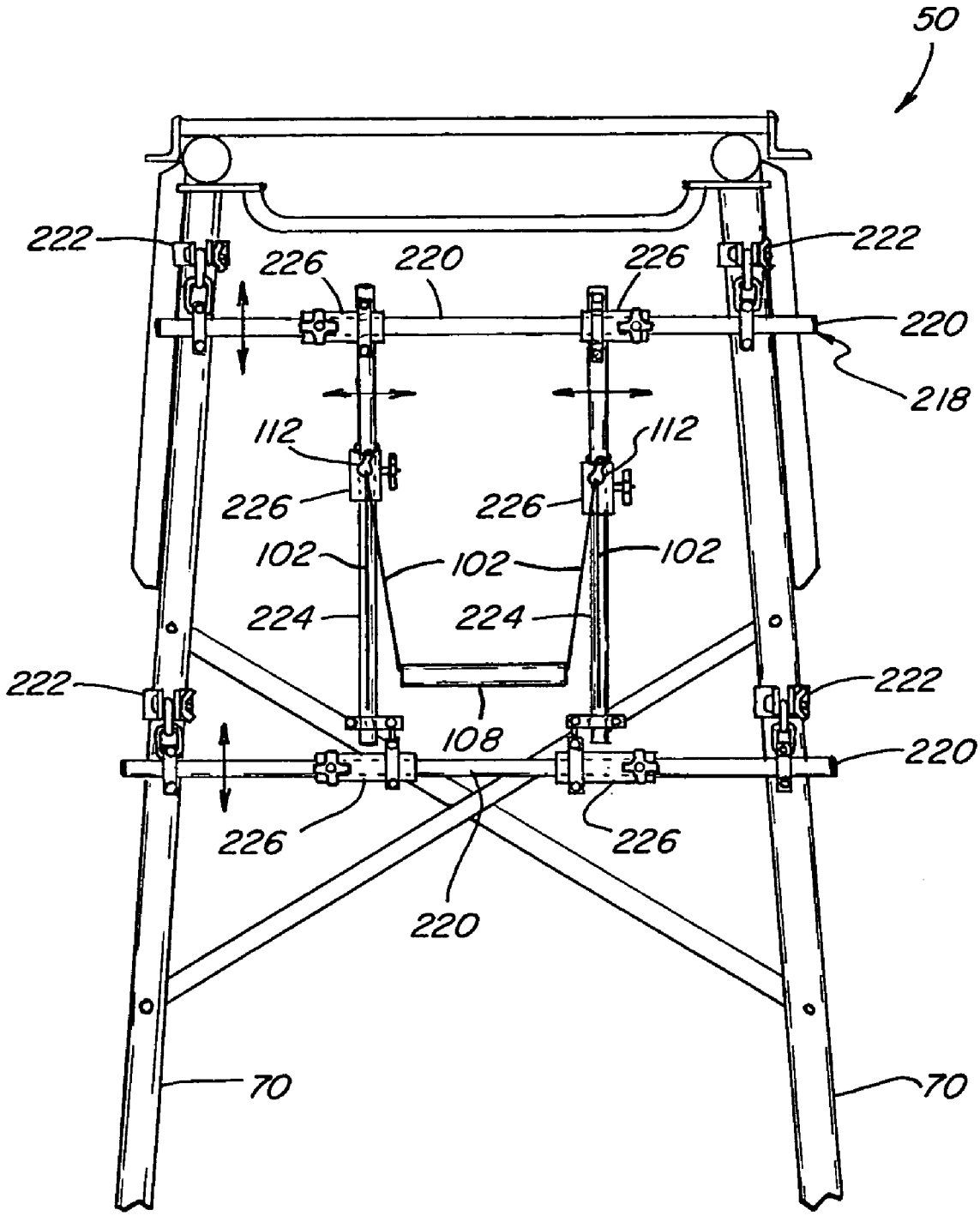
FIG. 52 is a fragmentary end view of the apparatus of FIG. 1, showing apparatus for connecting additional exercise elements to the apparatus.
Figure 52A:
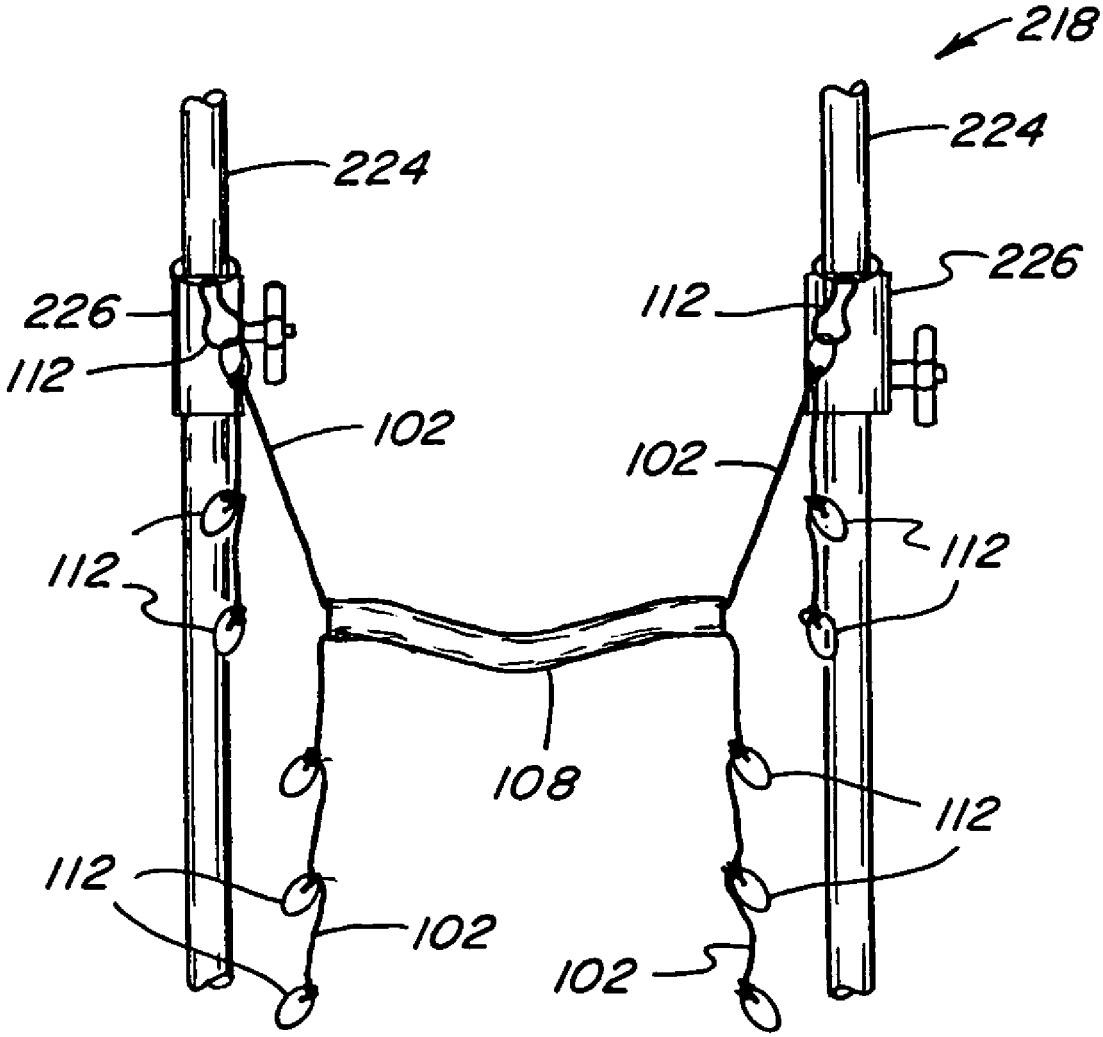
FIG. 52A is a fragmentary end view of the apparatus of FIG. 52, showing a representative exercise element connected thereto.
Figure 53:
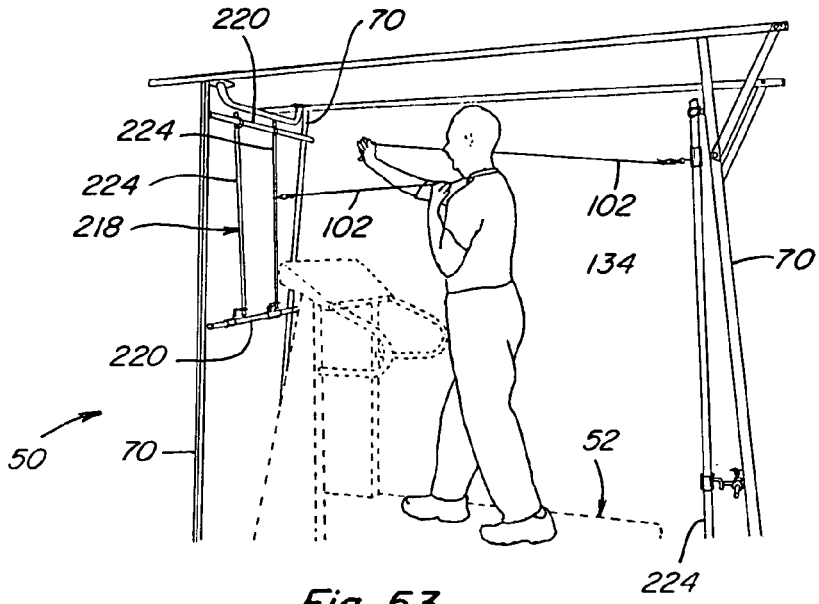
FIG. 53 is a fragmentary perspective view of the apparatus of FIG. 52 and machine of FIG. 1, showing the person using the exercise elements to illustrate unloading and performing a resistance exercise in still another manner.

Referring also to FIGS. 52, 52A and 53, an apparatus 218 is shown connected to forward legs 70 of apparatus 50, for supporting a variety of exercise elements, such as, but not limited to, elastic cords 102 and/or bars 108, for performing a variety of exercises and stretches while performing a cardiovascular exercise on a cardiovascular exercise machine such as, but not limited to, treadmill 52 shown in FIG. 53, or in the absence of usage of a cardiovascular exercise machine. Here, it should be noted that apparatus 218 can be connected to and supported by the forward legs 70 and/or the rearward legs 70, or other structure such as the cardiovascular machine such as a treadmill, as desired or required for a particular application. Apparatus 218 includes a pair of horizontal support bars 220 preferably supported by legs 70 in spanning relation to the space therebetween, by a plurality of sliding clamps 222. Each clamp 222 includes a portion which extends partially around the respective leg 70 and including a suitable detent, fastener or the like, such as a common bolt and wingnut shown threadedly engageable for clamping at a desired location along the length of leg 70. Clamp 222 can be released to allow movement of the support bar 220 connected thereto, as denoted by the vertical arrows, in desired relation to a cardiovascular exercise machine on which a user, such as man 134, is to exercise. Bars 220 support one or more vertical bars 224 in spanning relation therebetween, preferably for slidable horizontal movement, as denoted by the horizontal arrows, to a desired position or positions, on sliding sleeves 226. Sleeves 226 and bars 224 are optionally securable in a desired position along bars 220 by a suitable detent, fastener or the like, such as a common set screw. Additionally, each vertical bar 224 includes an additional sliding sleeve 226 thereon which supports a connector such as eyelets 112 at a desired height, for connection of one or more exercise elements, such as, but not limited to, elastic cords 102 alone, or cords 102 or springs supporting a bar 108, for use by a user such as man 134, in a manner such as shown in FIG. 53.

More particularly, in FIG. 52A two cords 102 are shown passing through or connected to ends of a bar 108 which is curved for better utility for doing different curls. Each cord 102 preferably includes eyelets 112 at spaced intervals along the length thereof selectably connectable to eyelets 112 on a sleeve 226 or on a bar 220 or 224 of apparatus 218, to allow adjusting the effective length, including the length of extension, of cords 102 and the position of bar 108. One or both of the cords 102, and additional cords 102, can be connected to apparatus 218 for achieving a desired degree or amount of resistance.

FIG. 53 illustrates one manner of use of apparatus 218. Here, man 134 is shown grasping an elastic cord 102 connected to a forwardly located vertical bar 224 and pulling rearwardly, and grasping a second cord 102 connected to a vertical bar 224 connected directly to a rear leg 70 and pulling forwardly, to perform an asymmetrical, core body strengthening exercise. Here, it should be recognized that cords 102 can be extended in a variety of different directions for varying the muscle groups used and exercising in multiple planes. By varying the height of the connection of the exercise element to the bar 224, and by varying the position of the bar 224, the exercises can be varied as desired or required for achieving comfort or pain free exercise. Here also it should be noted that vertical bar 224 illustrated in FIG. 53 is shown attached directly to rear leg 70, but could alternatively be supported by horizontal support bars 220, as desired. Still further, rear bar 224 is longer than the forward bars 224, which is to provide an extended capability for performing exercises while lying on a floor (FIG. 54), standing, or sitting, either on an exercise machine such as treadmill 52, or on a floor or other surface. It should also be noted that here man 134 is shown grasping a cord 102 in his left hand which is connected to a bar 224 aligned with the right side of his body, and is grasping a cord 102 in his right hand which is connected to a bar 224 rearwardly of the left side of his body, for torsional loading of the man's trunk, thus illustrating still another variety of exercise and/or stretch that can be performed using the present apparatus.

Figure 54:
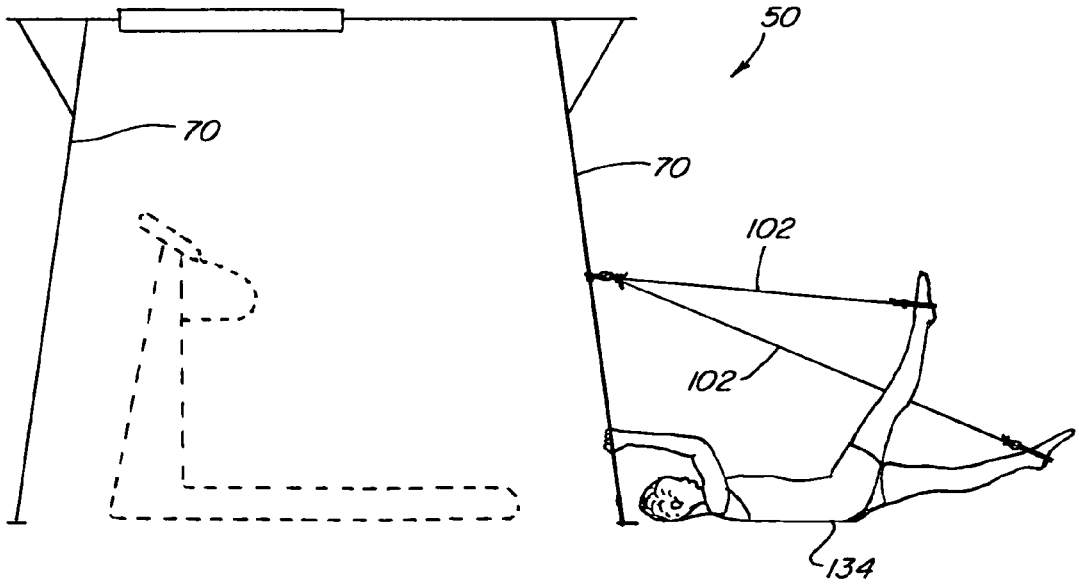
FIG. 54 is another simplified schematic representation of the apparatus of FIG. 52 and machine of FIG. 1, showing the person using the exercise elements to illustrate performing a resistance exercise in still another manner.

Referring also to FIG. 54, cords 102 or other exercise elements supported at forward, rearward and/or elevated locations on apparatus 50 can also be used as desired for performing various exercises and stretches by a person not located on the cardiovascular exercise machine. For example, a person 134 standing, sitting or lying on a floor or other surface adjacent to the present apparatus can grasp or connect to the leg or foot any desired number of the exercise elements such as cords 102 connected at one or more locations to apparatus 50, such as a leg 70 as shown, and extend the exercise elements in a variety of directions and in a variety of manners for performing a variety of exercises and/or stretches such as leg extensions in the manner shown.

Figure 55:
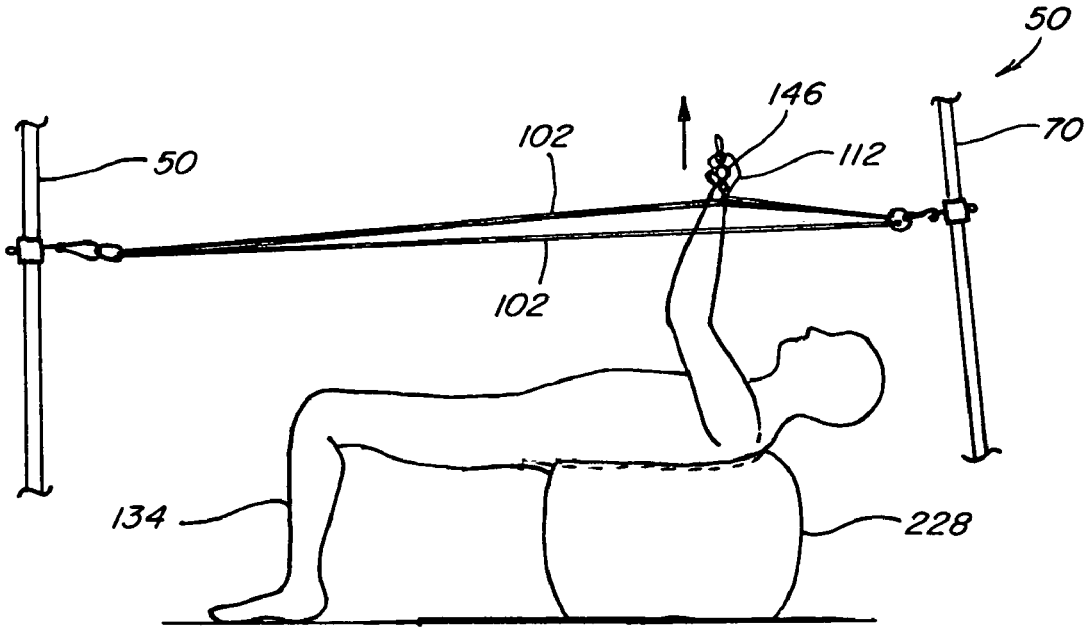
FIG. 55 is another simplified schematic representation of the apparatus of FIG. 1, showing a person lying on an exercise ball and exercising with a bar in connection with exercise elements of the apparatus to illustrate performing a resistance exercise in still another manner.

In FIG. 55 person 134 is shown in position for performing a press type exercise, but with his or her back supported on a well known, commercially available exercise ball 228 located on a surface such as a floor beneath apparatus 50, and his or her feet on the floor. In this and subsequent illustrations shown in FIGS. 55A and B, it should be appreciated that usage of the present apparatus 50 provides the advantage of improved stability and protection against falling, particularly when using free weights, compared to when ball 228 is used without the present apparatus. Person 134 is shown grasping a bar 146 in both hands and pressing upwardly. Here, bar 146 is shown connected to a plurality of cords 102 extending between legs 70, by eyelets 112 or other suitable connectors such as rings or the like, such that the upward press resiliently extends cords 102. Here, it should be noted that bar 146 can be attached to any desired number of cords 102, for selecting a desired level of resistance. Also, by using eyelets 112, or other suitable connectors, the longitudinal position of bar along cords 102 can be varied. Still further, instead of connection by connectors such as eyelets 112, bar 146 could simply be placed beneath a desired number of cords 102 required to provide a desired degree of resistance, as shown in FIG. 40A. By varying the firmness of ball 228, for instance by changing the inflation pressure thereof or using a different ball, different effects can be achieved. Handles such as handles 142 (not shown) could also be used and positioned in desired proximity to bar 146 to vary the resistance, such as shown in FIG. 38C. And, by lying at an angle to horizontal on ball 228, person 134 can perform inclined presses (not shown). By positioning cords 102 sufficiently above person 134, bar 146 could be pulled downwardly against cords 102 for performing curls. Also, by sitting on ball 228, military type or overhead presses can be performed.

Figure 55A:
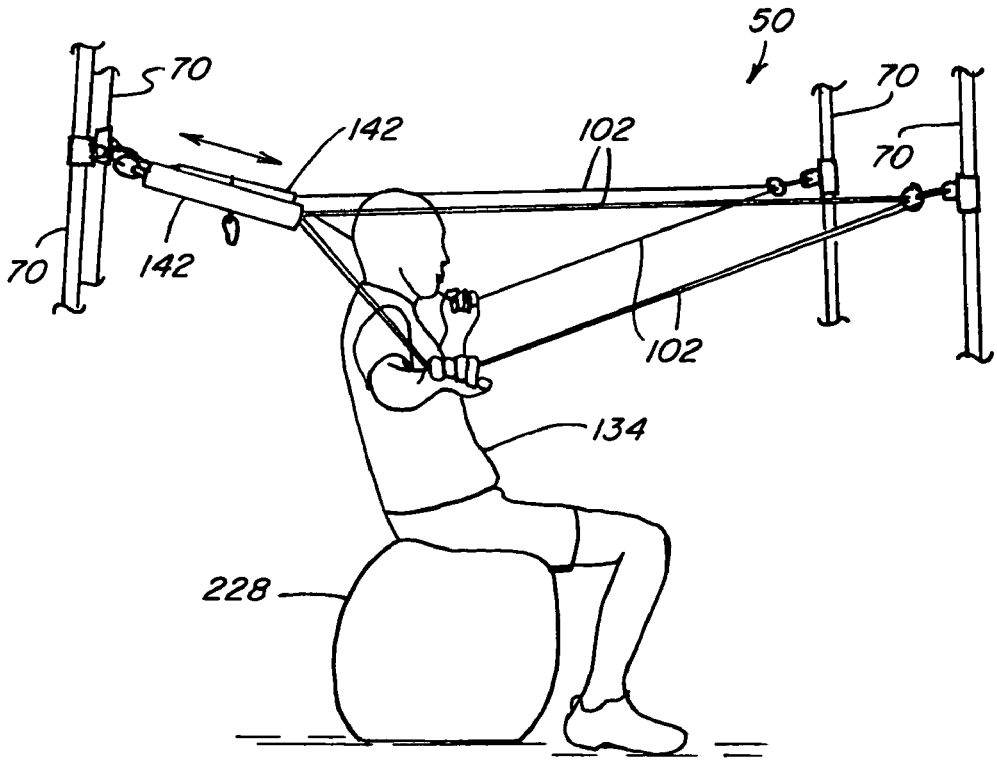
FIG. 55A is another simplified schematic representation of the apparatus of FIG. 1, showing a person sitting on an exercise ball and exercising with exercise elements of the apparatus to illustrate performing a resistance exercise in still another manner.

FIG. 55A is another variant using a ball 228. Here, person 134 is shown seated on ball 228 and grasping a plurality of cords 102 extending forwardly and rearwardly between legs 70 of apparatus 50, and pulling the cords downwardly with his or her arms partially extended, for performing fly type exercises. Again, the number of cords 102 used and the height thereof, as well as the firmness of ball 228 can be varied for differing effect. Handles, such as handles 142 shown can be positioned around the cords 102 used, for varying the degree of resistance. Here also, it should be noted that the selected cords can be pressed upwardly for performing a military type press.

Figure 55B:
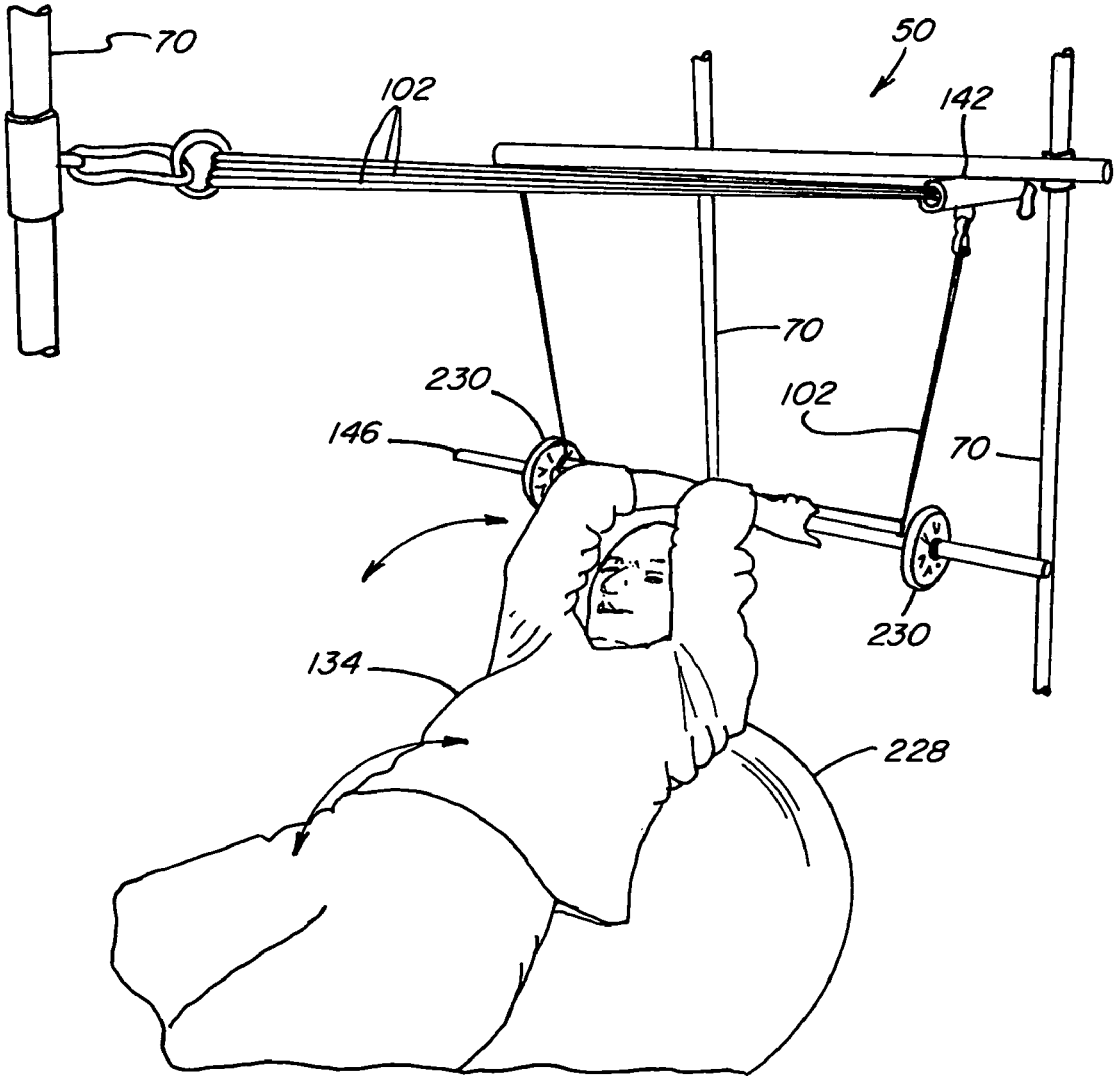
FIG. 55B is another simplified schematic representation of the apparatus of FIG. 1, showing a person lying on an exercise ball and exercising with a bar bell suspended from exercise elements of the apparatus to illustrate performing a resistance exercise in still another manner.

FIG. 55B illustrates still more exercises that can be performed using apparatus 50 and ball 228. Here, person 134 is lying on ball 228 and grasping a bar 146 with both hands over his or her head. Bar 146 is shown including optional free weight plates 230 of a desired weight. Bar 146 is suspended by a cord 102 having opposite ends connected to handles 142 supported by cords 102 extending forwardly and rearwardly between legs 70 of apparatus 50. This allows forward and rearward movement of handles 142 and bar 146 along cords 102. From this position, as denoted by the arrows, person 134 can perform arm extensions by pulling bar 104 in opposition to cords 102 to a desired position over his or her trunk region, and resisted sit ups and/or crunches by bending at the waist in the well known manner. A similar exercise can be performed from a seated position. In either instance, the suspension of bar 146 by cord 102 from apparatus 50 provides better support and stability for person 134 when supported on ball 228, compared to if the present device were not used.

Here, it should be noted that a variety of additional exercises can be performed using an exercise ball such as ball 228, including, but not limited to, exercises with the arms and/or legs performed with the person's chest or trunk supported on ball 228 so as to be facing downwardly.

Accordingly, a feature of the present invention is the provision of resiliently flexible and/or elongatable exercise elements at different locations above and/or beside the predetermined user area of a cardiovascular exercise machine, which elements can be resiliently flexed and/or elongated in various combinations for unloading, resistance exercising, and/or stretching in various ways in multiple planes. The exercise elements afford a widely variable ability to perform resistance exercises and stretches for a number of muscle groups of the arms, shoulders, back, abdomen and legs. While using the present apparatus during a cardiovascular exercise session, a user can unload a desired portion of his or her weight from the weight bearing elements of the cardiovascular exercise machine in one, or several ways. For instance, the user can continuously unload by continuously pressing down on one or more of cords 102 positioned at his or her sides, pulling down on cords 102 at higher locations, and/or pulling down on one or more bars 108 or straps 106, to achieve a desired unloading effect. This can be done in a symmetrical manner or asymmetrically, and can also be used as a component of variety of resistance exercises and/or stretches. Additionally, as a variety of the same or exercise elements at different positions are provided, a user can utilize the various exercise elements alternatingly, or in a desired sequence, as desired for achieving a broad fitness benefit and/or as required for comfortably exercising. By grasping bar 108 and doing chin-ups or pull-ups, or by lifting one's body using bars 204 or other overhead structure a user can also completely remove his or her weight from the weight bearing elements of the cardiovascular exercise machine.

Thus, there has been shown and described a novel invention in several embodiments of a variable unloading and resistance exercise apparatus which overcomes many of the problems set forth above. It will be apparent, however, to those familiar in the art, that many changes, variations, modifications, and other uses and applications for the subject device are possible. All such changes, variations, modifications, and other uses and applications that do not depart from the spirit and scope of the invention are deemed to be covered by the invention which is limited only by the claims which follow.

What is claimed is:

1. A variable unloading and resistance exercise device for use by a person when performing a cardiovascular exercise, comprising:

a cardiovascular exercise machine in which at least a portion of the person's weight is supported by at least one lower extremity of the person's body in moving contact with a movable weight bearing element of the machine disposed so as to be located beneath the person for performing the cardiovascular exercise;

a support element and structure for supporting the support element above the movable weight bearing element of the cardiovascular exercise machine; and a plurality of resiliently yieldable exercise elements suspended from the support element at different locations over the movable weight bearing element, including at least one exercise element disposed at a first elevation so as to be located at least generally in front of the person and graspable in a hand of the person when performing the cardiovascular exercise, and at least one exercise element disposed at a second elevation lower than the first elevation so as to be located at least generally beside the person and graspable in a hand of the person when performing the cardiovascular exercise, such that when performing the cardiovascular exercise the person can alternatingly grasp the exercise elements disposed at the first and second elevations and resiliently extend them in a sufficient number of directions for performing different resistance exercises in different ways involving several muscle groups of the person, including downwardly for reducing the portion of the person's weight supported by the movement of the at least one lower extremity of the person's body in moving contact with the movable weight bearing element of the machine and sidewardly, wherein the support element comprises a frame including at least one member supported over the cardiovascular exercise machine and supporting the exercise elements and configured to be movable along the frame through a range of positions over the movable weight bearing element of the cardiovascular exercise machine for positioning the exercise elements at different locations thereover, and wherein the at least one exercise element supported by said at least one member is suspended therefrom for movement relative thereto.

2. The device of claim 1 wherein the first elevation is sufficient such that the at least one of the exercise elements disposed so as to be located in front of the person will be positioned about in front of a head of the person.

3. The device of claim 1 wherein the at least one exercise element disposed at the first elevation includes a plurality of resiliently elongatable cords graspable individually or in a desired number and elongatable in a plurality of directions including at least one downward direction and at least one forward direction for performing several of the resistance exercises.

4. The device of claim 1 wherein at least some of the exercise elements comprise resiliently elongatable cords and the support element includes connectors at a plurality of different locations above the weight bearing element for connecting to and supporting the cords.

5. The device of claim 1 wherein the cardiovascular exercise machine comprises a treadmill and the weight bearing element comprises an endless belt of the treadmill.

6. The device of claim 1 wherein the cardiovascular exercise machine comprises a stationary cycle and the weight bearing element comprises pedals of the cycle.

7. The device of claim 1 wherein the cardiovascular exercise machine comprises an elliptical exercise machine and the weight bearing element comprises pedals of the elliptical exercise machine.

8. The device of claim 1, wherein the at least one exercise element further includes at least one elongate resiliently yieldable element supported by and extending between members of the frame in position to be grasped in a hand of the person and yieldably extended for performing another resistance exercise, and the at least one elongate resiliently yieldable element includes elements positioned so as to be located above a head of the person when exercising using the cardiovascular exercise machine.

9. The device of claim 8, wherein the at least one elongate resiliently yieldable element includes elements positioned so as to be located beside the body of the person when exercising using the cardiovascular exercise machine.

10. The device of claim 1, wherein the plurality of exercise elements suspended from the support element at at least one of the locations comprises a plurality of generally parallel elastic cords, a selected number of the cords being graspable and extendable for providing a corresponding desired amount of resistance.

11. A combination cardiovascular and variable unloading and resistance exercise device for use by a person when performing a cardiovascular exercise, comprising;

a cardiovascular exercise machine in which at least a portion of a person's weight is supported by at least one lower extremity of the person's body in moving contact with a weight bearing element of the machine for performing a cardiovascular exercise on the machine;

a support element and structure for supporting the support element above the weight bearing element of the exercise machine; and a plurality of resiliently yieldable exercise elements suspended from the support element at different locations over the weight bearing element, including at least one exercise element disposed at a first elevation so as to be located at least generally in front of the person and graspable in a hand of the person when performing the cardiovascular exercise, and at least one exercise element disposed at a second elevation lower than the first elevation so as to be located at least generally beside the person and graspable in a hand of the person when performing the cardiovascular exercise, such that when performing the cardiovascular exercise the person can alternatingly grasp the exercise elements disposed at the first and second elevations and resiliently extend them in a sufficient number of directions for performing different resistance exercises in different ways involving several muscle groups of the person, including downwardly for reducing the portion of the person's weight supported by the movement of the at least one lower extremity of the person's body in moving contact with the weight bearing element of the machine and sidewardly, wherein the support element comprises a structural frame including at least one member supported over the cardiovascular exercise machine and supporting the exercise elements, and wherein the at least one exercise element further includes at least one elongate resiliently yieldable element supported by and extending generally horizontally between portions of the frame in position to be grasped in a hand of the person and yieldably extended for performing another resistance exercise.

12. The device of claim 11, wherein the at least one elongate resiliently yieldable element includes elements positioned so as to be located above a head of the person when exercising using the cardiovascular exercise machine.

13. The device of claim 11, wherein the at least one elongate resiliently yieldable element includes elements positioned so as to be located beside the body of the person when exercising using the cardiovascular exercise machine.

14. The device of claim 11, wherein the plurality of exercise elements suspended from the support element at at least one of the locations comprises a plurality of generally parallel elastic cords, a selected number of the cords being graspable and extendable for providing a corresponding desired amount of resistance.

15. The device of claim 11 wherein the first elevation is sufficient such that the at least one of the exercise elements disposed so as to be located in front of the person will be positioned about in front of a head of the person.

16. The device of claim 11 wherein the at least one exercise element disposed at the first elevation includes a plurality of resiliently elongatable cords graspable individually or in a desired number and elongatable in a plurality of directions including at least one downward direction and at least one forward direction for performing several of the resistance exercises.

17. The device of claim 11 wherein at least some of the exercise elements comprise resiliently elongatable cords and the support element includes connectors at a plurality of different locations above the weight bearing element for connecting to and supporting the cords.

18. The device of claim 11 wherein the cardiovascular exercise machine comprises a treadmill and the weight bearing element comprises an endless belt of the treadmill.

19. The device of claim 11 wherein the cardiovascular exercise machine comprises a stationary cycle and the weight bearing element comprises pedals of the cycle.

20. The device of claim 11 wherein the cardiovascular exercise machine comprises an elliptical exercise machine and the weight bearing element comprises pedals of the elliptical exercise machine.

21. The device of claim 11, wherein the at least one exercise element supported by said at least one member is suspended therefrom for movement relative to the support element.

22. The device of claim 21, wherein the member is movable for positioning the at least one exercise element at different locations above the weight bearing element.

* * * * *